US006686140B2

(12) United States Patent
Asanuma et al.

(10) Patent No.: US 6,686,140 B2
(45) Date of Patent: Feb. 3, 2004

(54) SILVER HALIDE PHOTOSENSITIVE MATERIAL

(75) Inventors: Naoki Asanuma, Minami-Ashigara (JP); Kohzaburoh Yamada, Minami-Ashigara (JP); Yasuhiro Shimada, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/383,771

(22) Filed: Mar. 10, 2003

(65) Prior Publication Data

US 2003/0224309 A1 Dec. 4, 2003

(30) Foreign Application Priority Data

Mar. 12, 2002 (JP) ..... 2002-067259
Jan. 30, 2003 (JP) ..... 2003-022480

(51) Int. Cl.[7] ..... G03C 1/08; G03C 1/12; G03C 1/34; G03C 1/42; G03C 7/392

(52) U.S. Cl. ..... 430/566; 430/599; 430/600; 430/603; 430/607; 430/613; 430/955

(58) Field of Search ..... 430/599, 600, 430/603, 955, 566, 578, 583, 584, 588, 592, 595, 580, 581, 607, 613

(56) References Cited

U.S. PATENT DOCUMENTS 6,514,683 B2 * 2/2003 Muenter et al. ..... 430/603
6,593,075 B1 * 7/2003 Ichikawa et al. ..... 430/603

FOREIGN PATENT DOCUMENTS

EP 1 227 365 A1 7/2002
JP 11-119364 A 4/1999
JP 2001-42466 A 2/2001

* cited by examiner

*Primary Examiner*—Richard L. Schilling
(74) *Attorney, Agent, or Firm*—Sughrue Mion, PLLC

(57) ABSTRACT

A silver halide photosensitive material comprises at least one light sensitive silver halide emulsion layer on a support. The silver halide photosensitive material contains at least one compound capable of undergoing a one-electron oxidation to thereby form a one-electron oxidation product thereof, the one-electron oxidation product being capable of releasing further one or more electrons, and at least one reducing compound having a C/H value of 3 or less; and another reducing compound having a C/H value of more than 3, the C/H value representing a ratio of (the number of Group IV elements)/(the sum of Groups III, V, VI and VII elements).

14 Claims, No Drawings

SILVER HALIDE PHOTOSENSITIVE MATERIAL

CROSS-REFERENCE TO RELATED APPLICATIONS

This application is based upon and claims the benefit of priority from the prior Japanese Patent Applications No. 2002-67259, filed Mar. 12, 2002; No. 2003-22480, filed Jan. 30, 2003, the entire contents of both of which are incorporated herein by reference.

BACKGROUND OF THE INVENTION

1. Field of the Invention

The present invention relates to a silver halide photosensitive material. Particularly, the present invention relates to a silver halide photosensitive material that reconciles high photographic speed and low fog.

2. Description of the Related Art

The silver halide photosensitive material principally comprises a support and, superimposed thereon, a dispersion medium containing lightsensitive silver halide grains. Extensive investigations have been conducted for increasing the photographic speed of silver halide lightsensitive material. Increasing the inherent sensitivity of silver halide grains is very important for attaining an increase of the photographic speed of silver halide lightsensitive material. Various methods have been employed for increasing the inherent sensitivity of silver halides with respect to such silver halide grains.

For example, there have been employed a sensitivity enhancement wherein use is made of a chemical sensitizer such as sulfur, gold or a compound of a metal of Group VIII, a sensitivity enhancement wherein a chemical sensitizer such as sulfur, gold or a compound of a metal of Group VIII is used in combination with an additive capable of intensifying the sensitizing effect thereof, and a sensitivity enhancement wherein use is made of an additive capable of exerting a sensitizing effect depending on silver halide emulsion species. Further, a method of conducting a reduction sensitization of silver halide grains has been employed as means for enhancing a photographic sensitivity.

Still further, recently, a sensitizing technology wherein use is made of an organic electron-donating compound having an electron-donating group and a split-off group has been reported (see, for example, U.S. Pat. No. (hereinafter also referred to as U.S. Pat. No. ) 5,747,235 and U.S. Pat. No. 5,747,236; European Patent Publication No. (hereinafter also refereed to as EP) 786692A1, EP's 893731A1 and 893732A1; and U.S. Pat. No. 5,994,051). This is a novel sensitivity-enhancing technology and is effective for sensitivity enhancement.

However, the use of this organic electron-donating compound, although a sensitivity enhancement can be attained, is accompanied by an increase of fog (Dmin). Further, the use of this organic electron-donating compound has a drawback in that the storability would be deteriorated. Therefore, there has been a strong demand for improvement. For overcoming these problems, a joint use with a precursor type antifoggant (see, for example, U.S. Pat. No. 6,472,134B1) and a joint use with a storability improver (see, for example, EP 1227365A1 and Jpn. Pat. Appln. KOKAI No. (hereinafter also referred to as JP-A-) 11-119364 and JP-A-2001-42466) have been studied and improvement thereby has been attempted. However, the attained improvement is still unsatisfactory, and a further improvement is desired.

BRIEF SUMMARY OF THE INVENTION

An object of the present invention is to solve the above problems of the prior art. Specifically, it is an object of the present invention to provide a silver halide photosensitive material of high speed and low fog. That is, the present invention is intended to not only attain a sensitivity enhancement by the use of a novel organic electron-donating compound, of tabular grains of high aspect ratio and large size by the use of a novel organic electron-donating compound but also reduce the fog at fresh and the fog after storage by the use of specific reducing compounds in combination.

The objects of the present invention have been attained by the following means.

(1) A silver halide photosensitive material comprising at least one light sensitive silver halide emulsion layer on a support, wherein the silver halide photosensitive material contains:

at least one compound capable of undergoing a one-electron oxidation to thereby form a one-electron oxidation product thereof, wherein the one-electron oxidation product is capable of releasing further one or more electrons, and at least one reducing compound having a C/H value of 3 or less, and another reducing compound having a C/H value of more than 3, wherein the C/H value represents a ratio of (the number of Group IV elements)/(the sum of Groups III, V, VI and VII elements).

(2) A silver halide photosensitive material comprising at least one light sensitive silver halide emulsion layer on a support, wherein the silver halide photosensitive material contains:

at least one compound capable of undergoing a one-electron oxidation to thereby form a one-electron oxidation product thereof, wherein the one-electron oxidation product is capable of releasing further one or more electrons, and at least one reducing compound having a molecular weight of 300 or less, and another reducing compound having a molecular weight of more than 300.

(3) The silver halide photosensitive material according to (1) or (2), wherein the one-electron oxidation product generated by one-electron oxidation, is capable of releasing further two or more electrons.

(4) The silver halide photosensitive material according to any one of (1) to (3), wherein the compound capable of undergoing a one-electron oxidation to thereby form a one-electron oxidation product thereof, wherein the one-electron oxidation product is capable of releasing further one or more electrons, is selected from the following compounds of types 1 to 5:

(Type 1)

A compound capable of undergoing a one-electron oxidation to thereby form a one-electron oxidation product thereof, wherein the one-electron oxidation product is capable of releasing further two or more electrons accompanying a subsequent bond cleavage reaction;

(Type 2)

A compound capable of undergoing a one-electron oxidation to thereby form a one-electron oxidation product thereof, wherein the one-electron oxidation product is capable of releasing further one electron accompanying a subsequent bond cleavage reaction, and the compound has, in its molecule, two or more groups adsorptive to silver halide;

(Type 3)

A compound capable of undergoing a one-electron oxidation to thereby form a one-electron oxidation product thereof, wherein the one-electron oxidation product is capable of releasing further one or more electrons after going through a subsequent bond forming process;

(Type 4)

A compound capable of undergoing a one-electron oxidation to thereby form a one-electron oxidation product thereof, wherein the one-electron oxidation product is capable of releasing further one or more electrons after going through a subsequent intramolecular ring cleavage reaction; and (Type 5)

A compound having a formula: X—Y wherein X represents a reducing group, and Y represents a splitting-off group, wherein the reducing group represented by X is capable of undergoing a one-electron oxidation to thereby form a one-electron oxidation product thereof, from which Y is split accompanying a subsequent cleavage reaction of X—Y bond to thereby form an X radical, the X radical capable of further releasing one electron.

(5) The silver halide photosensitive material according to any one of (1) to (4), wherein the compounds of types 1 to 5 are represented by the following general formula (A), general formula (B), general formula (1), general formula (2), general formula (3), general formula (C), general formula (D), general formula (E), general formula (F) or general formula (G):

(A)

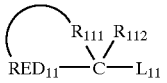

(B)

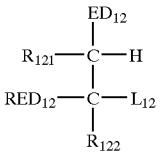

(1)

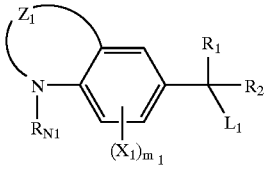

(2)

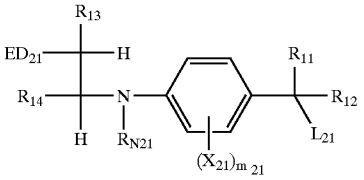

(3)

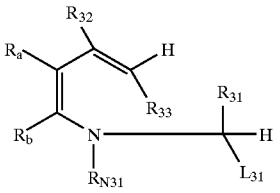

-continued (C)

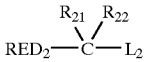

(D)

(E)

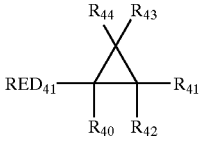

(F)

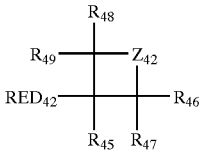

(G)

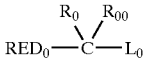

In the general formula (A), $RED_{11}$ represents a one-electron oxidizable reducing group; $L_{11}$ represents a split-off group; $R_{112}$ represents a hydrogen atom or substituent; and $R_{111}$ represents a nonmetallic atomic group capable of forming, together with carbon atom (C) and $RED_{11}$, a specific 5- or 6-membered cyclic structure, wherein the 5- or 6-membered cyclic structure means a tetrahydro form, hexahydro form or octahydro form of a 5- or 6-membered aromatic ring (including an aromatic heterocycle).

In the general formula (B), $RED_{12}$ represents a one-electron oxidizable reducing group; $L_{12}$ represents a split-off group; each of $R_{121}$ and $R_{122}$ represents a hydrogen atom or substituent; and $ED_{12}$ represents an electron-donating group. In the general formula (B), $R_{121}$ and $RED_{12}$, or $R_{121}$ and $R_{122}$, or $ED_{12}$ and $RED_{12}$ may be bonded with each other to thereby form a cyclic structure.

In the general formula (1), $Z_1$ represents an atomic group capable of forming a 6-membered ring together with the nitrogen atom and the two carbon atoms of the benzene ring; each of $R_1$, $R_2$ and $R_{N1}$ represents a hydrogen atom or substituent; $X_1$ represents a group capable of substituting on the benzene ring; $m_1$ is an integer of 0 to 3; and $L_1$ represents a split-off group. In the general formula (2), $ED_{21}$ represents an electron-donating group; each of $R_{11}$, $R_{12}$, $R_{N21}$, $R_{13}$ and $R_{14}$ represents a hydrogen atom or substituent; $X_{21}$ represents a substituent capable of substituting on the benzene ring; $m_{21}$ is an integer of 0 to 3; and $L_{21}$ represents a split-off group. Any two of $R_{N21}$, $R_{13}$, $R_{14}$, $X_{21}$ and $ED_{21}$ may be bonded with each other to thereby form a cyclic structure. In the general formula (3), each of $R_{32}$, $R_{33}$, $R_{31}$, $R_{N31}$, $R_a$ and $R_b$ represents a hydrogen atom or substituent; and $L_{31}$ represents a split-off group. Provided that, when $R_{N31}$ represents a group other than an aryl group, $R_a$ and $R_b$ are bonded to each other to thereby form an aromatic ring.

In the general formula (C), $RED_2$ has the same meaning as $RED_{12}$ of the general formula (B); $L_2$ has the same meaning as $L_{11}$ of the general formula (A), provided that when $L_2$ represents a silyl group the compound represented by the general formula (C) has, in its molecular, a nitrogen-containing heterocycle that is substituted with two or more mercapto groups, as the group adsorptive to silver halide; each of $R_{21}$ and $R_{22}$ represents a hydrogen atom or substituent; and $RED_2$ and $R_{21}$ may be bonded with each other to thereby form a cyclic structure.

In the general formula (D), $RED_3$ represents a one-electron oxidizable reducing group; $Y_3$ represents a reactive moiety that reacts with one electron oxidized $RED_3$. Specifically, $Y_3$ represents an organic group having a carbon-carbon double bond moiety, carbon-carbon triple bond moiety, aromatic moiety or benzo-condensed nonaromatic heterocyclic group. $L_3$ represents a linking group that links between $RED_3$ and $Y_3$.

In the general formulae (E) and (F), each of $RED_{41}$ and $RED_{42}$ has the same meaning as $RED_{12}$ of the general formula (B); and each of $R_{40}$ to $R_{44}$ and $R_{45}$ to $R_{49}$ represents a hydrogen atom or substituent. In the general formula (F), $Z_{42}$ represents —$CR_{420}R_{421}$—, —$NR_{423}$— or —O—. Herein, each of $R_{420}$ and $R_{421}$ represents a hydrogen atom or substituent; and $R_{423}$ represents a hydrogen atom, alkyl group, aryl group or heterocyclic group.

In the general formula (G), $RED_0$ represents a reducing group; $L_0$ represents a splitting-off group; and $R_0$ and $R_{00}$ each represents a hydrogen atom or substituent. $RED_0$ and $R_0$, or $R_0$ and $R_{00}$ may be bonded together to form a cyclic structure.

(6) The silver halide photosensitive material according to any one of (1) to (5), wherein the reducing compound is a compound selected from the group consisting of hydroxylamines, hydroxamic acids, hydroxyureas, hydroxyurethanes, hydroxysemicarbazides, reductons (including reducton derivatives), anilines, phenols (including chroman-6-ols, 2,3-dihydrobenzofuran-5-ols, aminophenols, sulfonamidophenols, and polyphenols such as hydroquinones, catechols, resorcinols, benzenetriols and bisphenols), hydrazines, hydrazides, and Phenidons.

(7) The silver halide photosensitive material according to (6), wherein the reducing compound is a compound selected from the group consisting of hydroxylamines represented by the following general formula ($B_{14}$) and hydroxamic acids represented by the following general formula ($B_{15}$):

($B_{14}$)

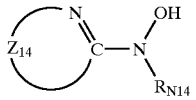

($B_{15}$)

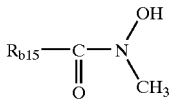

In the general formula ($B_{14}$), $R_{N14}$ represents a hydrogen atom, alkyl group or aryl group, and $Z_{14}$ represents a nonmetallic atom group capable of forming, together with —N=C—, a 5- to 7-membered heterocycle.

In the general formula ($B_{15}$), $Rb_{15}$ represents a hydrogen atom, alkyl group, aryl group or heterocycle.

(8) The silver halide photosensitive material according to any one of (1) to (7), wherein the compounds of types 1 to 5 each has, in its molecule, a group adsorptive to silver halide or a partial structure of sensitizing dye.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The compound capable of undergoing a one-electron oxidation to thereby form a one-electron oxidation product thereof, wherein the one-electron oxidation product is capable of releasing further one or more electrons, is preferably selected from the following compounds of types 1 to 5:

(Type 1)

A compound capable of undergoing a one-electron oxidation to thereby form a one-electron oxidation product thereof, wherein the one-electron oxidation product is capable of releasing further two or more electrons accompanying a subsequent bond cleavage reaction;

(Type 2)

A compound capable of undergoing a one-electron oxidation to thereby form a one-electron oxidation product thereof, wherein the one-electron oxidation product is capable of releasing further one electron accompanying a subsequent bond cleavage reaction, and the compound has, in its molecule, two or more groups adsorptive to silver halide;

(Type 3)

A compound capable of undergoing a one-electron oxidation to thereby form a one-electron oxidation product thereof, wherein the one-electron oxidation product is capable of releasing further one or more electrons after going through a subsequent bond forming process;

(Type 4)

A compound capable of undergoing a one-electron oxidation to thereby form a one-electron oxidation product thereof, wherein the one-electron oxidation product is capable of releasing further one or more electrons after going through a subsequent intramolecular ring cleavage reaction; and (Type 5)

A compound having a formula: X—Y wherein X represents a reducing group, and Y represents a splitting-off group. The compound of type 5 is such a compound that the reducing group represented by X is capable of undergoing a one-electron oxidation to thereby form a one-electron oxidation product thereof, from which Y is split accompanying a subsequent cleavage reaction of X—Y bond to thereby form an X radical, the X radical capable of further releasing one electron.

Among the compounds of types 1, and 3 to 5, preferable ones are "compounds having, in its molecular, an adsorptive group to silver halide" or "compounds having, in its molecular, a partial structure of spectral sensitizing dye". More preferable compounds are "compounds having, in its molecular, an adsorptive group to silver halide".

The compounds of types 1 to 5 will now be described in detail.

With respect to the compound of type 1, the expression "bond cleavage reaction" refers to the cleavage of a carbon-carbon bond, carbon-silicon bond, carbon-hydrogen bond, carbon-boron bond, carbon-tin bond, or carbon-germanium bond. Cleavage of carbon-hydrogen bond may further accompany the above bond cleavage. The compound of type 1 is a compound capable of undergoing a one-electron oxidation to thereby form a one-electron oxidation product. The one-electron oxidation product only thereafter capable of undergoing a bond cleavage reaction to thereby further release two or more electrons (preferably three or more electrons).

In another expression, the one-electron oxidation product of the compound of type 1 is capable of being oxidized with further two or more electrons (preferably three or more electrons).

Among the compounds of type 1, preferable compounds are represented by the general formula (A), general formula (B), general formula (1), general formula (2) or general formula (3):

(A)

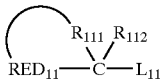

(B)

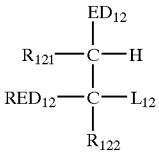

In the general formula (A), $RED_{11}$ represents a one-electron oxidizable reducing group; $L_{11}$ represents a split-off group; $R_{112}$ represents a hydrogen atom or substituent; and $R_{111}$ represents a nonmetallic atomic group capable of forming, together with carbon atom (C) and $RED_{11}$, a specific 5- or 6-membered cyclic structure, wherein the 5- or 6-membered cyclic structure means a tetrahydro form, hexahydro form or octahydro form of a 5- or 6-membered aromatic ring (including an aromatic heterocycle).

In the general formula (B), $RED_{12}$ represents a one-electron oxidizable reducing group; $L_{12}$ represents a split-off group; each of $R_{121}$ and $R_{122}$ represents a hydrogen atom or substituent; and $ED_{12}$ represents an electron-donating group. In the general formula (B), $R_{121}$ and $RED_{12}$, or $R_{121}$ and $R_{122}$, or $ED_{12}$ and $RED_{12}$ may be bonded with each other to thereby form a cyclic structure.

These compounds are those which, after a one-electron oxidation of the reducing group represented by $RED_{11}$ or $RED_{12}$ of the general formula (A) or general formula (B), can spontaneously split $L_{11}$ or $L_{12}$ through a bond cleavage reaction, namely, cleave the C (carbon atom)—to—$L_{11}$ bond or the C (carbon atom)—to—$L_{12}$ bond to thereby further release two or more electrons, preferably three or more electrons.

(1)

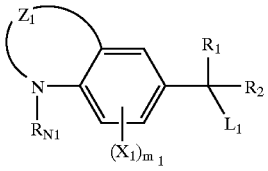

(2)

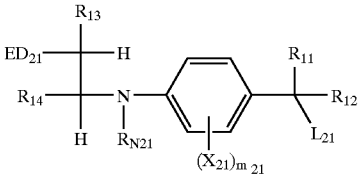

(3)

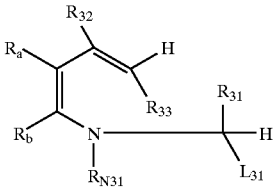

In the general formula (1), $Z_1$ represents an atomic group capable of forming a 6-membered ring together with the nitrogen atom and the two carbon atoms of the benzene ring; each of $R_1$, $R_2$ and $R_{N1}$ represents a hydrogen atom or substituent; $X_1$ represents a group capable of substituting on the benzene ring; $m_1$ is an integer of 0 to 3; and $L_1$ represents a split-off group. In the general formula (2), $ED_{21}$ represents an electron-donating group; each of $R_{11}$, $R_{12}$, $R_{N21}$, $R_{13}$ and $R_{14}$ represents a hydrogen atom or substituent; $X_{21}$ represents a substituent capable of substituting on the benzene ring; $m_{21}$ is an integer of 0 to 3; and $L_{21}$ represents a split-off group. Any two of $R_{N21}$, $R_{13}$, $R_{14}$, $X_{21}$ and $ED_{21}$ may be bonded with each other to thereby form a cyclic structure. In the general formula (3), each of $R_{32}$, $R_{33}$, $R_{31}$, $R_{N31}$, $R_a$ and $R_b$ represents a hydrogen atom or substituent; and $L_{31}$ represents a split-off group. Provided that, when $R_{N31}$ represents a group other than an aryl group, $R_a$ and $R_b$ are bonded to each other to thereby form an aromatic ring.

These compounds are those which, after a one-electron oxidation, can spontaneously split $L_1$, $L_{21}$ or $L_{31}$ through a bond cleavage reaction, namely, cleave the C (carbon atom)—to—$L_1$ bond, the C (carbon atom)—to—$L_{21}$ bond or the C (carbon atom)—to—$L_{31}$ bond to thereby further release two or more electrons, preferably three or more electrons.

First, the compound represented by the general formula (A) will be described in detail below.

In the general formula (A), the reducing group represented by $RED_{11}$ that is capable of being oxidized with one-electron, is a group capable of bonding with $R_{111}$ described later to thereby form a specific ring. The reducing group can be, for example, a divalent group corresponding to a monovalent group, as mentioned below, having one hydrogen atom removed therefrom at a position that is appropriate for cyclization. The monovalent group can be, for example, any of an alkylamino group, arylamino group (e.g., anilino, naphthylamino), heterocyclic amino group (e.g., benzothiazolylamino, pyrrolylamino), alkylthio group, arylthio group (e.g., phenylthio), heterocyclic thio group, alkoxy group, aryloxy group (e.g., phenoxy), heterocyclic oxy group, aryl group (e.g., phenyl, naphthyl, anthranyl) and aromatic or nonaromatic heterocyclic group (for example, 5- to 7-membered monocyclic or condensed heterocycle containing at least one hetero atom selected from a group consisting of a nitrogen atom, sulfur atom, oxygen atom and selenium atom, which heterocycle can be, for example, a tetrahydroquinoline ring, tetrahydroisoquinoline ring, tetrahydroquinoxaline ring, tetrahydroquinazoline ring, indoline ring, indole ring, indazole ring, carbazole ring, phenoxazine ring, phenothiazine ring, benzothiazoline ring, pyrrole ring, imidazole ring, thiazoline ring, piperidine ring, pyrrolidine ring, morpholine ring, benzimidazole ring, benzimidazoline ring, benzoxazoline ring or methylenedioxyphenyl ring) (hereinafter, for simplicity, $RED_{11}$ is referred to as denoting a monovalent group). These groups may each have a substituent.

The substituent can be, for example, any of a halogen atom, alkyl groups (including, e.g., an aralkyl group, cycloalkyl group, active methine group), an alkenyl group, alkynyl group, aryl group, heterocyclic group (preferably 5- to 7-membered ring having, as a hetero atom, N, O, S and etc., and the substitution position of the heterocyclic group is not questioned), heterocyclic group containing a quaternated nitrogen atom (e.g., pyridinio, imidazolio, quinolinio or isoquinolinio), acyl group, alkoxycarbonyl group, aryloxycarbonyl group, carbamoyl group, carboxyl group or a salt thereof, sulfonylcarbamoyl group, cacylcarbamoyl group, sulfamoylcarbamoyl group, carbazoyl group, oxalyl group, oxamoyl group, cyano group, carbonimidoyl group, thiocarbamoyl group, hydroxyl group, alkoxy groups (including a group containing ethyleneoxy or propyleneoxy repeating units), aryloxy group, heterocyclic oxy group, acyloxy group, alkoxy- or aryloxy-carbonyloxy group, carbamoyloxy group, sulfonyloxy group, amino group, alkyl-, aryl- or heterocyclic-amino group, acylamino group, sulfonamido group, ureido group, thioureido group, imido group, alkoxy- or aryloxy-carbonylamino group, sulfamoylamino group, semicarbazido group, thiosemicarbazido group, hydrazino group, ammonio group, oxamoylamino group, alkyl- or aryl-sulfonylureido group, acylureido group, acylsulfamoylamino group, nitro group, mercapto group, alkyl-, aryl- or heterocyclic-thio group, alkyl- or aryl-sulfonyl group, alkyl- or aryl-sulfinyl group, sulfo group or a salt thereof, sulfamoyl group, acylsulfamoyl group, sulfonylsulfamoyl group or a salt thereof, and group containing a phosphoramide or phosphoric ester structure. These substituents may be further substituted with these substituents.

In the general formula (A), $L_{11}$ represents a split-off group that can be split off through a bond cleavage only after a one-electron oxidation of the reducing group represented by $RED_{11}$. Specifically, $L_{11}$ represents, for example, a carboxyl group or a salt thereof, silyl group, hydrogen atom, triarylboron anion, trialkylstannyl group, trialkylgermyl group or a group of the formula $—CR_{C1}R_{C2}R_{C3}$.

When $L_{11}$ represents a salt of carboxyl group, as a counter ion for forming a salt, there can be mentioned, for example, an alkali metal ion (e.g., $Li^+$, $Na^+$, $K^+$ or $Cs^+$), an alkaline earth metal ion (e.g., $Mg^{2+}$, $Ca^{2+}$ or $Ba^{2+}$), a heavy metal ion (e.g., $Ag^+$ or $Fe^{2+/3+}$), an ammonium ion or a phosphonium ion. When $L_{11}$ represents a silyl group, specifically, the silyl group is, for example, a trialkylsilyl group, an aryldialkylsilyl group or a triarylsilyl group. The alkyl of these groups can be, for example, methyl, ethyl, benzyl or t-butyl. The aryl of these groups can be, for example, phenyl.

When $L_{11}$ represents a triarylboron anion, the aryl thereof is preferably a substituted or unsubstituted phenyl, wherein the substituent can be any of those which may be had by $RED_{11}$. When $L_{11}$ represents a trialkylstannyl group or a trialkylgermyl group, the alkyl thereof is a substituted or unsubstituted linear, branched or cyclic alkyl having 1 to 24 carbon atoms, wherein the substituent can be any of those which may be had by $RED_{11}$.

When $L_{11}$ represents a group of the formula $—CR_{C1}R_{C2}R_{C3}$, each of $R_{C1}$, $R_{C2}$ and $R_{C3}$ independently represents any of a hydrogen atom, alkyl group, aryl group, heterocyclic group, alkylthio group, arylthio group, alkylamino group, arylamino group, heterocyclic amino group, alkoxy group, aryloxy group and hydroxyl group. These may be bonded with each other to thereby form a cyclic structure. Each of these may further have a substituent. The substituent can be any of those which may be had by $RED_{11}$. Provided however that, when one of $R_{C1}$, $R_{C2}$ and $R_{C3}$ represents a hydrogen atom or alkyl group, the remaining two do not represent a hydrogen atom or alkyl group. It is preferred that each of $R_{C1}$, $R_{C2}$ and $R_{C3}$ independently represent an alkyl group, aryl group (especially, phenyl), alkylthio group, arylthio group, alkylamino group, arylamino group, heterocyclic group, alkoxy group or hydroxyl group. Specific examples thereof include methyl, ethyl, cyclohexyl, benzyl, phenyl, p-dimethylaminophenyl, p-methoxyphenyl, 2,4-dimethoxyphenyl, p-hydroxyphenyl, methylthio, phenylthio, phenoxy, methoxy, ethoxy, dimethylamino, N-methylanilino, diphenylamino, morpholino, thiomorpholino and hydroxyl. Examples of groups having a cyclic structure formed by mutual bonding of these include 1,3-dithiolan-2-yl, 1,3-dithian-2-yl, N-methyl-1,3-thiazolidin-2-yl and N-benzylbenzothiazolidin-2-yl.

Preferred groups of the formula $—CR_{C1}R_{C2}R_{C3}$ can be, for example, trityl, tri(p-hydroxyphenyl)methyl, 1,1-diphenyl-1-(p-dimethylaminophenyl)methyl, 1,1-diphenyl-1-(methylthio)methyl, 1-phenyl-1,1-(dimethylthio)methyl, 1,3-dithiolan-2-yl,2-phenyl-1,3-dithiolan-2-yl, 1,3-dithian-2-yl, 2-phenyl-1,3-dithian-2-yl, 2-methyl-1,3-dithian-2-yl, N-methyl-1,3-thiazolidin-2-yl, 2-methyl-3-methyl-1,3-thiazolidin-2-yl, N-benzylbenzothiazolidin-2-yl, 1,1-diphenyl-1-dimethylaminomethyl and 1,1-diphenyl-1-morpholinomethyl group. It is also preferred that the group of the formula $—CR_{C1}R_{C2}R_{C3}$ be the same group as the residue resulting from removal of $L_{11}$ from the general formula (A) as a consequence of selection within the above scopes with respect of the $R_{C1}$, $R_{C2}$ and $R_{C3}$.

In the general formula (A), $R_{112}$ represents a hydrogen atom or substituent capable of substituting on the carbon atom. When $R_{112}$ represents a substituent capable of substituting on the carbon atom, the substituent can be, for example, any of those mentioned as substituent examples with respect to the $RED_{11}$ having a substituent. Provided, however, that $R_{112}$ and $L_{11}$ do not represent the same group.

In the general formula (A), $R_{111}$ represents a group of nonmetallic atoms capable of forming a specific 5-membered or 6-membered cyclic structure together with the carbon atom (C) and $RED_{11}$. Herein, the expression "specific 5-membered or 6-membered cyclic structure" formed by $R_{111}$ means a cyclic structure corresponding to a tetrahydro form, hexahydro form or octahydro form of 5-membered or 6-membered aromatic ring (including an aromatic heterocycle). Herein, the terminology "hydro form" means a cyclic structure resulting from partial hydrogenation of internal carbon to carbon double bonds or carbon to nitrogen double bonds of an aromatic ring (including an aromatic heterocycle). The tetrahydro form refers to a structure resulting from hydrogenation of two carbon to carbon double bonds or carbon to nitrogen double bonds. The hexahydro form refers to a structure resulting from hydrogenation of three carbon to carbon double bonds or carbon to nitrogen double bonds. The octahydro form refers to a structure resulting from hydrogenation of four carbon to carbon double bonds or carbon to nitrogen double bonds. As a result of hydrogenation, the aromatic ring becomes a partially hydrogenated nonaromatic cyclic structure.

Specifically, as examples of 5-membered monocycles, there can be mentioned a pyrrolidine ring, imidazolidine ring, thiazolidine ring, pyrazolidine ring and oxazolidine ring which correspond to tetrahydro forms of aromatic rings including a pyrrole ring, imidazole ring, thiazole ring, pyrazole ring and oxazole ring, respectively. As examples of 6-membered monocycles, there can be mentioned tetrahydro or hexahydro forms of aromatic rings such as a pyridine ring, pyridazine ring, pyrimidine ring and pyrazine ring. Particular examples thereof include a piperidine ring, tetrahydropyridine ring, tetrahydropyrimidine ring and piperazine ring. As examples of 6-membered condensed rings, there can be mentioned a tetralin ring, tetrahydroquinoline ring, tetrahydroisoquinoline ring, tetrahydroquinazoline ring and tetrahydroquinoxaline ring which correspond to tetrahydro forms of aromatic rings including a naphthalene ring, quinoline ring, isoquinoline ring, quinazoline ring and quinoxaline ring, respectively. As examples of tricyclic compounds, there can be mentioned a tetrahydrocarbazole ring, which is a tetrahydro form of a carbazole ring, and an octahydrophenanthridine ring, which is an octahydro form of a phenanthridine ring.

These cyclic structures may further be substituted. As examples of suitable substituents, there can be mentioned those described above with respect to substituents which may be had by the $RED_{11}$. Substituents of these cyclic structures may be further bonded with each other to thereby form a ring. The thus newly formed ring is a nonaromatic carbon ring or heterocycle.

Preferred range of compounds represented by the general formula (A) of the present invention will be described below.

In the general formula (A), $L_{11}$ preferably represents a carboxyl group or a salt thereof, or hydrogen atom. More preferably, $L_{11}$ is a carboxyl group or a salt thereof. As a counter ion of the salt, there can preferably be mentioned an alkali metal ion or an ammonium ion. An alkali metal ion (especially $Li^+$, $Na^+$ or $K^+$ ion) is most preferred.

When $L_{11}$ represents a hydrogen atom, it is preferred that the compound represented by the general formula (A) have an intramolecular base moiety. By virtue of the action of the base moiety, the compound represented by the general formula (A) is oxidized, and thereafter the hydrogen atom represented by $L_{11}$ is deprotonized to thereby enable further release of an electron therefrom.

Herein, the base refers to, for example, a conjugated base of acid exhibiting a pKa value of about 1 to about 10. As the base, there can be mentioned, for example, any of nitrogen-containing heterocycles (pyridines, imidazoles, benzimidazoles, thiazoles, etc.), anilines, trialkylamines, an amino group, carbon acids (active methylene anion, etc.), a thioacetate anion, carboxylate ($—COO^-$), sulfate ($—SO_3^-$) and an amine oxide ($>N^+(O^-)—$). Preferred base is a conjugated base of acid exhibiting a pKa value of about 1 to about 8. Carboxylate, sulfate and an amine oxide are more preferred. Carboxylate is most preferred. When these bases have an anion, a counter cation may be had thereby. The counter cation can be, for example, an alkali metal ion, an alkaline earth metal ion, a heavy metal ion, an ammonium ion or a phosphonium ion.

These bases are linked at an arbitrary position thereof to the compound represented by the general formula (A). The position at which the base moiety is bonded may be any of $RED_{11}$, $R_{111}$ and $R_{112}$ of the general formula (A). Also, the bases may be linked at substituents of these groups.

When $L_{11}$ represents a hydrogen atom, it is preferred that the hydrogen atom and the base moiety be linked to each other through an atomic group consisting of 8 or less atoms. More preferably, the linkage is made by an atomic group consisting of 5 to 8 atoms. Herein, what is counted as a linking atomic group refers to an atomic group which links the hydrogen atom to the central atom of base moiety (namely, an atom having an anion, or an atom having a lone electron pair) by a covalent bond. For example, with respect to carboxylate, two atoms of $—C—O^-$ are counted. With respect to sulfate, two atoms of $S—O^-$ are counted. Also, the carbon atom represented by C in the general formula (A) is included in the count.

In the general formula (A), when $L_{11}$ represents a hydrogen atom and when $RED_{11}$ represents an aniline whose nitrogen atom forms a 6-membered monocyclic saturated ring structure (for example, a piperidine ring, piperazine ring, morpholine ring, thiomorpholine ring or selenomorpholine ring) together with $R_{111}$, it is preferred that the compound have an adsorptive group acting on silver halides in its molecule. It is more preferred that the compound simultaneously have an intramolecular base moiety, the base moiety and the hydrogen atom linked to each other through an atomic group consisting of 8 or less atoms.

In the general formula (A), it is preferred that $RED_{11}$ represents an alkylamino group, arylamino group, heterocyclic amino group, aryl group, or aromatic or nonaromatic heterocyclic group. As the heterocyclic group, preferred group is, for example, tetrahydroquinolinyl, tetrahydroquinoxalinyl, tetrahydroquinazolinyl, indolyl, indolenyl, carbazolyl, phenoxazinyl, phenothiazinyl, benzothiazolinyl, pyrrolyl, imidazolyl, thiazolidinyl, benzimidazolyl, benzimidazolinyl or 3,4-methylenedioxyphenyl-1-yl. More preferred group is an arylamino group (especially an anilino) or aryl group (especially an phenyl). When $RED_{11}$ represents an aryl group, it is preferred that the aryl group has at least one electron-donating group (the number of electron-donating groups is preferably 4 or less, more preferably 1 to 3). Herein, the electron-donating group specifically refers to a hydroxyl group, alkoxy group, mercapto group, sulfonamido group, acylamino group, alkylamino group, arylamino group, heterocyclic amino group, active methine group, electron-excessive aromatic heterocyclic group (e.g., indolyl, pyrrolyl, imidazolyl, benzimidazolyl, thiazolyl, benzthiazolyl or indazolyl), or a nonaromatic nitrogen-containing heterocyclic group that is bonded to the carbon atom of the general formula (A) via its nitrogen atom (e.g., pyrrolidinyl, indolinyl, piperidinyl, piperazinyl or morpholino). Herein, the active methine group refers to a methine group substituted with two electron-withdrawing groups. Herein, the electron-withdrawing groups refer to an acyl group, alkoxycarbonyl group, aryloxycarbonyl group, carbamoyl group, alkylsulfonyl group, arylsulfonyl group, sulfamoyl group, trifluoromethyl group, cyano group, nitro group and carbonimidoyl group. These two electron-withdrawing groups may be bonded with each other to thereby form a circular structure. When $RED_{11}$ represents an aryl group, the substituent of the aryl group is preferably an alkylamino group, hydroxyl group, alkoxy group, mercapto group, sulfonamido group, active methine group, or nonaromatic nitrogen-containing heterocyclic group that is bonded to the carbon atom of the general formula (A) via its nitrogen atom. More preferably, the substituent is an alkylamino group, hydroxyl group, active methine group, or nonaromatic nitrogen-containing heterocyclic group that is bonded to the carbon atom of the general formula (A) via its nitrogen atom. Most preferably, the substituent is an alkylamino group, or nonaromatic nitrogen-containing heterocyclic group that is bonded to the carbon atom of the general formula (A) via its nitrogen atom.

In the general formula (A), $R_{112}$ preferably represents any of a hydrogen atom, alkyl group, aryl group (e.g., phenyl), alkoxy group (e.g., methoxy, ethoxy or benzyloxy), hydroxyl group, alkylthio group (e.g., methylthio or butylthio), amino group, alkylamino group, arylamino group and heterocyclic amino group. More preferably, $R_{112}$ represents any of a hydrogen atom, alkyl group, alkoxy group, phenyl group, or alkylamino group.

In the general formula (A), $R_{111}$ preferably represents a group of nonmetallic atoms capable of forming the following specific 5-membered or 6-membered cyclic structure together with the carbon atom (C) and $RED_{11}$. Specifically, the cyclic structure formed by $R_{111}$ may be, for example, either of a pyrrolidine ring and an imidazolidine ring which correspond to tetrahydro forms of monocyclic 5-membered aromatic rings including a pyrrole ring and imidazole ring, respectively. Also, the cyclic structure may be a tetrahydro or hexahydro form of monocyclic 6-membered aromatic ring such as a pyridine ring, pyridazine ring, pyrimidine ring or pyrazine ring. For example, the cyclic structure may be a piperidine ring, tetrahydropyridine ring, tetrahydropyrimidine ring or piperazine ring. Further, the cyclic structure may be any of a tetralin ring, tetrahydroquinoline ring, tetrahydroisoquinoline ring, tetrahydroquinazoline ring and tetrahydroquinoxaline ring which correspond to tetrahydro forms of condensed-ring of 6-membered aromatic rings including a naphthalene ring, a quinoline ring, isoquinoline ring, quinazoline ring and quinoxaline ring, respectively. Still further, the cyclic structure may be a tetrahydrocarbazole ring which is a tetrahydro form of a tricyclic aromatic carbazole ring, or octahydrophenanthridine ring which is an octahydro form of a phenanthridine ring. The cyclic structure formed by $R_{111}$ is more preferably selected from a pyrrolidine ring, imidazolidine ring, piperidine ring, tetrahydropyridine ring, tetrahydropyrimidine ring, piperazine ring, tetrahydroquinoline ring, tetrahydroquinazoline ring, tetrahydroquinoxaline ring and tetrahydrocarbazole ring. Most preferably, the cyclic structure formed by $R_{111}$ is selected from a pyrrolidine ring, piperidine ring, piperazine ring, tetrahydroquinoline ring, tetrahydroquinazoline ring, tetrahydroquinoxaline ring and tetrahydrocarbazole ring. Optimally, the cyclic structure formed by $R_{111}$ is selected from a pyrrolidine ring, piperidine ring and tetrahydroquinoline ring.

Now, the general formula (B) will be described in detail.

With respect to the $RED_{12}$ and $L_{12}$ of the general formula (B), not only the meanings but also the preferred ranges thereof are the same as those of the $RED_{11}$ and $L_{11}$ of the general formula (A), respectively. Provided, however, that $RED_{12}$ represents a monovalent group unless the following cyclic structure is formed thereby. For example, the monovalent group can be any of those mentioned with respect to $RED_{11}$. With respect to $R_{121}$ and $R_{122}$, not only the meanings but also the preferred ranges thereof are the same as those of the $R_{112}$ of the general formula (A). $ED_{12}$ represents an electron-donating group. $R_{121}$ and $RED_{12}$; $R_{121}$ and $R_{122}$; or $ED_{12}$ and $RED_{12}$ may be bonded with each other to thereby form a cyclic structure.

In the general formula (B), the electron-donating group represented by $ED_{12}$ refers to a hydroxyl group, alkoxy group, mercapto group, alkylthio group, arylthio group, heterocyclic thio group, sulfonamido group, acylamino group, alkylamino group, arylamino group, heterocyclic amino group, active methine group, electron-excessive aromatic heterocyclic group (e.g., indolyl, pyrrolyl or indazolyl), a nonaromatic nitrogen-containing heterocyclic group that is bonded to the carbon atom of the general formula (B) via its nitrogen atom (e.g., pyrrolidinyl, piperidinyl, indolinyl, piperazinyl or morpholino), or an aryl group substituted with any of these electron-donating groups (e.g., p-hydroxyphenyl, p-dialkylaminophenyl, an o,p-dialkoxyphenyl or 4-hydroxynaphthyl). Herein, the active methine group is the same as described above as a substituent when $RED_{11}$ represents an aryl group. $ED_{12}$ preferably represents a hydroxyl group, alkoxy group, mercapto group, sulfonamido group, alkylamino group, arylamino group, active methine group, electron-excessive aromatic heterocyclic group, nonaromatic nitrogen-containing heterocyclic group that is bonded to the carbon atom of the general formula (B) via its nitrogen atom, or phenyl group substituted with any of these electron-donating groups. More preferably, $ED_{12}$ represents a hydroxyl group, mercapto group, sulfonamido group, alkylamino group, arylamino group, active methine group, nonaromatic nitrogen-containing heterocyclic group that is bonded to the carbon atom of the general formula (B) via its nitrogen atom, or phenyl group substituted with any of these electron-donating groups (e.g., p-hydroxyphenyl, p-dialkylaminophenyl or o,p-dialkoxyphenyl).

In the general formula (B), $R_{121}$ and $RED_{12}$; $R_{122}$ and $R_{121}$; or $ED_{12}$ and $RED_{12}$ may be bonded with each other to thereby form a cyclic structure. The thus formed cyclic structure is a substituted or unsubstituted cyclic structure of a 5- to 7-membered monocyclic or condensed-ring nonaromatic carbon ring or heterocycle. When $R_{121}$ and $RED_{12}$ form a cyclic structure, the thus formed cyclic structure can be, for example, a pyrrolidine ring, pyrroline ring, imidazolidine ring, imidazoline ring, thiazolidine ring, thiazoline ring, pyrazolidine ring, pyrazoline ring, oxazolidine ring,. oxazoline ring, indane ring, piperidine ring, piperazine ring, morpholine ring, tetrahydropyridine ring, tetrahydropyrimidine ring, indoline ring, tetralin ring, tetrahydroquinoline ring, tetrahydroisoquinoline ring, tetrahydroquinoxaline ring, tetrahydro-1,4-oxazine ring, 2,3-dihydrobenzo-1,4-oxazine ring, tetrahydro-1,4-thiazine ring, 2,3-dihydrobenzo-1,4-thiazine ring, 2,3-dihydrobenzofuran ring or 2,3-dihydrobenzothiophene ring. When $ED_{12}$ and $RED_{12}$ form a cyclic structure, $ED_{12}$ preferably represents an amino group, alkylamino group or arylamino group. The cyclic structure formed thereby can be, for example, a tetrahydropyrazine ring, piperazine ring, tetrahydroquinoxaline ring or tetrahydroisoquinoline ring. When $R_{122}$ and $R_{121}$ form a cyclic structure, the thus formed cyclic structure can be, for example, a cyclohexane ring or cyclopentane ring.

Those which are more preferred among the compounds of the general formula (A) of the present invention are represented by the following general formulae (10) to (12). Those which are more preferred among the compounds of the general formula (B) are represented by the following general formulae (13) and (14):

(10)

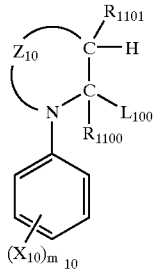

(11)

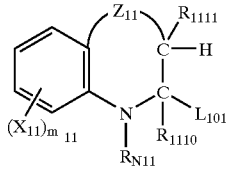

(12)

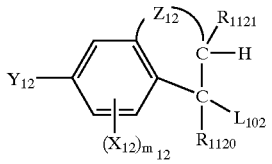

-continued (13)

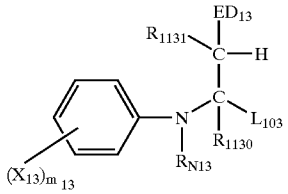

(14)

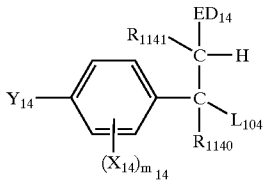

With respect to the $L_{100}$, $L_{101}$, $L_{102}$, $L_{103}$ and $L_{104}$ of the general formulae (10) to (14), not only the meanings but also the preferred ranges thereof are the same as those of the $L_{11}$ of the general formula (A).

With respect to $R_{1100}$ and $R_{1101}$; $R_{1110}$ and $R_{1111}$; $R_{1120}$ and $R_{1121}$; $R_{1130}$ and $R_{1131}$; and $R_{1140}$ and $R_{1141}$; not only the meanings but also the preferred ranges thereof are the same as those of the $R_{122}$ and $R_{121}$, respectively of the general formula (B). With respect to the $ED_{13}$ and $ED_{14}$, not only the meanings but also the preferred ranges thereof are the same as those of the $ED_{12}$ of the general formula (B). Each of $X_{10}$, $X_{11}$, $X_{12}$, $X_{13}$ and $X_{14}$ represents a substituent capable of substituting on the benzene ring. Each of $m_{10}$, $m_{11}$, $m_{12}$, $m_{13}$ and $m_{14}$ is an integer of 0 to 3. When it is 2 or more, a plurality of $X_{10}$, $X_{11}$, $X_{12}$, $X_{13}$ or $X_{14}$ groups may be the same or different. Each of $Y_{12}$ and $Y_{14}$ represents an amino group, alkylamino group, arylamino group, nonaromatic nitrogen-containing heterocyclic group that is bonded to the benzene ring of the general formula (12) or (14) via its nitrogen atom (e.g., pyrrolyl, piperidinyl, indolinyl, piperazino or morpholino), hydroxyl group or alkoxy group.

Each of $Z_{10}$, $Z_{11}$ and $Z_{12}$ represents a nonmetallic atomic group capable of forming a specific cyclic structure. The specific cyclic structure formed by $Z_{10}$ means a cyclic structure corresponding to a tetrahydro form or hexahydro form of 5- or 6-membered, monocyclic or condensed-ring, nitrogen-containing aromatic heterocycle. As such a cyclic structure, there can be mentioned, for example, a pyrrolidine ring, imidazolidine ring, thiazolidine ring, pyrazolidine ring, piperidine ring, tetrahydropyridine ring, tetrahydropyrimidine ring, piperazine ring, tetrahydroquinoline ring, tetrahydroisoquinoline ring, tetrahydroquinazoline ring or tetrahydroquinoxaline ring. The specific cyclic structure formed by $Z_{11}$ refers to a tetrahydroquinoline ring or tetrahydroquinoxaline ring. The specific cyclic structure formed by $Z_{12}$ refers to a tetralin ring, tetrahydroquinoline ring or tetrahydroisoquinoline ring.

Each of $R_{N11}$ and $R_{N13}$ represents a hydrogen atom or substituent capable of substituting on the nitrogen atom. The substituent can be, for example, any of an alkyl group, alkenyl group, alkynyl group, aryl group, heterocyclic group and acyl group, preferably an alkyl group or aryl group.

The substituents capable of substituting on the benzene ring, represented by $X_{10}$, $X_{11}$, $X_{12}$, $X_{13}$ or $X_{14}$, can be, for example, those which may be had by the $RED_{11}$ of the general formula (A). Preferably, the substituents can be a halogen atom, alkyl group, aryl group, heterocyclic group, acyl group, alkoxycarbonyl group, aryloxycarbonyl group, carbamoyl group, cyano group, alkoxy group (including a group containing ethyleneoxy or propyleneoxy repeating units), alkyl-, aryl- or heterocyclic-amino group, an acylamino group, sulfonamido group, ureido group, thioureido group, imido group, alkoxy- or aryloxy-carbonylamino group, nitro group, alkyl-, aryl- or heterocyclic-thio group, alkyl- or aryl-sulfonyl group, a sulfamoyl group, etc. Each of $m_{10}$, $m_{11}$, $m_{12}$, $m_{13}$ and $m_{14}$ is preferably an integer of 0 to 2, more preferably 0 or 1.

Each of $Y_{12}$ and $Y_{14}$ preferably represents an alkylamino group, arylamino group, nonaromatic nitrogen-containing heterocyclic group that is bonded to the benzene ring of the general formula (12) or (14) via its nitrogen atom, hydroxyl group or alkoxy group. More preferably, each of $Y_{12}$ and $Y_{14}$ represents an alkylamino group, 5- or 6-membered nonaromatic nitrogen-containing heterocyclic group that is bonded to the benzene ring of the general formula (12) or (14) via its nitrogen atom, or hydroxyl group. Most preferably, each of $Y_{12}$ and $Y_{14}$ represents an alkylamino group (especially, dialkylamino) or a 5- or 6-membered nonaromatic nitrogen-containing heterocyclic group that is bonded to the benzene ring of the general formula (12) or (14) via its nitrogen atom.

In the general formula (13), $R_{1131}$ and $X_{13}$; $R_{1131}$ and $R_{N13}$; $R_{1130}$ and $X_{13}$; or $R_{1130}$ and $R_{N13}$ may be bonded with each other to thereby form a cyclic structure. In the general formula (14), $R_{1141}$ and $X_{14}$; or $R_{1141}$ and $R_{1140}$; $ED_{14}$ and $X_{14}$; or $R_{1140}$ and $X_{14}$ may be bonded with each other to thereby form a cyclic structure. The thus formed cyclic structure is a substituted or unsubstituted cyclic structure consisting of a 5- to 7-membered monocyclic or condensed-ring nonaromatic carbon ring or heterocycle. When, in the general formula (13), $R_{1131}$ and $X_{13}$ are bonded with each other to thereby form a cyclic structure, or $R_{1131}$ and $R_{N13}$ are bonded with each other to thereby form a cyclic structure, the resultant compound, like that wherein no cyclic structure is formed, is a preferred Example of the compounds of the general formula (13). As the cyclic structure formed by $R_{1131}$ and $X_{13}$ in the general formula (13), there can be mentioned, for example, any of an indoline ring, in which case, $R_{1131}$ represents a single bond, tetrahydroquinoline ring, tetrahydroquinoxaline ring, 2,3-dihydrobenzo-1,4-oxazine ring and 2,3-dihydrobenzo-1,4-thiazine ring. Of these, an indoline ring, tetrahydroquinoline ring and tetrahydroquinoxaline ring are especially preferred. As the cyclic structure formed by $R_{1131}$ and $R_{N13}$ in the general formula (13), there can be mentioned, for example, any of a pyrrolidine ring, pyrroline ring, imidazolidine ring, imidazoline ring, thiazolidine ring, thiazoline ring, pyrazolidine ring, pyrazoline ring, oxazolidine ring, oxazoline ring, piperidine ring, piperazine ring, morpholine ring, tetrahydropyridine ring, tetrahydropyrimidine ring, indoline ring, tetrahydroquinoline ring, tetrahydroisoquinoline ring, tetrahydroquinoxaline ring, tetrahydro-1,4-oxazine ring, 2,3-dihydrobenzo-1,4-oxazine ring, tetrahydro-1,4-thiazine ring, 2,3-dihydrobenzo-1,4-thiazine ring, 2,3-dihydrobenzofuran ring and 2,3-dihydrobenzothiophene ring of these, a pyrrolidine ring, piperidine ring, tetrahydroquinoline ring and tetrahydroquinoxaline ring are especially preferred.

When, in the general formula (14), $R_{1141}$ and $X_{14}$ are bonded with each other to thereby form a cyclic structure, or $ED_{14}$ and $X_{14}$ are bonded with each other to thereby form a cyclic structure, the resultant compound, like that wherein no cyclic structure is formed, is a preferred Example of the compounds of the general formula (14). As the cyclic structure formed by the bonding of $R_{1141}$ and $X_{14}$ in the general formula (14), there can be mentioned, for example, an indane ring, tetralin ring, tetrahydroquinoline ring, tetrahydroisoquinoline ring or indoline ring. As the cyclic structure formed by the bonding of $ED_{14}$ and $X_{14}$, there can be mentioned, for example, a tetrahydroisoquinoline ring or tetrahydrocinnoline ring.

Now, the general formulae (1) to (3) will be described.

In the general formulae (1) to (3), each of $R_1$, $R_2$, $R_{11}$, $R_{12}$ and $R_{31}$ independently represents a hydrogen atom or substituent. With respect to these, not only the meanings but also the preferred ranges thereof are the same as those of the $R_{112}$ of the general formula (A). Each of $L_1$, $L_{21}$ and $L_{31}$ independently represents a split-off group, which can be any of those mentioned as examples in the above description of the $L_{11}$ of the general formula (A). The preferred ranges thereof are also the same as mentioned there. Each of $X_1$ and $X_{21}$ represents a substituent capable of substituting on the benzene ring. Each thereof independently represents any of those mentioned as the substituent examples with respect to substituted $RED_{11}$ of the general formula (A). Each of $m_1$ and $m_{21}$ is an integer of 0 to 3, preferably 0 to 2, and more preferably 0 or 1.

Each of $R_{N1}$, $R_{N21}$ and $R_{N31}$ represents a hydrogen atom or substituent capable of substituting on the nitrogen atom. The substituent can preferably be any of an alkyl group, aryl group and heterocyclic group. These groups may further have a substituent. This substituent can be any of those which may be had by the $RED_{11}$ of the general formula (A). Each of $R_{N1}$, $R_{N21}$ and $R_{N31}$ preferably represents a hydrogen atom, alkyl group or aryl group, more preferably a hydrogen atom or alkyl group.

Each of $R_{13}$, $R_{14}$, $R_{32}$, $R_{33}$, $R_a$ and $R_b$ independently represents a hydrogen atom or substituent capable of substituting on the carbon atom. The substituent can be any of those that may be had by the $RED_{11}$ of the general formula (A). The substituent can preferably be, for example, an alkyl group, aryl group, acyl group, alkoxycarbonyl group, carbamoyl group, cyano group, alkoxy group, acylamino group, sulfonamido group, ureido group, thioureido group, alkylthio group, arylthio group, alkylsulfonyl group, arylsulfonyl group or sulfamoyl group.

In the general formula (1), $Z_1$ represents an atomic group capable of forming a 6-membered ring together with the nitrogen atom and the two carbon atoms of the benzene ring. The 6-membered ring formed with $Z_1$ is a nonaromatic carbon ring or heterocycle condensed with the benzene ring of the general formula (1). Specifically, the atomic group can be any of a tetrahydroquinoline ring, tetrahydroquinoxaline ring and tetrahydroquinazoline ring, which ring structures include the benzene ring to which the atomic group condensed. These may have a substituent. The substituent can be any of those mentioned as examples when the $R_{112}$ of the general formula (A) represents a substituent, and the preferred range thereof is also the same as mentioned there.

In the general formula (1), $Z_1$ preferably represents an atomic group capable of forming a tetrahydroquinoline ring or tetrahydroquinoxaline ring together with the nitrogen atom and the two carbon atoms of the benzene ring.

In the general formula (2), $ED_{21}$ represents an electron-donating group. With respect to the $ED_{21}$, not only the meaning but also the preferred range thereof is the same as those of the $ED_{12}$ of the general formula (B).

In the general formula (2), any two of $R_{N21}$, $R_{13}$, $R_{14}$, $X_{21}$ and $ED_{21}$ may be bonded with each other to thereby form a cyclic structure. The cyclic structure formed by $R_{N21}$ and $X_{21}$ is preferably a 5- to 7-membered nonaromatic carbon ring or heterocycle condensed with the benzene ring of the general formula (2). For example, it can be a tetrahydroquinoline ring, tetrahydroquinoxaline ring, indoline ring or 2,3-dihydro-5,6-benzo-1,4-thiazine ring. Preferably, it is a tetrahydroquinoline ring, tetrahydroquinoxaline ring or indoline ring.

In the general formula (3), when $R_{N31}$ represents a group other than aryl group, $R_a$ and $R_b$ are bonded with each other to thereby form an aromatic ring. Herein, this aromatic ring is an aryl group. Herein, the aromatic group is an aryl group (e.g., phenyl or naphthyl) or an aromatic heterocyclic group (e.g., a pyridine ring, pyrrole ring, quinoline ring or indole ring). An aryl group is preferred. The aromatic ring group may have a substituent. The substituent can be any of those mentioned when $X_1$ of the general formula (1) represents a substituent, and the preferred range thereof is also the same as mentioned there.

In the general formula (3), it is preferred that $R_a$ and $R_b$ be bonded with each other to thereby form an aromatic ring (especially a phenyl group).

In the general formula (3), $R_{32}$ preferably represents, for example, a hydrogen atom, alkyl group, aryl group, hydroxyl group, alkoxy group, mercapto group or amino group. When $R_{32}$ represents a hydroxyl group, it is a preferred mode that simultaneously $R_{33}$ represents an electron-withdrawing group. This electron-withdrawing group refers to any of an acyl group, alkoxycarbonyl group, aryloxycarbonyl group, carbamoyl group, alkylsulfonyl group, arylsulfonyl group, sulfamoyl group, trifluoromethyl group, cyano group, nitro group and carbonimidoyl group. Of these, an acyl group, alkoxycarbonyl group, carbamoyl group and cyano group are preferred.

The compound of type 2 will be described below.

The compound of type 2 is a compound capable of undergoing a one-electron oxidation to thereby form a one-electron oxidation product and capable of, only thereafter, undergoing a bond cleavage reaction to thereby further release another electron. That is, the one-electron oxidation product of the compound of type 2 is capable of being oxidized with a further one-electron oxidation. Herein, the expression "bond cleavage reaction" refers to the cleavage of a carbon-carbon bond, carbon-silicon bond, carbon-hydrogen bond, carbon-boron bond, carbon-tin bond, or carbon-germanium bond. Cleavage of carbon-hydrogen bond may accompany the above bond cleavage.

Provided that the compound of type 2 has, in its molecule, two or more (preferably two to six, more preferably two to four) groups adsorptive to silver halide. More preferably, the compound of type 2 has a nitrogen-containing heterocyclic group substituted with two or more mercapto groups, as its adsorptive group.

Among the compounds of type 2, those preferred are represented by general formula (C):

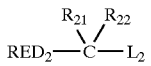

(C)

Herein, the compound of the general formula (C) is, after the one-electron oxidation of the reducing group represented by $RED_2$, $L_2$ is spontaneously split off through a bond cleavage reaction, namely, the C (carbon atom)—to—$L_2$ bond is cleaved, so that further another electron can be released.

With respect to $RED_2$ of the general formula (C), not only the meaning but also the preferred range thereof is the same as those of the $RED_{12}$ of the general formula (B). $L_2$ has the same meaning as described for $L_{11}$ of the general formula (A). The preferable range of $L_2$ is also the same as that of $L_{11}$. When $L_2$ represents a silyl group, the compound of the general formula (C) has, in its molecule, a nitrogen-containing heterocyclic group that is substituted by two or more mercapto groups, as an adsorptive group. Each of $R_{21}$ and $R_{22}$ represents a hydrogen atom or substituent. With respect to these, not only the meanings but also the preferred ranges thereof are the same as those of the $R_{112}$ of the general formula (A). $RED_2$ and $R_{21}$ may be bonded with each other to thereby form a cyclic structure.

The thus formed cyclic structure is preferably a 5- to 7-membered monocyclic or condensed-ring nonaromatic carbon ring or heterocycle, which may have a substituent. Provided however that the cyclic structure is not one corresponding to a tetrahydro form, hexahydro form or octahydro form of an aromatic ring or aromatic heterocycle. The substituent can be any of those mentioned as substituent examples with respect to substituted $RED_{11}$ of the general formula (A). The cyclic structure is preferably a cyclic structure corresponding to a dihydro form of an aromatic or nonaromatic heterocycle. Preferable Example of the cyclic structure, for example, is a 2-pyrroline ring, 2-imidazoline ring, 2-thiazoline ring, 1,2-dihydropyridine ring, 1,4-dihydropyridine ring, indoline ring, benzimidazoline ring, benzothiazoline ring, benzoxazoline ring, 2,3-dihydrobenzothiophene ring, 2,3-dihydrobenzofuran ring, benzo-α-pyran ring, 1,2-dihydroquinoline ring, 1,2-dihydroquinazoline ring and 1,2-dihydroquinoxaline ring.

Of these, a 2-imidazoline ring, 2-thiazoline ring, indoline ring, benzimidazoline ring, benzothiazoline ring, benzoxazoline ring, 1,2-dihydropyridine ring, 1,2-dihydroquinoline ring, 1,2-dihydroquinazoline ring and 1,2-dihydroquinoxaline ring are preferred. An indoline ring, benzimidazoline ring, benzothiazoline ring and 1,2-dihydroquinoline ring are more preferred. An indoline ring is most preferred.

The compound of type 3 will be described below.

The compound of type 3 is a compound characterized in that it can undergo a one-electron oxidation to thereby form a one-electron oxidation product, the one-electron oxidation product being capable of releasing further one or more electrons after going through a subsequent bond-forming process. The bond-forming process refers to the formation of bond between atoms, for example, of carbon-carbon bond, carbon-nitrogen bond, carbon-sulfur bond or carbon-oxygen bond.

The compound of type 3 is preferably a compound characterized in that it can undergo a one-electron oxidation to thereby form a one-electron oxidation product, the one-electron oxidation product subsequently reacting with a reactive group moiety (a carbon to carbon double bond moiety, a carbon to carbon triple bond moiety, an aromatic group moiety or a benzo-condensed nonaromatic heterocyclic group moiety) which coexists in the molecule to thereby form a bond, followed by further release of one or more electrons.

The one-electron oxidation product formed by the one-electron oxidation of the compound of type 3 refers to a cation radical species, which may undergo splitting of a proton to thereby form a neutral radical species. This one-electron oxidation product (cation radical species or neutral radical species) reacts with a carbon to carbon double bond moiety, a carbon to carbon triple bond moiety, an aromatic group moiety and a benzo-condensed nonaromatic heterocyclic group moiety which coexists in the molecule, thereby forming interatomic bonds such as carbon-carbon bond, carbon-nitrogen bond, carbon-sulfur bond and carbon-oxygen bond. Thus, a new intramolecular cyclic structure is formed. Simultaneously or thereafter, further one or more electrons are released. The characteristic of the compound of type 3 resides in this respect.

More specifically, the compound of type 3 is characterized in that the bond-forming reaction after the one-electron oxidation leads to formation of a new radical species of cyclic structure, from which the second electron is further released directly or through splitting of a proton to thereby cause an oxidation thereof.

Furthermore, the compounds of type 3 include one exhibiting such a capability that the thus formed two-electron oxidation product subsequently undergoes a tautomeric reaction accompanying a transfer of proton either by way of a hydrolytic reaction or directly to thereby further release one or more, generally two or more, electrons, resulting in an oxidation thereof. Still further, the compounds of type 3 include one exhibiting such a capability that, without undergoing such a tautomeric reaction, further one or more, generally two or more, electrons are directly released from the two-electron oxidation product, resulting in oxidation thereof.

The compound of type 3 is preferably represented by the general formula (D):

$$RED_3—L_3—Y_3 \quad (D)$$

In the general formula (D), $RED_3$ represents a one-electron oxidizable reducing group, $Y_3$ represents a reactive moiety that reacts with one electron oxidized $RED_3$ after $RED_3$ is one-electron oxidized. Specifically, $Y_3$ represents an organic group having a carbon-carbon double bond moiety, carbon-carbon triple bond moiety, aromatic moiety or benzo-condensed nonaromatic heterocyclic group. $L_3$ represents a linking group that links between $RED_3$ and $Y_3$.

In the general formula (D), $RED_3$ preferably represents an arylamino group, heterocyclic amino group, aryloxy group, arylthio group, aryl group, or aromatic or nonaromatic heterocyclic group (especially preferably a nitrogen-containing heterocyclic group). More preferably, $RED_3$ represents an arylamino group, heterocyclic amino group, aryl group, or aromatic or nonaromatic heterocyclic group. With respect to the heterocyclic group, it is preferred to use, for example, a tetrahydroquinoline ring group, tetrahydroquinoxaline ring group, tetrahydroquinazoline ring group, indoline ring group, indole ring group, carbazole ring group, phenoxazine ring group, phenothiazine ring group, benzothiazoline ring group, pyrrole ring group, imidazole ring group, thiazole ring group, benzimidazole ring group, benzimidazoline ring group, benzothiazoline ring group or 3,4-methylenedioxyphenyl-1-yl ring group.

An arylamino group (especially anilino), an aryl group (especially phenyl) or an aromatic or nonaromatic heterocyclic group is most preferred as $RED_3$.

When $RED_3$ represents an aryl group, it is preferred that the aryl group has at least one electron-donating group. Herein, the electron-donating group specifically refers to a hydroxyl group, alkoxy group, mercapto group, alkylthio group, sulfonamido group, acylamino group, alkylamino group, arylamino group, heterocyclic amino group, active methine group, electron-excessive aromatic heterocyclic group (e.g., indolyl, pyrrolyl or indazolyl), or a nonaromatic nitrogen-containing heterocyclic group that is bonded to $L_3$ via its nitrogen atom (e.g., pyrrolidinyl, indolinyl, piperidinyl, piperazinyl, morpholino or thiomorpholino). Herein, the active methine group refers to a methine group substituted with two electron-withdrawing groups. Herein, the electron-withdrawing groups refer to an acyl group, alkoxycarbonyl group, aryloxycarbonyl group, carbamoyl group, alkylsulfonyl group, arylsulfonyl group, sulfamoyl group, trifluoromethyl group, cyano group, nitro group and carbonimidoyl group. These two electron-withdrawing groups may be bonded with each other to thereby form a cyclic structure.

When $RED_3$ represents an aryl group, the substituent of the aryl group is preferably an alkylamino group, hydroxyl group, alkoxy group, mercapto group, sulfonamido group, active methine group, or nonaromatic nitrogen-containing heterocyclic group that is bonded to $L_3$ via its nitrogen atom. More preferably, the substituent is an alkylamino group, hydroxyl group, active methine group, or nonaromatic nitrogen-containing heterocyclic group that is bonded to $L_3$ via its nitrogen atom. Most preferably, the substituent is an alkylamino group, or nonaromatic nitrogen-containing heterocyclic group that is bonded to $L_3$ via its nitrogen atom.

When the reactive group represented by $Y_3$ is an organic substituted group having a carbon to carbon double bond or a carbon to carbon triple bond moiety, the substituent of the substituted organic group can preferably be any of, for example, an alkyl group (preferably having 1 to 8 carbon atoms), aryl group (preferably having 6 to 12 carbon atoms), alkoxycarbonyl group (preferably having 2 to 8 carbon atoms), carbamoyl group, acyl group and electron-donating group. Herein, the electron-donating group refers to any of an alkoxy group (preferably having 1 to 8 carbon atoms), hydroxyl group, amino group, alkylamino group (preferably having 1 to 8 carbon atoms), arylamino group (preferably having 6 to 12 carbon atoms), heterocyclic amino group (preferably having 2 to 6 carbon atoms), sulfonamido group, acylamino group, active methine group, mercapto group, an alkylthio group (preferably having 1 to 8 carbon atoms), arylthio group (preferably having 6 to 12 carbon atoms) and aryl group having any of these groups as a substituent (the number of carbon atoms of the aryl moiety is preferably in the range of 6 to 12). The hydroxyl group may be protected with a silyl group, for example, a trimethylsilyloxy group, t-butyldimethylsilyloxy group, triphenylsilyloxy group, triethylsilyloxy group or phenyldimethylsilyloxy group. Examples of the carbon to carbon double bond moiety and carbon to carbon triple bond moiety are vinyl group and ethynyl group, respectively.

When $Y_3$ represents an organic group comprising a carbon to carbon double bond moiety having a substituent, the substituent thereof is more preferably, for example, an alkyl group, phenyl group, acyl group, cyano group, alkoxycarbonyl group, carbamoyl group or electron-donating group. Herein, the electron-donating group preferably refers to any of an alkoxy group, hydroxyl group, which may be protected with a silyl group, amino group, alkylamino group, arylamino group, sulfonamido group, active methine group, mercapto group, alkylthio group and phenyl group having any of these electron-donating groups as a substituent, among the substituents mentioned above.

When the carbon to carbon double bond moiety has a hydroxyl group as a substituent, $Y_3$ contains a partial structure of the formula $>C_1{=}C_2(-OH)-$. This may be tautomerized into a partial structure of the formula $>C_1H-C_2(=O)-$. Further, in this structure, it is preferred that the substituent on $C_1$ carbon be an electron-withdrawing group. In this instance, $Y_3$ has a partial structure of "active methylene group" or "active methine group". The electron-withdrawing groups capable of providing this partial structure of active methylene group or active methine group are the same as mentioned in the above description of "active methine groups".

When $Y_3$ represents an organic group having a carbon to carbon triple bond moiety having a substituent, the substituent is preferably, for example, an alkyl group, phenyl group, alkoxycarbonyl group, carbamoyl group or electron-donating group. Herein, the electron-donating group preferably refers to any of an alkoxy group, amino group, alkylamino group, arylamino group, heterocyclic amino group, sulfonamido group, acylamino group, active methine group, mercapto group, alkylthio group and phenyl group having any of these electron-donating groups as a substituent.

When $Y_3$ represents an organic group having an aromatic group moiety, the aromatic group is preferably an indole ring group or an aryl group (especially preferably a phenyl group) having an electron-donating group as a substituent. Herein, the electron-donating group preferably refers to a hydroxyl group (the hydroxyl group may be protected with a silyl group), alkoxy group, amino group, alkylamino group, active methine group, sulfonamido group or mercapto group.

When $Y_3$ represents a benzo-condensed organic group having a nonaromatic heterocyclic group, the benzo-condensed nonaromatic heterocyclic group is preferably one having an aniline structure as an internal partial structure, which can be, for example, an indoline ring group, 1,2,3,4-tetrahydroquinoline ring group, 1,2,3,4-tetrahydroquinoxaline ring group or 4-quinolone ring group.

In the general formula (D), the reactive group represented by $Y_3$ is more preferably an organic group containing a carbon to carbon double bond moiety, aromatic group moiety or benzo-condensed nonaromatic heterocyclic group. Still more preferably, the reactive group is an organic group having a carbon to carbon double bond moiety, phenyl group having an electron-donating group as a substituent, indole ring group, or benzo-condensed nonaromatic heterocyclic group having an aniline structure as an internal partial structure. Herein, it is more preferred that the carbon to carbon double bond moiety have at least one electron-donating group as a substituent.

When the reactive group represented by $Y_3$ of the general formula (D) has the same partial structure as that of the reducing group represented by $RED_3$ of the general formula (D) as a result of selection within the range described hereinbefore, also, preferred examples of the compounds of the general formula (D) are provided thereby.

In the general formula (D), $L_3$ represents a linking group which links between $RED_3$ and $Y_3$. For example, $L_3$ represents a group consisting of each of, or each of combinations of, a single bond, alkylene group, arylene group, heterocyclic group, —O—, —S—, $-NR_N-$, —C(=O)—, $-SO_2-$, —SO— and —P(=O)—. Herein, $R_N$ represents a hydrogen atom, alkyl group, aryl group or heterocyclic group. The linking group represented by $L_3$ may have a substituent. The substituent can be any of those mentioned hereinbefore as substituents which may be had by $RED_{11}$ of the general formula (A). The linking group represented by $L_3$ can engage in linkage by replacing one arbitrary hydrogen atom of each of the groups represented by $RED_3$ and $L_3$ at an arbitrary position thereof.

The linking group represented by $L_3$ of the general formula (D) is preferably such that, when the cationic radical species ($X^{30}$ .) formed as a result of oxidation of $RED_3$ of the general formula (D) or radical species (X.) formed through splitting of proton therefrom reacts with the reactive group represented by $Y_3$ of the general formula (D) to thereby form a bond, the relevant atomic groups engaging therein can form a 3- to 7-membered cyclic structure including $L_3$. From this viewpoint, it is preferred that the radical species ($X^{30}$ . or X.), the reactive group represented by $Y_3$ and the group $L_3$ be linked to each other by a group of 3 to 7 atoms.

As a preferred Example of $L_3$, there can be mentioned a divalent linking group selected from a single bond, alkylene group (especially methylene, ethylene or propylene), an arylene group (especially phenylene), —C(=O)— group, —O— group, —NH— group, —N(alkyl group)— group and combinations thereof.

Among the compounds of the general formula (D), preferred compounds are represented by the following general formulae (D-1) to (D-4):

(D-1)

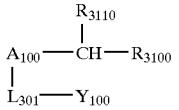

(D-2)

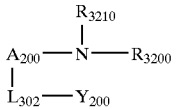

(D-3)

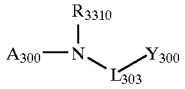

(D-4)

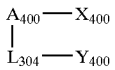

In the general formulae (D-1) to (D-4), each of $A_{100}$, $A_{200}$ and $A_{400}$ represents an arylene group or divalent heterocyclic group, and $A_{300}$ represents an aryl group or a heterocyclic group. The preferred range thereof is the same as that of $RED_3$ of the general formula (D). Each of $L_{301}$, $L_{302}$, $L_{303}$ and $L_{304}$ represents a linking group. With respect to these, not only the meanings but also the preferred ranges thereof are the same as those of $L_3$ of the general formula (D). Each of $Y_{100}$, $Y_{200}$, $Y_{300}$ and $Y_{400}$ represents a reactive group. With respect to these, not only the meanings but also the preferred ranges thereof are the same as those of $Y_3$ of the general formula (D). Each of $R_{3100}$, $R_{3110}$, $R_{3200}$, $R_{3210}$ and $R_{3310}$ represents a hydrogen atom or substituent. Each of $R_{3100}$ and $R_{3110}$ preferably represents a hydrogen atom, alkyl group or aryl group. Each of $R_{3200}$ and $R_{3310}$ preferably represents a hydrogen atom. $R_{3210}$ preferably represents a substituent. This substituent is preferably an alkyl group or aryl group. $R_{3110}$ and $A_{100}$; $R_{3210}$ and $A_{200}$; and $R_{3310}$ and $A_{300}$ may be bonded with each other to thereby form a cyclic structure. The thus formed cyclic structure is preferably, for example, a tetralin ring, indane ring, tetrahydroquinoline ring or indoline ring. $X_{400}$ represents a hydroxyl group, mercapto group or alkylthio group, preferably represents a hydroxyl group or mercapto group, and more preferably represents a mercapto group.

Among the compounds of the general formulae (D-1) to (D-4), the compounds of the general formulae (D-2), (D-3) and (D-4) are preferred. The compounds of the general formulae (D-2) and (D-3) are more preferred.

The compound of type 4 will be described below.

The compound of type 4 is a compound having a circular structure substituted with a reducing group, which compound can undergo a one-electron oxidation of the reducing group and thereafter a cleavage reaction of the circular structure to thereby further release one or more electrons.

In the compound of type 4, the cyclic structure is cleaved after a one-electron oxidation. Herein, the cyclic cleavage reaction refers to the following scheme of reaction:

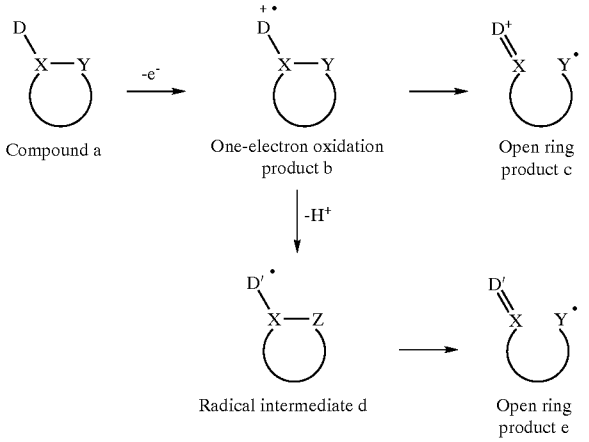

In the formulae, the compound a represents a compound of type 4. In the compound a, D represents a reducing group, and X and Y represent atoms forming a bond of the circular structure which is cleaved after a one-electron oxidation. First, the compound a undergoes a one-electron oxidation to thereby form a one-electron oxidation product b. Then, the D—X single bond is converted to a double bond, and simultaneously the X—Y bond is cleaved to thereby form an open-ring product c. An alternative route wherein a proton is split from the one-electron oxidation product b to thereby form a radical intermediate d, from which an open-ring product e is similarly formed, may be taken. One or more electrons are further released from the thus formed open-ring product c or e. The characteristic of this compound of the present invention resides in this respect.

The cyclic structure of the compound of type 4 refers to a nonaromatic, saturated or unsaturated, monocyclic or condensed-ring, 3- to 7-membered carbon ring or heterocycle. A saturated cyclic structure is preferred, and a 3- or 4-membered ring is more preferred. As preferred cyclic structures, there can be mentioned a cyclopropane ring, cyclobutane ring, oxirane ring, oxetane ring, aziridine ring, azetidine ring, episulfide ring and thietane ring. Of these, a cyclopropane ring, cyclobutane ring, oxirane ring, oxetane ring and azetidine ring are preferred. A cyclopropane ring, cyclobutane ring and azetidine ring are more preferred. The cyclic structure may have a substituent.

The compound of type 4 is preferably represented by the general formula (E) or (F):

(E)

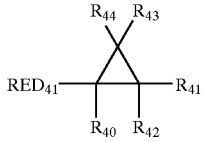

(F)

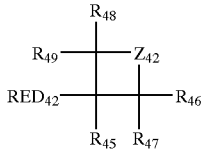

With respect to $RED_{41}$ and $RED_{42}$ of the general formulae (E) and (F), not only the meanings but also the preferred ranges thereof are the same as those of $RED_{12}$ of the general formula (B). Each of $R_{40}$ to $R_{44}$ and $R_{45}$ to $R_{49}$ represents a hydrogen atom or substituent. The substituent can be any of those which may be had by $RED_{12}$. In the general formula (F), $Z_{42}$ represents —$CR_{42}OR_{421}$—, —$NR_{423}$— or —O—. Each of $R_{420}$ and $R_{421}$ represents a hydrogen atom or substituent, and $R_{423}$ represents a hydrogen atom, alkyl group, aryl group or heterocyclic group.

In the general formula (E), $R_{40}$ preferably represents any of a hydrogen atom, alkyl group, alkenyl group, alkynyl group, aryl group, heterocyclic group, alkoxy group, amino group, alkylamino group, arylamino group, heterocyclic amino group, alkoxycarbonyl group, acyl group, carbamoyl group, cyano group and sulfamoyl group. Of these, a hydrogen atom, alkyl group, aryl group, heterocyclic group, alkoxy group, alkoxycarbonyl group, acyl group and carbamoyl group are more preferred. A hydrogen atom, alkyl group, aryl group, heterocyclic group, alkoxycarbonyl group and carbamoyl group are most preferred.

With respect to $R_{41}$ to $R_{44}$, it is preferred that a case wherein at least one thereof be a donating group. It is also preferred that a case wherein $R_{41}$ and $R_{42}$; or $R_{43}$ and $R_{44}$ be simultaneously electron-withdrawing groups. More preferably, at least one of $R_{41}$ to $R_{44}$ is a donating group. Most preferably, at least one of $R_{41}$ to $R_{44}$ is a donating group while, a group(s) that is not a donating group among $R_{41}$ to $R_{44}$, is (are) a hydrogen atom or alkyl group. The electron-withdrawing groups are the same as those mentioned in the above description of active methine group.

Herein, the donating group refers to a hydroxyl group, alkoxy group, aryloxy group, mercapto group, acylamino group, sulfonylamino group, active methine group, or group selected from preferred examples of the $RED_{41}$ and $RED_{42}$ groups. As the donating group, there can preferably be used any of an alkylamino group, arylamino group, heterocyclic amino group, 5-membered aromatic heterocyclic group having one nitrogen atom in its ring (the 5-membered aromatic ring may be monocyclic or in the form of condensed rings), a nonaromatic nitrogen-containing heterocyclic group that is bonded to the carbon atom of the general formula (E) via its nitrogen atom and phenyl group substituted with at least one electron-donating group, wherein the electron-donating group refers to a hydroxyl group, alkoxy group, aryloxy group, amino group, alkylamino group, arylamino group, heterocyclic amino group or nonaromatic nitrogen-containing heterocyclic group that is bonded to the carbon atom of the phenyl group via its nitrogen atom). Of these, an alkylamino group, arylamino group, 5-membered aromatic heterocyclic group having one nitrogen atom in its ring, wherein the aromatic heterocycle refers to an indole ring, pyrrole ring or carbazole ring, and a phenyl group substituted with at least one electron-donating group, in particular, a phenyl group substituted with three or more alkoxy groups or a phenyl group substituted with a hydroxyl group, alkylamino group or arylamino group, are more preferred. An arylamino group, 5-membered aromatic heterocyclic group having one nitrogen atom in its ring, wherein the 5-membered aromatic heterocyclic group represents a 3-indolyl group, and a phenyl group substituted with at least one electron-donating group, in particular, a trialkoxyphenyl group or a phenyl group substituted with an alkylamino group or arylamino group, are most preferred.

In the general formula (F), the preferred range of $R_{45}$ is the same as described above with respect to $R_{40}$ of the general formula (E). Each of $R_{46}$ to $R_{49}$ preferably represents any of a hydrogen atom, alkyl group, alkenyl group, alkynyl group, aryl group, heterocyclic group, hydroxyl group, alkoxy group, amino group, alkylamino group, arylamino group, heterocyclic amino group, mercapto group, arylthio group, alkylthio group, acylamino group and sulfonamino group. Of these, a hydrogen atom, alkyl group, aryl group, heterocyclic group, alkoxy group, alkylamino group, arylamino group and heterocyclic amino group are more preferred. Most preferably, each of $R_{46}$ to $R_{49}$ represents a hydrogen atom, alkyl group, aryl group, heterocyclic group, alkylamino group or arylamino group when $Z_{42}$ represents a group of the formula —$CR_{420}R_{421}$—; represents a hydrogen atom, alkyl group, aryl group or heterocyclic group when $Z_{42}$ represents a —$NR_{423}$—; and represents a hydrogen atom, alkyl group, aryl group or heterocyclic group when $Z_{42}$ represents —O—.

$Z_{42}$ preferably represents —$CR_{42}OR_{421}$— or —$NR_{423}$—, and more preferably represents —$NR_{423}$—. Each of $R_{420}$ and $R_{421}$ preferably represents any of a hydrogen atom, alkyl group, alkenyl group, alkynyl group, aryl group, heterocyclic group, hydroxyl group, alkoxy group, amino group, mercapto group, acylamino group and sulfonamino group. Of these, a hydrogen atom, alkyl group, aryl group, heterocyclic group, alkoxy group and amino group are more preferred. $R_{423}$ preferably represents a hydrogen atom, alkyl group, aryl group or aromatic heterocyclic group, and more preferably represents methyl, ethyl, isopropyl, t-butyl, t-amyl, benzyl, diphenylmethyl, allyl, phenyl, naphthyl, 2-pyridyl, 4-pyridyl or 2-thiazolyl.

When each of $R_{40}$ to $R_{49}$, $R_{420}$, $R_{421}$ and $R_{423}$ represents a substituent, the total number of carbon atoms of each thereof is preferably 40 or less, more preferably 30 or less, and most preferably 15 or less. These substituents may be bonded with each other or bonded with other moieties (e.g., $RED_{41}$, $RED_{42}$ or $Z_{42}$) of the molecule to thereby form rings.

It is preferred that the compounds of types 1, 3 and 4 according to the present invention be "compounds each having, in its molecule, a group adsorptive to silver halides" or "compounds each having, in its molecule, a partial structure of spectral sensitizing dye". More preferably, the compounds of types 1, 3 and 4 according to the present invention are "compounds each having, in its molecule, a group adsorptive to silver halides". The compound of type 2 is a "compound having, in its molecule, two or more groups adsorptive to silver halides". The compounds of types 1 to 4 are more preferably "compounds each having a nitrogen-containing heterocyclic group substituted with two or more mercapto groups as an adsorptive group".

With respect to the compounds of types 1 to 4 according to the present invention, the adsorptive group to silver halides refers to a group directly adsorbed onto silver halides or a group capable of promoting the adsorption onto silver halides. For example, the adsorptive group is a mercapto group (or a salt thereof), thione group (—C(=S)—), heterocyclic group containing at least one atom selected from a nitrogen atom, sulfur atom, selenium atom and tellurium atom, sulfido group, cationic group or ethynyl group. Provided however that, with respect to the compound of type 2 according to the present invention, a sulfido group is not included in the adsorptive groups thereof.

The terminology "mercapto group (or a salt thereof)" as the adsorptive group means not only a mercapto group (or a salt thereof) per se but also, preferably, a heterocyclic, aryl or alkyl group substituted with at least one mercapto group (or a salt thereof). Herein, the heterocyclic group refers to a 5- to 7-membered, monocyclic or condensed-ring, aromatic or nonaromatic heterocycle. As the heterocyclic group, there can be mentioned, for example, an imidazole ring group, thiazole ring group, oxazole ring group, benzimidazole ring group, benzothiazole ring group, benzoxazole ring group, triazole ring group, thiadiazole ring group, oxadiazole ring group, tetrazole ring group, purine ring group, pyridine ring group, quinoline ring group, isoquinoline ring group, pyrimidine ring group or triazine ring group. The heterocyclic group may be one containing a quaternary nitrogen atom, which may become a mesoion as a result of dissociation of a substituted mercapto group. This heterocyclic group can be, for example, any of an imidazolium ring group, pyrazolium ring group, thiazolium ring group, triazolium ring group, tetrazolium ring group, thiadiazolium ring group, pyridinium ring group, pyrimidinium ring group and triazinium ring group. Of these groups, a triazolium ring group (e.g., 1,2,4-triazolium-3-thiolate ring group) is preferred. The aryl group can be, for example, a phenyl group or naphthyl group. The alkyl group can be a linear, or branched, or cyclic alkyl group having 1 to 30 carbon atoms. When the mercapto group forms a salt, as the counter ion, there can be mentioned, for example, a cation of alkali metal, alkaline earth metal or heavy metal (e.g., $Li^+$, $Na^+$, $K^+$, $Mg^{2+}$, $Ag^+$ or $Zn^{2+}$), an ammonium ion, a heterocyclic group containing a quaternary nitrogen atom, or a phosphonium ion.

The mercapto group as the adsorptive group may further be tautomerized into a thione group. As such, there can be mentioned, for example, a thioamido group (herein a —C(═S)—NH— group) or a group containing a partial structure of the thioamido group, namely, a linear or cyclic thioamido group, thioureido group, thiourethane group or dithiocarbamic acid ester group. As examples of suitable cyclic groups, there can be mentioned, for example, a thiazolidine-2-thione group, oxazolidine-2-thione group, 2-thiohydantoin group, rhodanine group, isorhodanine group, thiobarbituric acid group and 2-thioxo-oxazolidin-4-one group.

The thione groups as the adsorptive group include not only the above thione groups resulting from tautomerization of mercapto groups but also a linear or cyclic thioamido group, thioureido group, thiourethane group and dithiocarbamic acid ester group which cannot be tautomerized into mercapto groups, i.e., not having any hydrogen atom at the α-position of thione group.

The heterocyclic group containing at least one atom selected from a nitrogen atom, sulfur atom, selenium atom and tellurium atom as the adsorptive group is a nitrogen-containing heterocyclic group having an —NH— group capable of forming an iminosilver (>NAg) as a partial structure of the heterocycle, or a heterocyclic group having an "—S—" group or "—Se—" group or "—Te—" group or "═N—" group capable of coordinating to silver ion by coordinate bond as a partial structure of the heterocycle. The former heterocyclic group can be, for example, a benzotriazole group, triazole group, indazole group, pyrazole group, tetrazole group, benzimidazole group, imidazole group or purine group. The latter heterocyclic group can be, for example, a thiophene group, thiazole group, oxazole group, benzothiazole group, benzoxazole group, thiadiazole group, oxadiazole group, triazine group, selenoazole group, benzoselenoazole group, tellurazole group or benzotellurazole group. The former heterocyclic group is preferred.

As the sulfido group as the adsorptive group, there can be mentioned all the groups having a partial structure of "—S—". Preferably, the sulfido group is a group having a partial structure of alkyl (or alkylene)-S-alkyl (or alkylene), aryl (or arylene)-S-alkyl (or alkylene), or aryl (or arylene)-S-aryl (or arylene). This sulfido group may be in the form of a cyclic structure or —S—S— group. As examples of sulfido groups forming a cyclic structure, there can be mentioned groups containing a thiolane ring, 1,3-dithiolane ring, 1,2-dithiolane ring, thiane ring, dithiane ring, tetrahydro-1,4-thiazine ring (thiomorpholine ring) or the like. Among the sulfido groups, groups having a partial structure of alkyl (or alkylene)-S-alkyl (or alkylene) are especially preferred.

The cationic group as the adsorptive group refers to a group containing a quaternary nitrogen atom. For example, it is a group containing an ammonio group or a nitrogen-containing heterocyclic group containing a quaternary nitrogen atom. However, the cationic group does not become part of an atomic group forming a dye structure (for example, cyanine chromophore). Herein, the ammonio group is, for example, a trialkylammonio group, dialkylarylammonio group or alkyldiarylammonio group. For example, as such, there can be mentioned benzyldimethylammonio group, trihexylammonio group or phenyldiethylammonio group. The nitrogen-containing heterocyclic group containing a quaternary nitrogen atom can be, for example, any of pyridinio group, quinolinio group, isoquinolinio group and imidazolio group. Of these, pyridinio group and imidazolio group are preferred. A pyridinio group is most preferred. The nitrogen-containing heterocyclic group containing a quaternary nitrogen atom may have an arbitrary substituent. However, when the nitrogen-containing heterocyclic group is a pyridinio group or imidazolio group, the substituent is preferably selected from, for example, an alkyl group, aryl group, acylamino group, chlorine atom, alkoxycarbonyl group and carbamoyl group. When the nitrogen-containing heterocyclic group is a pyridinio group, the substituent is most preferably a phenyl group.

The ethynyl group as the adsorptive group refers to a —C≡CH group, whose hydrogen atom may be replaced by a substituent.

The above adsorptive groups may have an arbitrary substituent.

Furthermore, examples of suitable adsorptive groups include those listed on pages 4 to 7 of JP-A-11-95355, (U.S. Pat. No. 6,054,260, the entire contents of which is incorporated herein by reference).

In the present invention, it is preferred that the adsorptive group be a nitrogen-containing heterocyclic group substituted with mercapto (e.g., a 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazolium-3-thiolate group), or a nitrogen-containing heterocyclic group having an —NH— group capable of forming an iminosilver (>NAg) as a partial structure of the heterocycle (e.g., a benzotriazole group, benzimidazole group or indazole group). More preferably, the adsorptive group is a 5-mercaptotetrazole group, 3-mercapto-1,2,4-triazole group or benzotriazole group. Most preferably, the adsorptive group is a 3-mercapto-1,2,4-triazole group or 5-mercaptotetrazole group.

Among the compounds of the present invention, those having, in its molecule, two or more mercapto groups as partial structures are also especially preferred. Herein, the mercapto group (—SH) may become a thione group when it can be tautomerized. Examples of such compounds may include a compound possessing in its molecule two or more adsorptive groups having the above mercapto group or thione group as a partial structure (e.g., a ring forming thioamido group, alkylmercapto group, arylmercapto group or heterocyclic mercapto group), and a compound possessing at least one adsorptive group having, in the adsorptive group per se, two or more mercapto groups or thione groups as a partial structure (e.g., a dimercapto-substituted nitrogen-containing heterocyclic group).

As examples of adsorptive groups having two or more mercapto groups as a partial structure (e.g., dimercapto-substituted nitrogen-containing heterocyclic groups), there can be mentioned a 2,4-dimercaptopyrimidine group, 2,4-dimercaptotriazine group, 3,5-dimercapto-1,2,4-triazole group, 2,5-dimercapto-1,3-thiazole group, 2,5-dimercapto-1,3-oxazole group, 2,7-dimercapto-5-methyl-s-triazolo[1,5-a]pyrimidine group, 2,6,8-trimercaptopurine group, 6,8-dimercaptopurine group, 3,5,7-trimercapto-s-triazolotriazine group, 4,6-dimercaptopyrazolopyrimidine group and 2,5-dimercaptoimidazole group. Of these, a 2,4-dimercaptopyrimidine group, 2,4-dimercaptotriazine group and 3,5-dimercapto-1,2,4-triazole group are especially preferred.

Although substitution with the adsorptive group may be effected at any position of the general formulae (A) to (F) and general formulae (1) to (3), it is preferred that the substitution be effected at $RED_{11}$, $RED_{12}$, $RED_2$ and $RED_3$ in the general formulae (A) to (D); at $RED_{41}$, $R_{41}$, $RED_{42}$ and $R_{46}$ to $R_{48}$ in the general formulae (E) and (F); and at any arbitrary position except $R_1$, $R_2$, $R_{11}$, $R_{12}$, $R_{31}$, $L_1$, $L_{21}$ and $L_{31}$ in the general formulae (1) to (3). It is more preferred that, in all the general formulae (A) to (F), the substitution be effected at $RED_2$ to $RED_{42}$.

The partial structure of spectral sensitizing dye refers to a group containing a chromophore of spectral sensitizing dye, and refers to a residue resulting from removal of an arbitrary hydrogen atom or substituent from a spectral sensitizing dye compound. Although substitution with the partial structure of spectral sensitizing dye may be effected at any position of the general formulae (A) to (F) and general formulae (1) to (3), it is preferred that the substitution be effected at $RED_{11}$, $RED_{12}$, $RED_2$ and $RED_3$ in the general formulae (A) to (D); at $RED_{41}$, $R_{41}$, $RED_{42}$ and $R_{46}$ to $R_{48}$ in the general formulae (E) and (F); and at any arbitrary position except $R_1$, $R_2$, $R_{11}$, $R_{12}$, $R_{31}$, $L_1$, $L_{21}$ and $L_{31}$ in the general formulae (1) to (3). It is more preferred that, in all the general formulae (A) to (F), the substitution be effected at $RED_2$ to $RED_{42}$. Preferred spectral sensitizing dyes are those typically employed in color sensitization techniques, which include, for example, cyanine dyes, composite cyanine dyes, merocyanine dyes, composite merocyanine dyes, homopolar cyanine dyes, styryl dyes and hemicyanine dyes. Representative spectral sensitizing dyes are disclosed in Research Disclosure, item 36544, September 1994, the entire contents of which are incorporated herein by reference. These spectral sensitizing dyes can be synthesized by persons skilled in the art to which the invention pertains in accordance with the procedure described in the above Research Disclosure or F. M. Hamer "The Cyanine Dyes and Related Compounds", Interscience Publishers, New York, 1964. Further, all the dyes described on pages 7 to 14 of JP-A-11-95355 (U.S. Pat. No. 6,054,260, entire contents of which are incorporated herein by reference) per se are applicable.

With respect to the compounds of types 1 to 4 according to the present invention, the total number of carbon atoms is preferably in the range of 10 to 60, more preferably 10 to 50, most preferably 11 to 40, and optimally 12 to 30.

With respect to the compounds of types 1 to 4 according to the present invention, a one-electron oxidation thereof is induced upon exposure of the silver halide photographic photosensitive material using the compounds. After the subsequent reaction, another electron, or two or more electrons depending on the type of compound are released to thereby cause further oxidation. The oxidation potential with respect to the first electron is preferably about 1.4 V or below, more preferably 1.0 V or below. This oxidation potential is preferably higher than 0 V, more preferably higher than 0.3 V. Thus, the oxidation potential is preferably in the range of about 0 to about 1.4 V, more preferably about 0.3 to about 1.0 V.

Herein, the oxidation potential can be measured in accordance with the cyclic voltammetry technique. For example, a sample compound is dissolved in a solution consisting of a 80%:20% (vol. %) mixture of acetonitrile and water (containing 0.1 M lithium perchlorate), and nitrogen gas is passed through the solution for 10 min. Thereafter, the oxidation potential is measured at 25° C. and at a potential scanning rate of 0.1 V/sec with the use of a glassy carbon disk as a working electrode, a platinum wire as a counter electrode and a calomel electrode (SCE) as a reference electrode. The oxidation potential vs. SCE is determined at the peak potential of cyclic voltammetry wave.

With respect to, among the compounds of types 1 to 4 according to the present invention, those which undergo a one-electron oxidation and, after a subsequent reaction, further release another electron, the oxidation potential at the latter stage is preferably in the range of −0.5 to −2 V, more preferably −0.7 to −2 V, and most preferably −0.9 to −1.6 V.

With respect to, among the compounds of types 1 to 4 according to the present invention, those which undergo a one-electron oxidation and, after a subsequent reaction, further release two or more electrons to thereby effect oxidation, the oxidation potential at the latter stage is not particularly limited. The reason is that the oxidation potential with respect to the second electron cannot be clearly distinguished from the oxidation potential with respect to the third electron et seqq., so that it is often difficult to practically accomplish accurate measuring and distinguishing thereof.

Specific examples of the compounds of types 1 to 4 according to the present invention will be listed below, which however in no way limit the scope of the present invention.

1

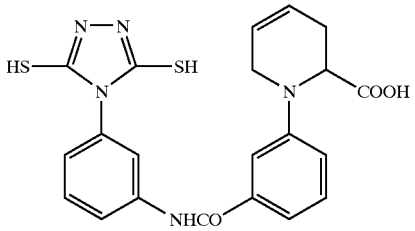

2

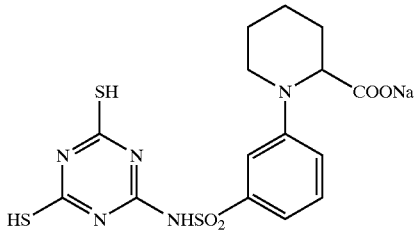

-continued
3
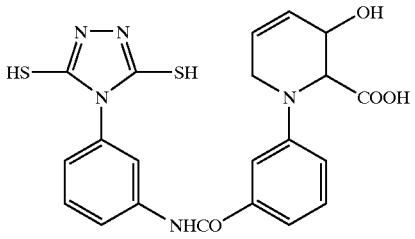
4
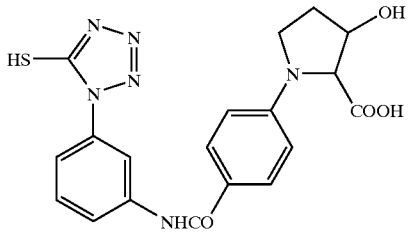
5
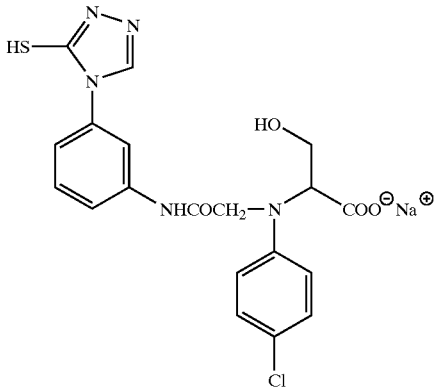
6
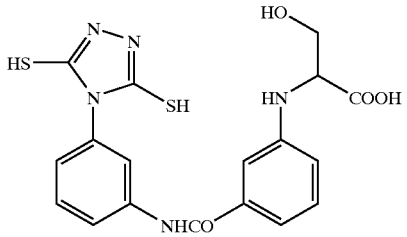
7
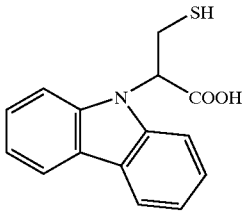
8
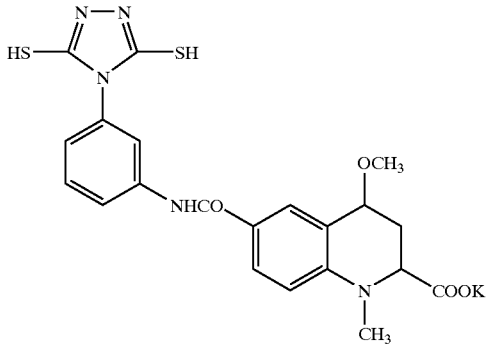
9
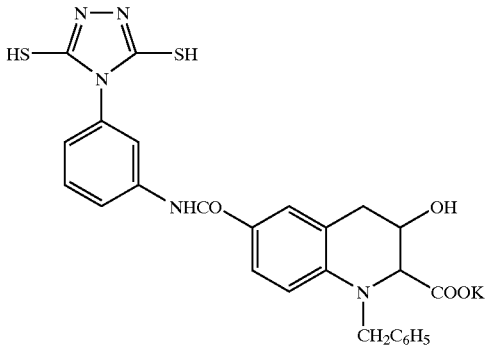
10
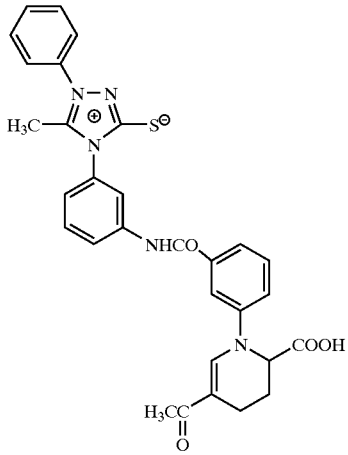

-continued
11
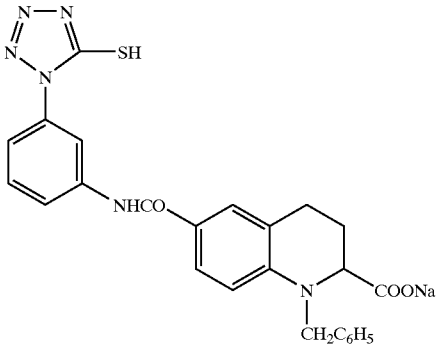
12
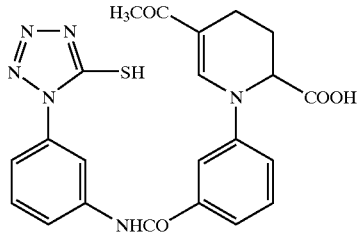
13
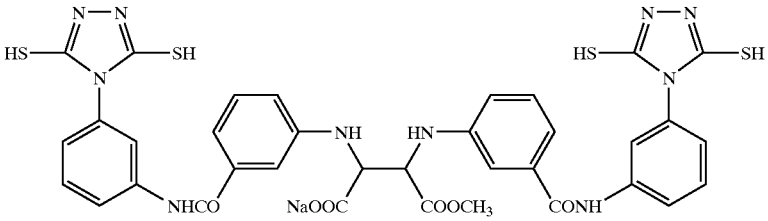
14
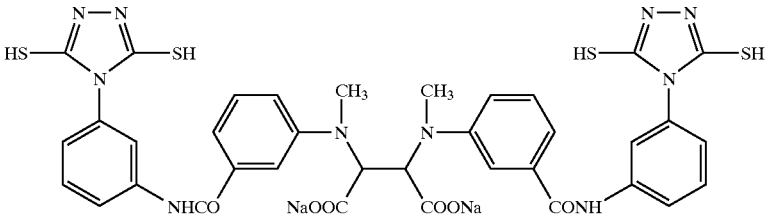
15
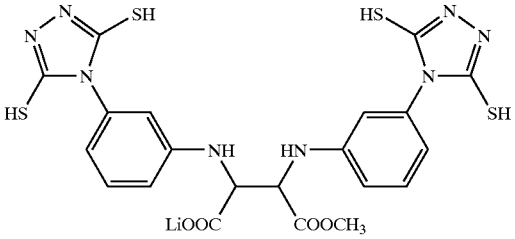
16
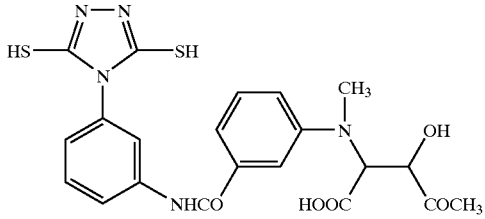
17
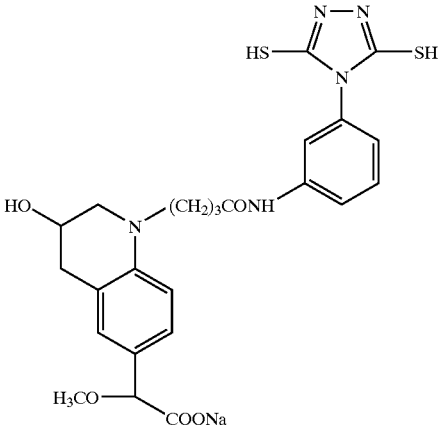
18
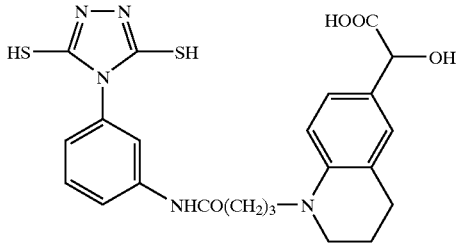

-continued
19
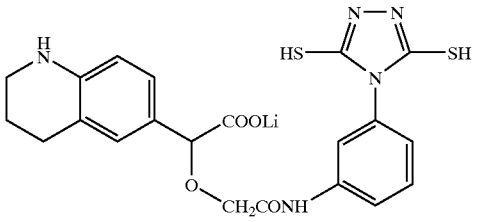
20
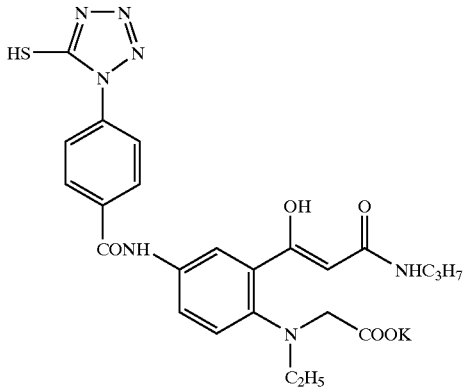
21
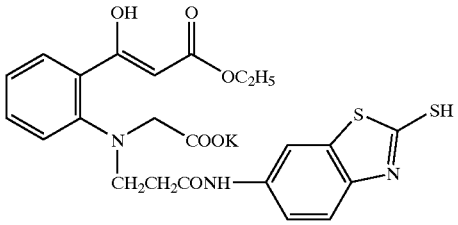
22
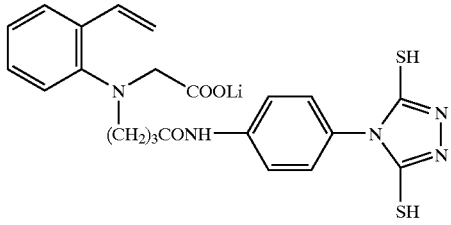
23
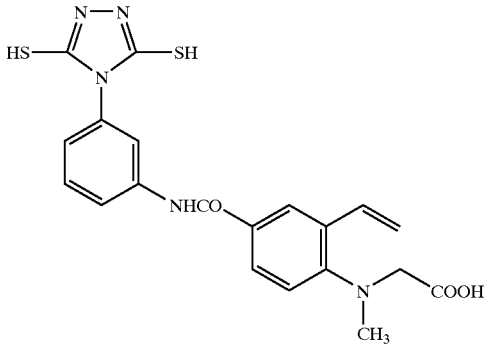
24
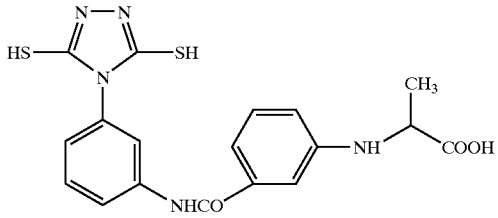
25
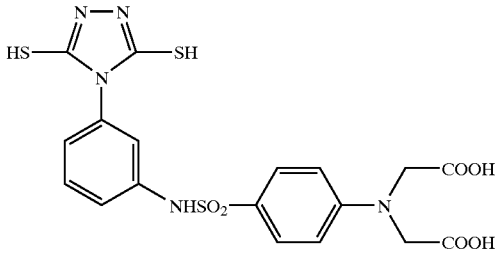
26
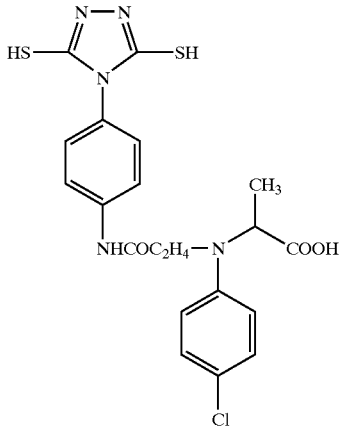

-continued
27
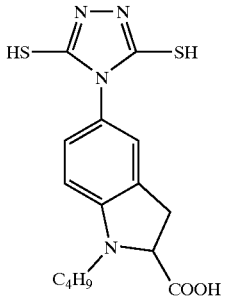
28
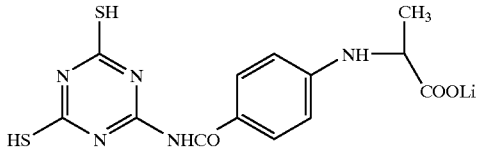
29
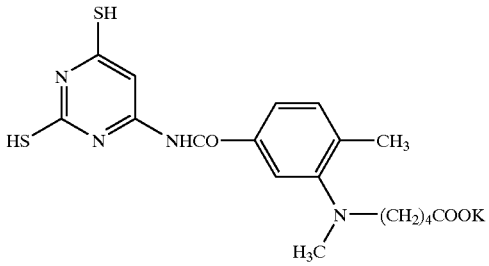
30
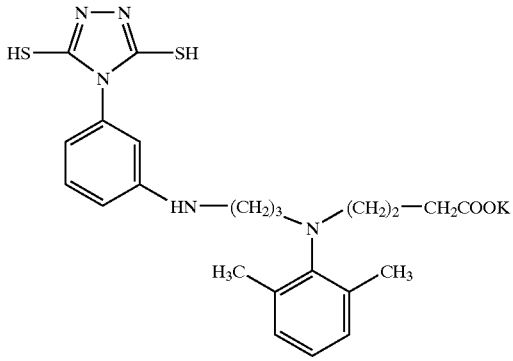
31
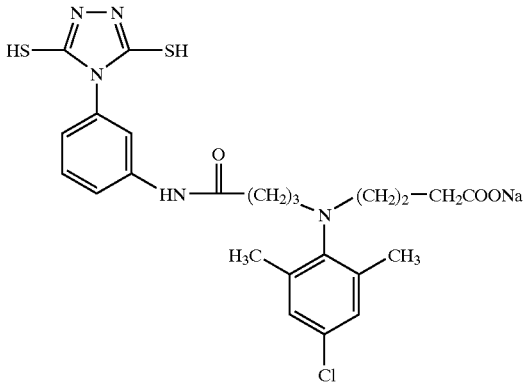
32
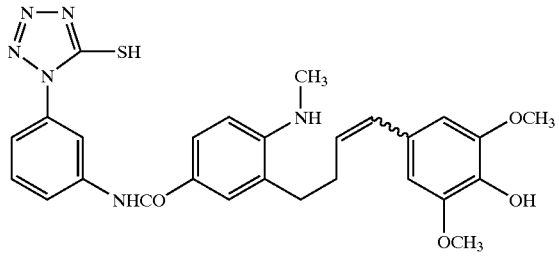
(cis or trans)
33
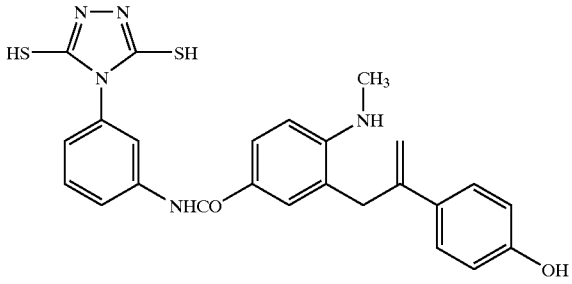

-continued
34
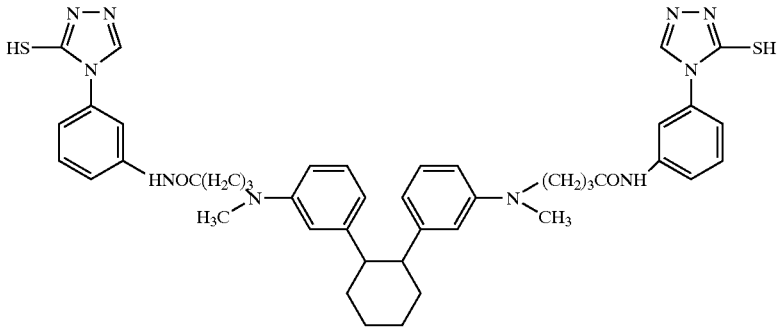
35
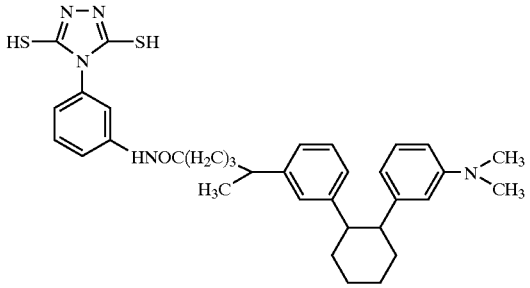
36
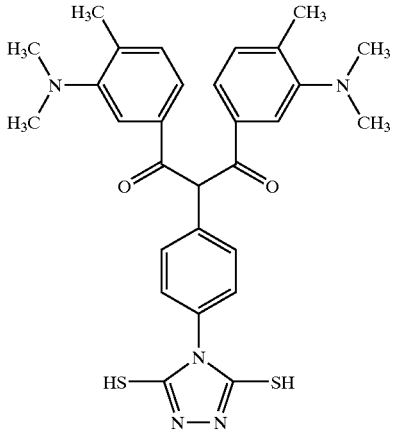
37
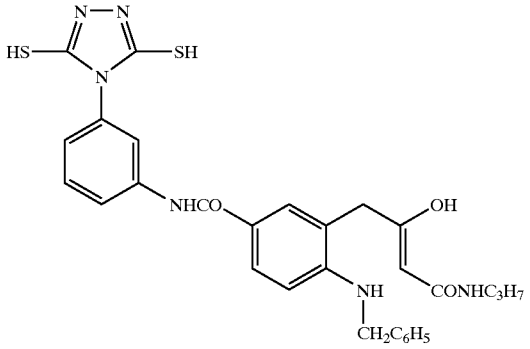
38
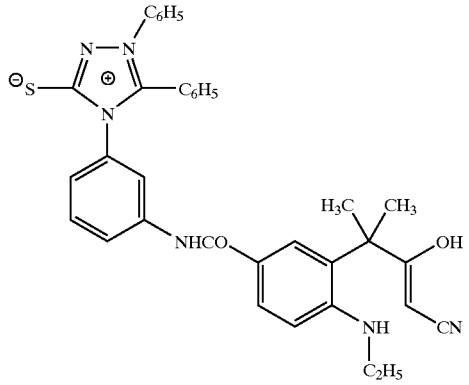
39
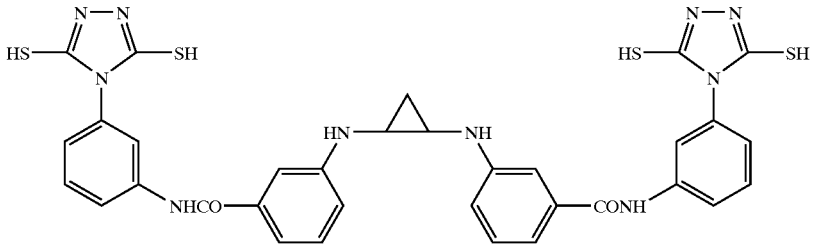

-continued
40
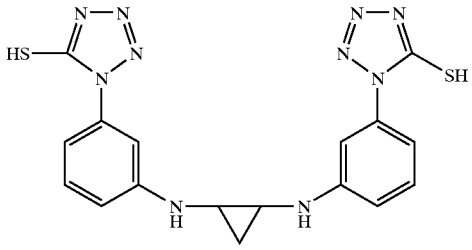
41
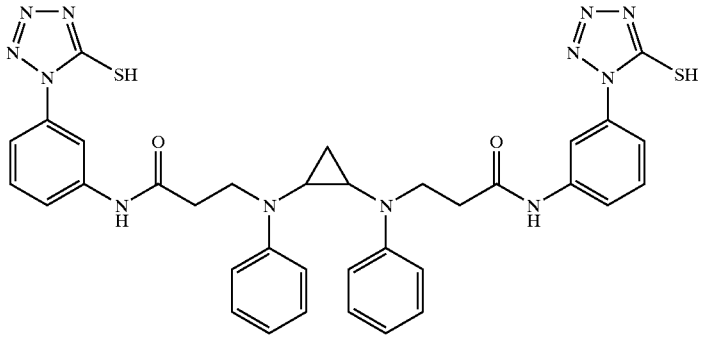
42
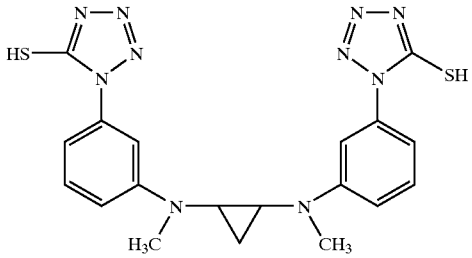
43
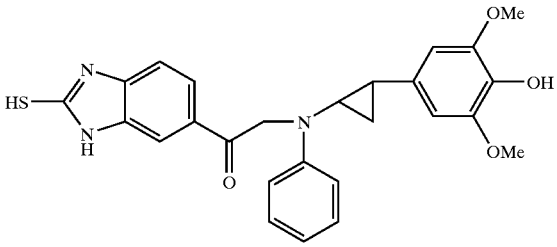
44
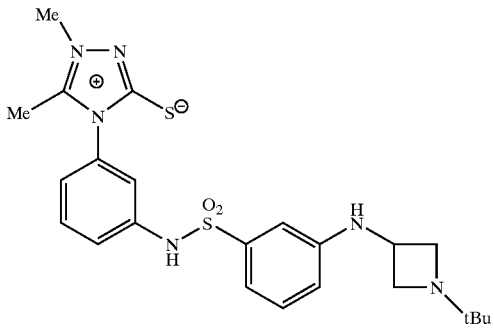
45
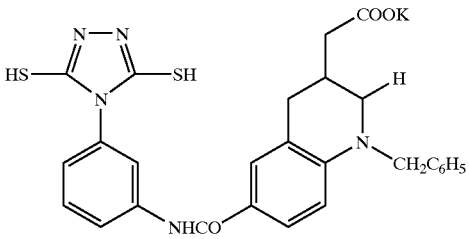
46
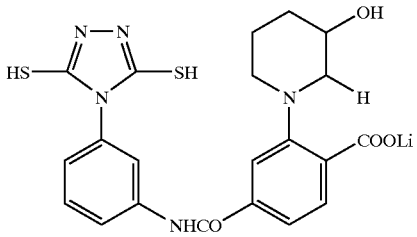
47
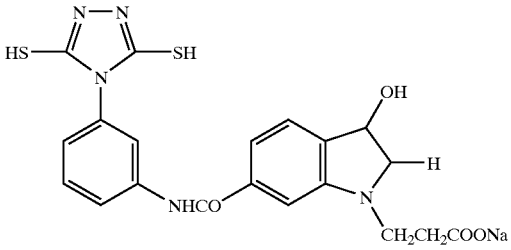

-continued
48
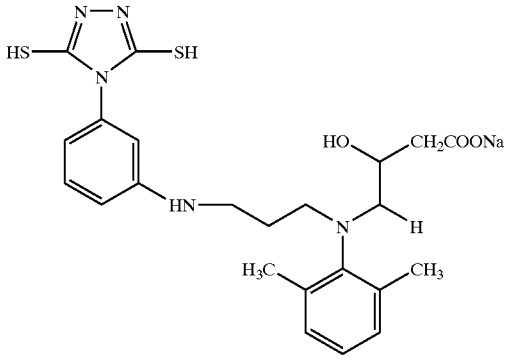
49
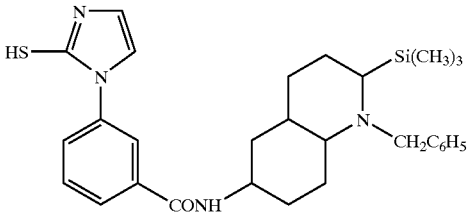
50
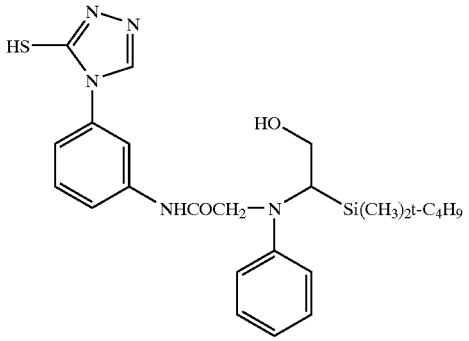
51
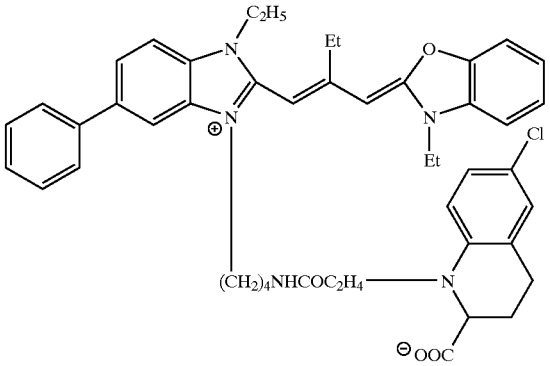
52
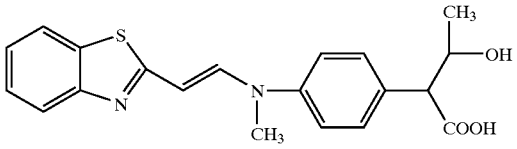
53
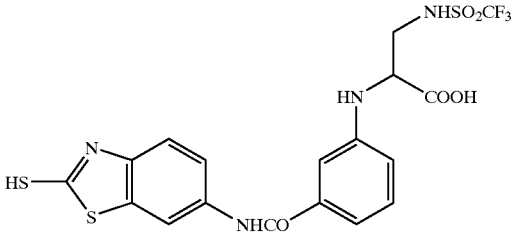
54
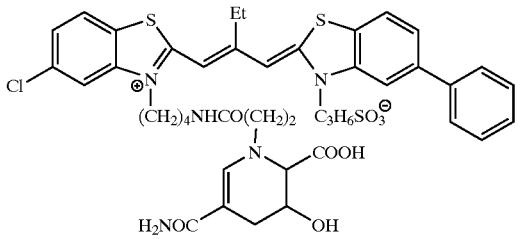
55
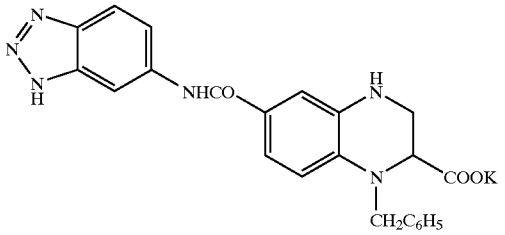
56
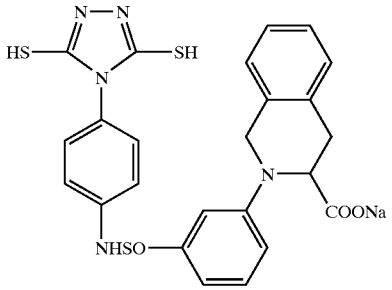
57
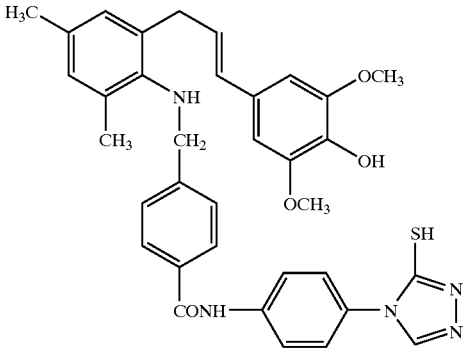

-continued

58

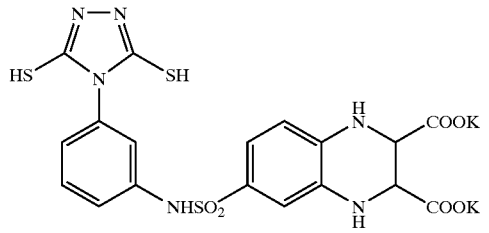

59

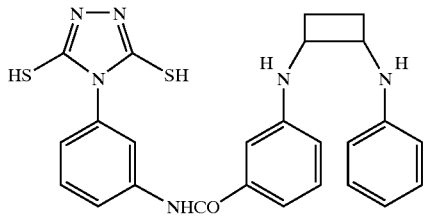

60

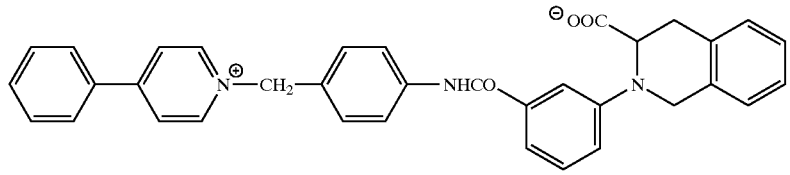

The compounds of types 1 to 4 according to the present invention are the same as those described in detail in Japanese Patent Applications Nos. 2001-272137, 2002-188536, 2002-188537 and 2002-192373, the entire contents of the specification of the patent applications of which are incorporated herein by references. The specific compounds disclosed in the specifications of these patent applications can also be mentioned as specific examples of the compounds of types 1 to 4 according to the present invention. Further, examples of synthesis of the compounds of types 1 to 4 according to the present invention are also the same as those described in these patent applications.

The compound of type 5 will be described below.

The compound of type 5 is represented by X—Y, wherein X represents a reducing group and Y represents a split-off group. The compound of type 5 is such a compound that the reducing group represented by X is capable of undergoing a one-electron oxidation to thereby form a one-electron oxidation product thereof, from which Y is split accompanying a subsequent cleavage reaction of X—Y bond to thereby form an X radical, the X radical capable of further releasing another electron. The reaction when such compound as type 5 is oxidized may be represented by the following formulae:

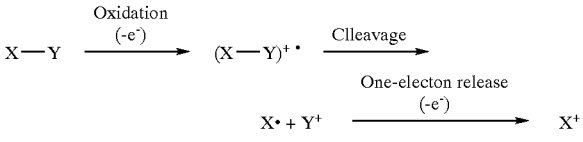

The oxidation potential of the compound of type 5 is preferably in the range of 0 to 1.4 V, more preferably 0.3 to 1.0 V. The oxidation potential of the radical X. formed according to the above reaction formula is preferably in the range of −0.7 to −2.0 V, more preferably −0.9 to −1.6 V.

The compound of type 5 is preferably represented by the general formula (G):

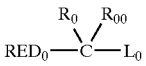

(G)

In the general formula (G), $RED_0$ represents a reducing group. $L_0$ represents a split-off group, and each of $R_0$ and $R_{00}$ represents a hydrogen atom or substituent. $RED_0$ and $R_0$, and also $R_0$ and $R_{00}$ may be bonded with each other to thereby form a ring structure. $RED_0$ represents the same groups as those represented by $RED_2$ of the general formula (C), and the preferred ranges thereof are also the same. $R_0$ and $R_{00}$ respectively represent the same groups as those represented by $R_{21}$ and $R_{22}$ of the general formula (C), and the preferred ranges thereof are also the same. Provided however that each of $R_0$ and $R_{00}$ does not represent the same groups as those represented by $L_0$, except for a hydrogen atom. $RED_0$ and $R_0$ may be bonded with each other to thereby form a ring structure. This ring structure can be, for example, any of those formed by bonding between $RED_2$ and $R_{21}$ of the general formula (C), and the preferred ranges thereof are also the same. Examples of the ring structures formed by bonding between $R_0$ and $R_{00}$ include a cyclopentane ring and a tetrahydrofuran ring. $L_0$ of the general formula (G) represents the same groups as those represented by $L_2$ of the general formula (C), and the preferred ranges thereof are also the same.

Each of the compounds of the general formula (G), although preferably having, in its molecule, an adsorptive group to silver halides or a partial structure of spectral sensitizing dye, does not simultaneously have two or more adsorptive groups in its molecule when $L_0$ represents a group other than a silyl group. Provided however that with respect to the sulfide group as an adsorptive group, two or more thereof may be had, irrespective of $L_0$.

The adsorptive groups to silver halides possessed by the compounds of the general formula (G) can be, for example, those which may be had by the compounds of types 1 to 4 according to the present invention. Furthermore, the adsorptive groups include a selenoxo group (—C═Se—), a telluroxo group (—C═Te—), a seleno group (—Se—), a telluro group (—Te—) and an active methine group. Herein, the selenoxo group (—C═Se—) and telluroxo group (—C═Te—) respectively refer to Se and Te derivatives of a compound having a thione group (—C═S—) and, as mentioned above with respect to thione groups, may be groups containing a selenoamido group (—C═Se—NH—) and a telluramido group (—C═Te—NH—), respectively. The seleno group (—Se—) and telluro group (—Te—) also respectively refer to Se and Te derivatives of a compound having a sulfido group (—S—), and can be, for example, any of Se and Te substitution products of compounds having a sulfido group. The active methine group refers to a methine group substituted with two electron-withdrawing groups. Herein, the electron withdrawing group refers to an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The above two electron-withdrawing groups may be bonded with each other to thereby form a ring structure.

The adsorptive groups possessed by the compounds of the general formula (G) are preferably a mercapto group (or its salt), a thione group (—C═S—), a heterocyclic group containing at least one atom selected from a nitrogen atom, sulfur atom, selenium atom and tellurium atom, and a sulfido group. More preferably, the adsorptive groups are a nitrogen-containing heterocyclic group substituted with mercapto, and a nitrogen-containing heterocyclic group having a —NH— group capable of forming iminosilver (>NAg) as a partial structure of the heterocycle.

These are the same as those described with respect to the preferred range of adsorptive groups which may be possessed by the compounds of types 1 to 4. Although the site of adsorptive group substitution in the general formula (G) is not limited, the substitution is preferably effected at $RED_0$ or $R_0$, more preferably $RED_0$.

The partial structure of spectral sensitizing dye which may be had by the compounds of the general formula (G) is the same as the partial structure of spectral sensitizing dye which may be had by the compounds of types 1 to 4 according to the present invention.

Specific examples of the compounds of the general formula (G) will be set out below, to which however the present invention is in no way limited.

G-1

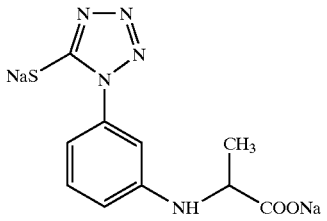

G-2

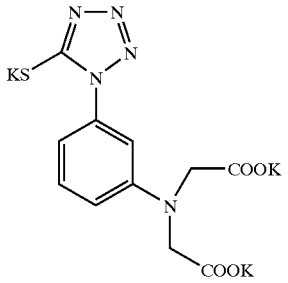

G-3

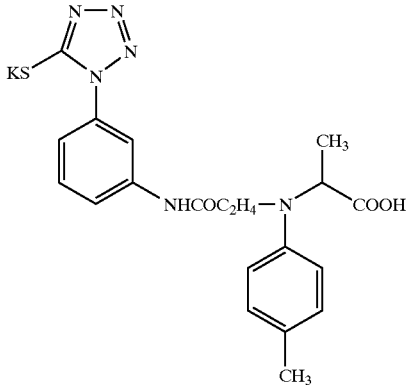

-continued

G-4

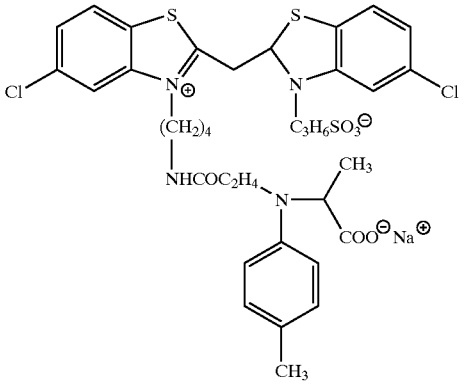

G-5

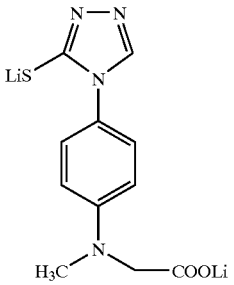

G-6

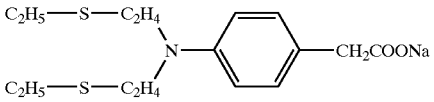

G-7

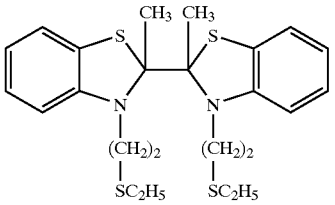

G-8

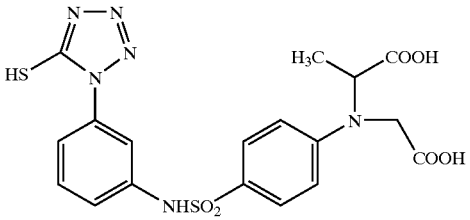

G-9

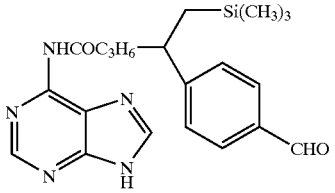

G-10

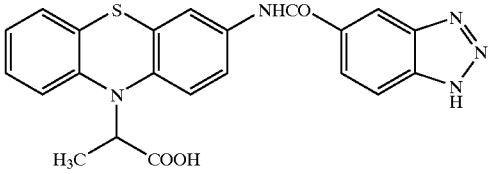

-continued
G-11
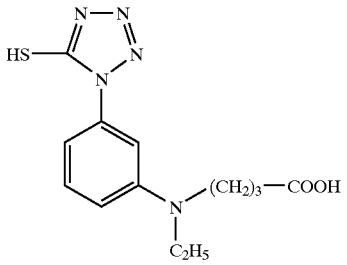
G-12
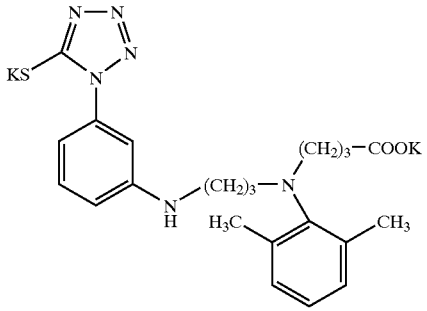
G-13
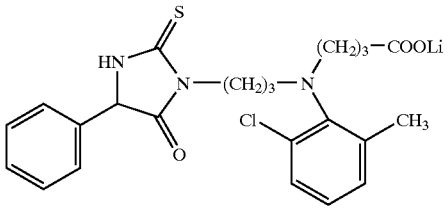
G-14
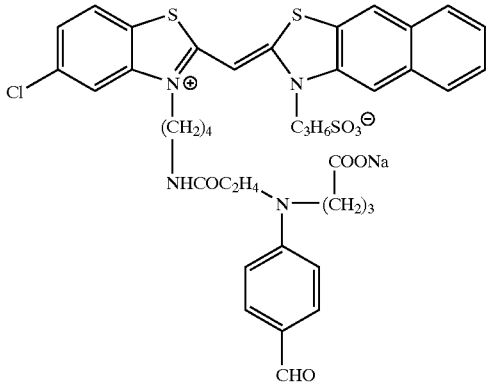
G-15
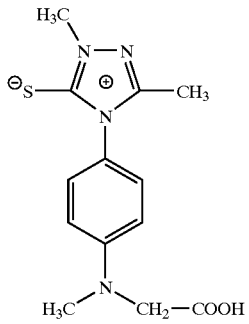
-continued
G-16
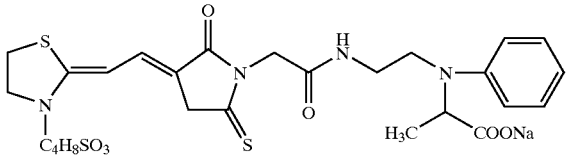
G-17
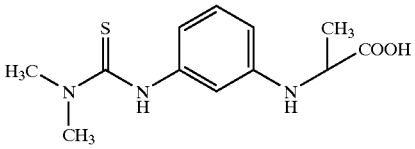
G-18
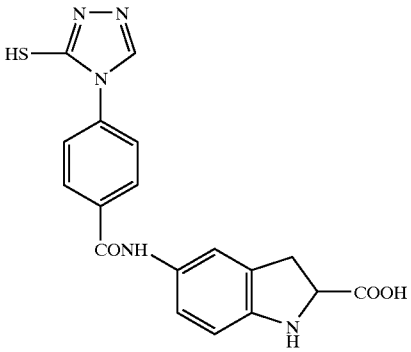
G-19
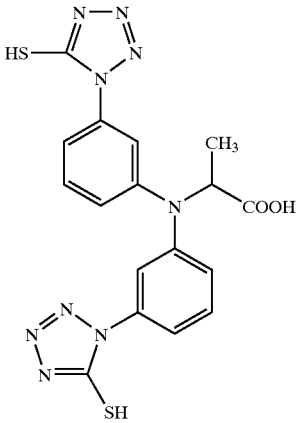
G-20
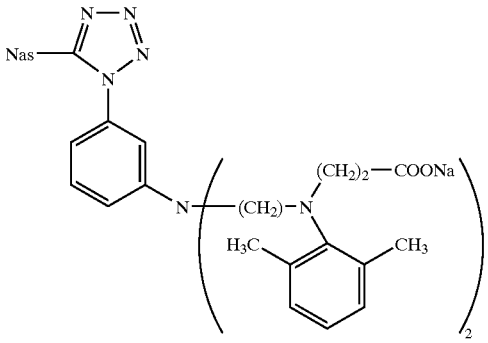

-continued

G-21

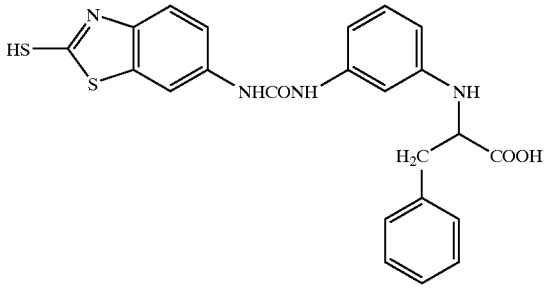

G-22

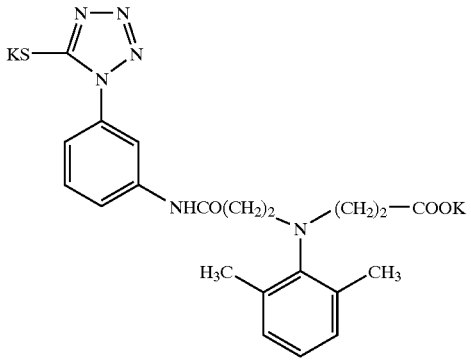

G-23

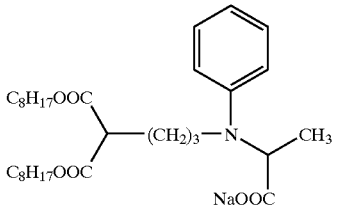

G-24

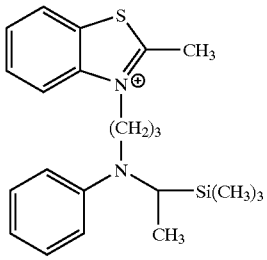

Specific examples of the compounds of the general formula (G) further include examples of compounds described as "one photon two electrons sensitizers" or "deprotonating electron-donating sensitizers" in the patent publications and specifications of, for example, JP-A-9-211769 (compounds PMT-1 to S-37 listed in Tables E and F on pages 28 to 32), JP-A-9-211774, JP-A-11-95355 (compounds INV 1 to 36), Japanese Patent Application KOHYO Publication 2001-500996 (compounds 1 to 74, 80 to 87 and 92 to 122), U.S. Pat. Nos. 5,747,235 and 5,747,236, EP 786692A1 (compounds INV 1 to 35), EP 893732A1 and U.S. Pat. Nos. 6,054,260 and 5,994,051, the entire contents of which are incorporated herein by reference.

The compound of types 1 to 5 may be used at any time during emulsion preparation or in photosensitive material manufacturing step, for example, during grain formation, at desalting step, at the time of chemical sensitization, or before coating. The compound may be added separately in a plurality of times during the steps. Preferable addition timing is from the completion of grain formation to before a desalting step, at the time of chemical sensitization (immediately before the initiation of chemical sensitization to immediately after the completion thereof), or before coating. More preferable addition timing is at chemical sensitization or before coating.

The compound of types 1 to 5 according to the present invention may preferably be added by dissolving it to a water or water-soluble solvent such as methanol, ethanol or a mixture of solvents. When the compound is added to water, if the solubility of the compound increases in a case where pH is raised or lowered, the compound may be added to the solvent by raising or lowering the pH thereof.

It is preferable that the compound of types 1 to 5 according to the present invention is used in an emulsion layer, but the compound may be added in a protective layer or interlayer together with the emulsion layer, thereby making the compound diffuse during coating. The addition time of the compound of the invention is irrespective of before or after the addition time of a sensitizing dye. Each of the compounds is preferably contained in a silver halide emulsion layer in an amount of $1\times10^{-9}$ to $5\times10^{-2}$ mol, more preferably $1\times10^{-8}$ to $2\times10^{-3}$ mol pre mol of silver halide.

Next, the reducing compounds according to the present invention will now be described.

The term "reducing compound" in the present invention indicates a compound selected from hydroxylamines, hydroxamic acids, hydroxyureas, hydroxyurethanes, hydroxysemicarbazides, reductons (including reducton derivatives), anilines, phenols (including chroman-6-ols, 2,3-dihydrobenzofuran-5-ols, aminophenols, sulfonamidophenols, and polyphenols such as hydroquinones, catechols, resorcinols, benzenetriols and bisphenols), hydrazines, hydrazides, and Phenidons.

Hydroxylamines are compounds preferably represented by general formula ($B_1$), hydroxamic acids are compounds preferably represented by general formula ($B_2$), hydroxyureas are compounds preferably represented by general formula ($B_3$), hydroxyurethanes are compounds preferably represented by general formula ($B_4$), hydroxysemicarbazides are compounds preferably represented by general formula ($B_5$), reductons are compounds preferably represented by general formula ($B_6$), anilines are compounds preferably represented by general formula ($B_7$), phenols are compounds preferably represented by general formulae ($B_8$), ($B_9$) and ($B_{10}$), hydrazines are compounds preferably represented by general formula ($B_{11}$), hydrazides are compounds preferably represented by general formula ($B_{12}$), and Phenidons are compounds preferably represented by general formula ($B_{13}$):

($B_1$)

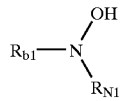

($B_2$)

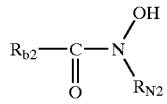

($B_3$)

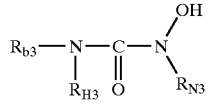

-continued (B4)

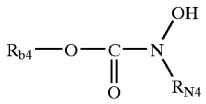

(B5)

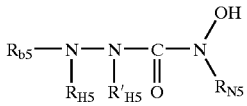

(B6)

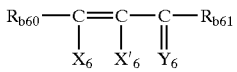

(B7)

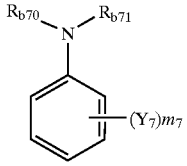

(B8)

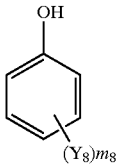

(B9)

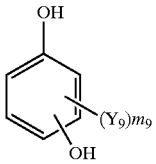

(B10)

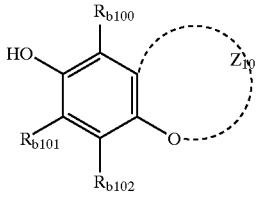

(B11)

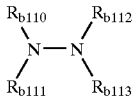

(B12)

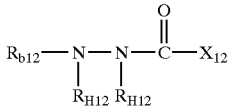

(B13)

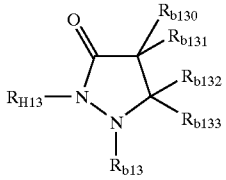

In the general formulae ($B_1$) to ($B_{13}$), each of $R_{b1}$, $R_{b2}$, $R_{b3}$, $R_{b4}$, $R_{b5}$, $R_{b70}$, $R_{b71}$, $R_{b110}$, $R_{b111}$, $R_{b112}$, $R_{b113}$, $R_{b12}$, $R_{b13}$, $R_{N1}$, $R_{N2}$, $R_{N3}$, $R_{N4}$, and $R_{N5}$ represents a hydrogen atom, alkyl group, aryl group, or heterocyclic group, each of $R_{H3}$, $R_{H5}$, $R'_{H5}$, $R_{H12}$, $R'_{H12}$, and $R_{H13}$ represents a hydrogen atom, alkyl group, aryl group, acyl group, alkylsulfonyl group or arylsulfonyl group, and among them $R_{H3}$ may further represent a hydroxy group. Each of $R_{b100}$, $R_{b101}$, $R_{b102}$, and $R_{b130}$ to $Rb_{133}$ represents a hydrogen atom or a substituent. Each of $Y_7$ and $Y_8$ represents a substituent excluding a hydroxy group, $Y_9$ represents a substituent, $m_7$ represents an integer of 0 to 5, $m_8$ represents an integer of 1 to 5, and mg represents an integer of 0 to 4. If $m_7$, $m_8$ and $m_9$ represent 2 or greater, each pair of two adjacent $Y_7$'s, $Y_8$'s and $Y_9$'s may bind to each other to form an aryl group condensed to the benzene ring (for example, a benzene-condensed ring), and it may further have a substituent. $Z_{10}$ represents a nonmetallic atomic group which can form a ring, and $X_{12}$ represents a hydrogen atom, alkyl group, aryl group, heterocyclic group, alkoxy group, amino group (including alkylamino group, arylamino group, heterocyclic amino group, and cyclic amino group), or carbamoyl group.

In the general formula ($B_6$), each of $X_6$ and $X'_6$ represents a hydroxy group, alkoxy group, mercapto group, alkylthio group, amino group (including an alkylamino group, arylamino group, heterocyclic amino group, and a cyclic amino group), acylamino group, sulfonamido group, alkoxycarbonylamino group, ureido group, acyloxy group, acylthio group, alkylaminocarbonyloxy group, or arylaminocarbonyloxy group. Each of $R_{b60}$, $R_{b61}$ represents an alkyl group, aryl group, amino group, alkoxy group, or aryloxy group, and $R_{b60}$ and $R_{b61}$ may bind to each other to form a ring structure. $Y_6$ represents an oxygen atom or sulfur atom.

In the above explanation of each group in the general formulae ($B_1$) to ($B_{13}$), the term "alkyl group" (including an alkyl group of a group having an alkyl group moiety, such as an alkylsulfonyl group) indicates a substituted or unsubstituted, linear, branched or cyclic alkyl having 1 to 30 carbon atoms, the term "aryl group" (including an aryl group of a group having an aryl group moiety, such as an arylsulfonyl group) indicates a substituted or unsubstituted, monocyclic or condensed-ring aromatic hydrocarbon ring such as a phenyl group and naphthyl group, and the term "heterocyclic group" (including a heterocyclic group of a group having a heterocyclic group moiety, such as a heterocyclic amino group) indicates an aromatic or non-aromatic, monocyclic or condensed-ring, substituted or unsubstituted heterocyclic group containing at least one hetero atom.

Further, examples of the substituents herein are a halogen atom (fluorine atom, chlorine atom, bromine atom, or iodine atom), alkyl group (linear, branched or cyclic alkyl group, including bicycloalkyl group and active methine group), alkenyl group, alkynyl group, aryl group, heterocyclic group (regardless of position of substitution), acyl group, alkoxycarbonyl group, aryloxycarbonyl group, heterocyclicoxycarbonyl group, carbamoyl group, N-hydroxycarbamoyl group, N-acylcarbamoyl group, N-sulfonylcarbamoyl group, N-carbamoylcarbamoyl group, thiocarbamoyl group, N-sulfamoylcarbamoyl group, carbazoyl group, carboxy group or its salt, oxalyl group, oxamoyl group, cyano group, carbonimidoyl group, formyl group, hydroxy group, alkoxy group (including a group containing repeated ethyleneoxy group or propyleneoxy group units), aryloxy group, heterocyclicoxy group, acyloxy group, alkoxy- or aryloxycarbonyloxy group, carbamoyloxy group, sulfonyloxy group, amino group, alkyl-, aryl- or heterocyclic-amino group, acylamino group, sulfonamido group, ureido group, thioureido group, N-hydroxyureido group, imido group, alkoxy- or aryloxy-carbonylamino group, sulfamoylamino group, semicarbazido group, thiosemicarbazido group, hydrazino group, ammonio group, oxamoylamino group, N-alkyl- or N-aryl-sulfonylureido group, N-acylureido group, N-acylsulfamoylamino group, hydroxyomino group, nitro group, heterocyclic group containing a quaternized nitrogen atom (such as pyridinio group, imidazolio group, quinolinio group, and isoquinolinio group), isocyano group, imino group, mercapto group, alkyl-, aryl- or heterocyclic-thio group, alkyl-, aryl- or heterocyclic-dithio group, alkyl- or aryl-sulfonyl group, alkyl- or aryl-sulfinyl group, sulfo group or a salt thereof, sulfamoyl group, N-acylsulfamoyl group, N-sulfonylsulfamoyl group or a salt thereof, phosphino group, phosphinyl group, phosphinyloxy group, phosphinylamino group, and silyl group. The term "active methine group" herein indicates a methine group substituted by two electron-withdrawing groups, and the term "electron-withdrawing group" herein indicates an acyl group, alkoxycarbonyl group, aryloxycarbonyl group, carbamoyl group, alkylsulfonyl group, arylsulfonyl group, sulfamoyl group, trifluoromethyl group, cyano group, nitro group, and carbonimidoyl group. The two electron-withdrawing groups may bind to each other to form a ring structure. Further, the term "salt" indicates salt with a cation such as an alkaline metal, alkaline-earth metal or heavy metal, or with an organic cation such as an ammonium ion or phosphonium ion.

These substituents may be further substituted by the substituents.

In the general formulae ($B_1$) to ($B_5$), each of $R_{N1}$, $R_{N2}$, $R_{N3}$, $R_{N4}$, and $R_{N5}$ is preferably a hydrogen atom or alkyl group. The alkyl group is preferably a linear, branched or cyclic, substituted or unsubstituted alkyl group preferably having 1 to 12 carbon atoms, more preferably a linear or branched, substituted or unsubstituted alkyl group having 1 to 6 carbon atoms. Examples of such an alkyl group are a methyl group, ethyl group, and benzyl group, etc.

In the general formula ($B_1$), $R_{b1}$ is preferably an alkyl group or heterocyclic group. The alkyl group is a linear, branched or cyclic, substituted or unsubstituted alkyl group, preferably having 1 to 30 carbon atoms, more preferably having 1 to 18 carbon atoms. The heterocyclic group is 5- or 6-membered, monocyclic or condensed-ring, aromatic or non-aromatic heterocyclic group, which may have a substituent. The heterocyclic group is preferably an aromatic heterocyclic group, such as a pyridine ring group, pyrimidine ring group, triazine ring group, thiazole ring group, benzothiazole ring group, oxazole ring group, benzoxazole ring group, imidazole ring group, benzimidazole ring group, pyrazole ring group, indazole ring group, indole ring group, purine ring group, quinoline ring group, isoquinoline ring group, or quinazoline ring group. Especially preferable aromatic heterocyclic group is a triazine ring group or benzothiazole ring group. The alkyl group or heterocyclic group represented by $R_{b1}$ further having at least one or two —N($R_{N1}$)OH group as its substituent is also a preferable Example of the compound represented by the general formula ($B_1$).

In the general formula ($B_2$), $R_{b2}$ is preferably an alkyl group, aryl group, or heterocyclic group, more preferably an alkyl group or aryl group. A preferable range of the alkyl group is the same as that in the description of $R_{b1}$. The aryl group is preferably a phenyl group or naphthyl group, especially preferably a phenyl group. The aryl group may have a substituent. The group represented by $R_{b2}$ further having at least one or two —CON($R_{N2}$)OH group as its substituent is also a preferable Example of the compound represented by the general formula ($B_2$).

In the general formula ($B_3$), $R_{b3}$ is preferably an alkyl group or an aryl group, and their preferable ranges are the same as those described with respect to $R_{b1}$ and $R_{b2}$. $R_{H3}$ is preferably a hydrogen atom, alkyl group, or hydroxy group, more preferably a hydrogen atom. The group represented by $R_{b3}$, further having at least one or two —N($R_{H3}$)CON($R_{N3}$)OH group as its substituent is also a preferable Example of the compound represented by the general formula (B3). Further, $R_{b3}$ and $R_{N3}$ may bind to each other to form a ring structure (preferably a 5- or 6-membered saturated heterocycle). In the general formula ($B_4$), $R_{b4}$ is preferably an alkyl group, and its preferable range is the same as that described with respect to $R_{b1}$. The group represented by $R_{b4}$, further having at least one or two —OCON($R_{N4}$)OH group as its substituent is also a preferable Example of the compound represented by the general formula ($B_4$).

In the general formula ($B_5$), $R_{b5}$ is preferably an alkyl group or aryl group, more preferably an aryl group, and their preferable ranges are the same as those described with respect to $R_{b1}$ and $R_{b2}$. Each of $R_{H5}$ and $R'_{H5}$ are preferably a hydrogen atom or alkyl group, more preferably a hydrogen atom.

In the general formula ($B_6$), $R_{b60}$ and $R_{b61}$ preferably bind to each other to form a ring structure. The ring structure formed by the above bonding is a 5- to 7-membered non-aromatic carbon ring or heterocycle, and may be a monocycle or condensed ring. Preferable specific examples of the ring structure are 2-cyclopentene-1-one ring, 2,5-dihydrofurane-2-one ring, 3-pyrroline-2-one ring, 4-pyrazoline-3-one ring, 2-cyclohexene-1-one ring, 5,6-dihydro-2H-pyran-2-one ring, 5,6-dihydro-2-pyridone ring, 1,2-dihydronaphthalene-2-one ring, coumarin ring (benzo-α-pyran-2-one ring), 2-quinolone ring, 1,4-dihydronaphthalene-1-one ring, chromone ring (benzo-γ-pyran-4-one ring), 4-quinolone ring, indene-1-one ring, 3-pyrroline-2,4-dione ring, uracil ring, thiouracil ring, and dithiouracil ring, more preferably, 2-cyclopentene-1-one ring, 2,5-dihydrofuran-2-one ring, 3-pyrroline-2-one ring, 4-pyrazoline-3-one ring, 1,2-dihydronaphthalene-2-one ring, coumarin ring (benzo-α-pyran-2-one ring), 2-quinolone ring, 1,4-dihydronaphthalene-1-one ring, chromone ring (benzo-γ-pyran-4-one ring), 4-quinolone ring, indene-1-one ring, and dithiouracil ring, and further preferably 2-cyclopentene-1-one ring, 2,5-dihydrofuran-2-one ring, 3-pyrroline-2-one ring, indene-1-one ring, and 4-pyrazoline-3-one ring.

When each of $X_6$ and $X'_6$ represents a cyclic amino group, the cyclic amino group is a non-aromatic nitrogen-containing heterocyclic group which binds to the carbon atom of the general formula ($B_6$) via its nitrogen atom, such as a pyrrolidino group, piperidino group, piperazino group, morpholino group, 1,4-thiazine-4-yl group, 2,3,5,6-tetrahydro-1,4-thiazine-4-yl group, or indolyl group.

Preferable examples of $X_6$ and $X'_6$ are a hydroxy group, mercapto group, amino group (including alkylamino group, arylamino group, and cyclic amino group), acylamino group, sulfonamido group, acyloxy group, or acylthio group, more preferably a hydroxy group, mercapto group, amino group, alkylamino group, cyclic amino group, sulfonamido group, acylamino group, and acyloxy group, and especially preferably a hydroxy group, amino group, alkylamino group, and cyclic amino group. Further, at least one of $X_6$ and $X'_6$ is preferably a hydroxy group.

$Y_6$ represents preferably an oxygen atom.

In the general formula ($B_7$), each of $R_{70}$ and $R_{b71}$ represents preferably a hydrogen atom, alkyl group or aryl group, more preferably an alkyl group. A preferable range of the alkyl group is the same as that described with respect to $R_{b1}$. $R_{b70}$ and $R_{b71}$ may bind to each other to form a ring structure (such as a pyrrolidine ring, piperidine ring, morpholino ring or thiomorpholino ring). Preferable examples of a substituent represented by $Y_7$ are an alkyl group (its preferable range is the same as that described with respect to $R_{b1}$), alkoxy group, acylamino group, sulfonamide group, ureido group, acyl group, alkoxycarbonyl group, carbamoyl group, sulfamoyl group, chlorine atom, sulfo group or a salt thereof, carboxy group or a salt thereof. $m_7$ represents preferably an integer of 0 to 2.

In the general formula ($B_8$), $m_8$ represents preferably an integer of 1 to 4, and plural $Y_8$'s may be the same or different. When $m_8$ is 1, $Y_8$ is preferably an amino group (including alkylamino group, and arylamino group), sulfonamido group, or acylamino group. Also, when $m_8$ is 2 or more, at least one of plural $Y_8$'s is preferably an amino group (including alkylamino group, and arylamino group), sulfonamido group, or acylamino group, and each of the remaining $Y_8$'s is preferably a sulfonamido group, acylamino group, ureido group, alkyl group, alkylthio group, acyl group, alkoxycarbonyl group, carbamoyl group, sulfo group or a salt thereof, carboxy group or a salt thereof or chlorine atom. If a o'-(or p'-)hydroxyphenylmethyl group serving as a substituent represented by $Y_8$ is substituted at a ortho or para position of the hydroxy group in the general formula ($B_8$), the general formula $B_8$ represents a compound generally called bisphenols, which is also a preferable Example of a compound represented by the general formula ($B_8$).

In the general formula ($B_9$), the positions of substitution of the two hydroxy groups may be ortho positions (catechols), meta positions (resorcinols) or para positions (hydroquinones). $m_9$ is preferably 1 to 2, and a plurality of $Y_9$'s may be the same or different. Preferable examples of the substituent represented by $Y_9$ are a chlorine atom, acylamino group, ureido group, sulfonamido group, alkyl group, alkylthio group, alkoxy group, acyl group, alkoxycarbonyl group, carbamoyl group, sulfo group or a salt thereof, carboxy group or a salt threreof, hydroxy group, alkylsulfonyl group, and arylsulfonyl group, etc. It is also a preferable Example that two adjacent $Y_9$'s are bonded to each other to form a condensed benzene ring and consequently the general formula ($B_9$) represents 1,4-naphthohydroquinones. When the general formula ($B_9$) represents catechols, $Y_9$ especially preferably represents a sulfo group or a salt thereof, or hydroxy group.

In the general formula ($B_{10}$), when each of $R_{b100}$, $R_{b101}$ and $R_{b102}$ represents a substituent, preferable examples of the substituents are the same as the preferable examples of $Y_9$. Among them, an alkyl group (in particular, methyl) is especially preferable. Preferable examples of a ring structure formed by $Z_{10}$ are a chroman ring and 2,3-dihydrobenzofuran ring. The ring structure may have a substituent, and may form a spiro ring.

In the general formula ($B_{11}$), preferable examples of $R_{b110}$, $R_{b111}$, $R_{b112}$ and $R_{b113}$ are an alkyl group, aryl group, and heterocyclic group, and their preferable ranges are the same as those described with respect to $R_{b1}$ and $R_{b2}$. Among them, an alkyl group is especially preferable, and two alkyl groups among $R_{b110}$ to $R_{b113}$ may be bonded to each other to form a ring structure. The ring structure is a 5- or 6-membered non-aromatic heterocycle, such as a pyrrolidine ring, piperidine ring, morpholino ring, thiomorpholino ring, or hexahydropyridazine ring, etc.

In the general formula ($B_{12}$), $R_{b12}$ preferably represents an alkyl group, aryl group or heterocyclic group, and their preferable ranges are the same as those described with respect to $R_{b1}$ and $R_{b2}$. $X_{12}$ preferably represents an alkyl group, aryl group (in particular, phenyl), heterocyclic group, alkoxy group, amino group (including alkylamino group, arylamino group, heterocyclic amino group and a cyclic amino group), or carbamoyl group, more preferably an alkyl group (especially preferably an alkyl group having 1 to 8 carbon atoms), aryl group (especially preferably phenyl), or amino group (including alkylamino group, arylamino group and cyclic amino group). Each of $R_{H12}$ and $R'_{H12}$ preferably represents a hydrogen atom or alkyl group, more preferably a hydrogen atom.

In the general formula ($B_{13}$), $R_{b13}$ preferably represents an alkyl group or aryl group, and their preferable ranges are the same as those described with respect to $R_{b1}$ and $R_{b2}$. Each of $R_{b130}$, $R_{b131}$, $R_{b132}$ and $R_{b133}$ preferably represents a hydrogen atom, alkyl group (especially preferably having 1 to 8 carbon atoms), or aryl group (especially preferably phenyl). $R_{H13}$ preferably represents a hydrogen atom or acyl group, more preferably a hydrogen atom.

Among the compounds represented by the general formula ($B_1$), the compounds of the general formula ($B_{14}$) are preferred.

($B_{14}$)

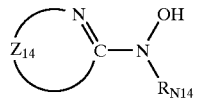

wherein $R_{N14}$ represents a hydrogen atom group or aryl group, and $Z_{14}$ represents a nonmetallic atomic group capable of bonding with —N═C— to thereby form a 5- to 7-membered heterocycle. As preferred heterocycles formed by $Z_{14}$ and —N═C—, there can be mentioned the aromatic heterocycles mentioned with respect to the general formula ($B_1$). The heterocycles are more preferably a pyrimidine ring group, triazine ring group, thiazole ring group, benzothiazole ring group, benzimidazole ring group, purine ring group, quinoline ring group and isoquinoline ring group. The heterocycles are further more preferably a pyrimidine ring group, triazine ring group, benzothiazole ring group, benzimidazole ring group and purine ring group, and most preferably a pyrimidine ring group, triazine ring group and benzothiazole ring group.

The heterocycles formed by $Z_{14}$ and —N═C— may each have a substituent which can be had by $R_{b1}$ in the general formula ($B_1$), and the preferred range thereof is the same as that of $R_{b1}$ of the general formula ($B_1$). Compounds having another —N($R_{N14}$)OH group, or two or more —N($R_{N14}$)OH groups as substituents are also included in the preferred examples of the compounds represented by the general formula ($B_{14}$).

$R_{N14}$ preferably represents a hydrogen atom or alkyl group. The preferred range of alkyl groups is the same as that of $R_{N1}$ of the general formula ($B_1$).

Among the compounds represented by the general formula ($B_2$), the compounds of the general formula ($B_{15}$) are preferred.

($B_{15}$)

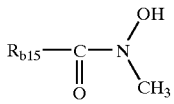

wherein $R_{b15}$ represents a hydrogen atom, group, aryl group or heterocyclic group. The preferred range of alkyl groups, aryl groups or heterocyclic groups is the same as that of $R_{b2}$ of the general formula ($B_2$).

$R_{b15}$ may have a substituent, and the preferred range thereof is the same as that of $R_{b2}$ of the general formula ($B_2$).

Compounds having another —N($CH_3$)OH group, or two or more —N($CH_3$)OH groups as substituents are also included in the preferred examples of the compounds represented by the general formula ($B_{15}$).

In one aspect of the present invention, the silver halide photosensitive material of the present invention is characterized by containing at least one reducing compound having C/H of 3 or less and at least one reducing compound having a C/H value of more than 3. In another aspect of the present invention, the silver halide photosensitive material of the present invention is characterized by containing at least one reducing compound having a molecular weight of 300 or less, and at least one reducing compound having a molecular weight of more than 300. The reducing compound having a molecular weight of less than 300 used in the present invention preferably has a molecular weight of 30 or more, more preferably has a molecular weight of 60 to 300. On the other hand, the reducing compound having a molecular weight of more than 300 preferably has a molecular weight of 1,000 or less, more preferably has a molecular weight of 700 or less.

In the present invention, the C/H value is defined as a ratio of the number of Group IV elements/the sum of Group III, Group V, Group VI and Group VII elements, disregarding the elements of other groups (e.g., hydrogen) contained in the molecular structure. When a functional group capable of forming a salt (for example, a group capable of forming an onium salt by reaction with an acid, such as an amino group, or an anionic group such as a carboxyl group or sulfo group), is present in the molecule, the C/H value shall be calculated in free form (form wherein any salt is not formed).

The Group III, Group IV, Group V, Group VI and Group VII elements refer to the elements up to the fifth period of the IUPAC periodic table. That is, the Group IV elements refer to carbon (C), silicon (Si), germanium (Ge) and tin (Sn). The Group III elements refer to boron (B), aluminum (Al), gallium (Ga) and indium (In). The Group V elements refer to nitrogen (N), phosphorus (P), arsenic (As) and antimony (Sb). The Group VI elements refer to oxygen (O), sulfur (S), selenium (Se) and tellurium (Te). The Group VII elements refer fluorine (F), chlorine (Cl), bromine (Br) and iodine (I).

In the present invention, the molecular weight generally refers to that calculated from the structural formula and composition formula of compound and the mass numbers of individual elements. When a particular compound in its molecule has a functional group capable of forming a salt (for example, a group capable of forming an onium salt by reaction with an acid, such as an amino group, or an anionic group such as a carboxyl group or sulfo group, is present in the molecule, the molecular weight of the compound refers to that calculated in free form (form wherein any salt is not formed).

In the present invention, the reducing compound may also be one having, incorporated in its molecule, a ballasting group or polymer chain customarily employed in immobilized photographic additives such as couplers. Herein, the ballasting group refers to a group having a linear, branched or cyclic alkyl group (or alkylene group) having 6 or more carbon atoms as a partial structure, which may be unsubstituted or substituted. This alkyl group (or alkylene group) can be bonded to any arbitrary position of the reducing compound of the present invention by means of an arbitrary linking group.

Herein, the linking group refers to one which consists of any one of groups such as an alkylene group, arylene group, heterocyclic group, a single bond, —O—, —$NR_N$—, —S—, —C═O—, —$SO_2$—, —C═S—, —SO— and —P═O—, or a polyvalent group consisting of combination of two or more these groups.

The above $R_N$ represents a hydrogen atom, alkyl group, aryl group or heterocyclic group. The linking group may further have any arbitrary substituent.

The ballasting group is preferably a group having a linear or branched alkyl group (or alkylene group) having 8 to 24 carbon atoms as a partial structure.

As the polymer, there can be mentioned, for example, those described in JP-A-1-100530, the entire contents of which are incorporated herein by reference.

Still further, the reducing compound of the present invention may be one having a group adsorptive to silver halide incorporated in its molecule.

In the present invention, the reducing compound having at least one group adsorptive to silver halide refers to a compound whose structure agrees with that of any of the general formulae ($B_1$) to ($B_{13}$), which compound has in its molecule a group adsorptive to silver halide which may be possessed by the compounds of types 1 to 5 described above.

The reducing compound of the present invention is preferably one selected from hydroxylamines represented by the general formula ($B_1$), hydroxamic acids represented by the general formula ($B_2$), hydroxylureas represented by the general formula ($B_3$), hydroxylurethanes represented by the general formula ($B_4$), hydroxysemicarbazides represented by the general formula ($B_5$), phenols represented by the general formulae ($B_8$), ($B_9$) and ($B_{10}$) (including chroman-6-ols, hydroquinones, catechols, resorcinols, bisphenols and the like), hydrazines represented by the general formula ($B_{11}$), Phenidones represented by the general formula ($B_{13}$) and reductones represented by the general formula ($B_6$) (including reductone derivatives). The reducing compound of the present invention is more preferably one selected from among hydroxylamines, hydroxamic acids, hydroxyureas, hydroxysemicarbazides, phenols, hydrazines and reductones.

Among the compounds represented by the general formula ($B_1$), hydroxylamines represented by the general formula ($B_{14}$) are especially preferred. Among the compounds represented by the general formula ($B_2$), hydroxamic acids represented by the general formula ($B_{15}$) are especially preferred.

As the reducing compound having a C/H value of 3 or less according to the present invention, there can preferably be employed hydroxylamines, hydroxamic acids, hydroxyureas, phenols, reductones and hydrazines.

Also, as the reducing compound having a C/H value of more than 3 according to the present invention, there can preferably be employed hydroxylamines, hydroxamic acids, hydroxyureas, hydroxyurethanes, phenols and reductones.

As the reducing compound having a molecular weight of 300 or less according to the present invention, there can preferably be employed hydroxylamines, hydroxamic acids, hydroxyureas, phenols, reductones and hydrazines.

Also, as the reducing compound having a molecular weight of more than 300 according to the present invention, there can preferably be employed hydroxylamines, hydroxamic acids, hydroxyureas, hydroxyurethanes, phenols and reductones.

An oxidation potential of each of the reducing compounds according to the present invention can be measured by using measuring methods described in "DENKIKAGAKU SOKUTEIHOU (Electrochemical Measuring method)" (pp. 150–208, GIHODO SHUPPAN Co. Ltd.) and "JIKKEN KAGAKU KOUZA (Experimental chemical Course)" the 4th Edition, edited and written by Chemical Society of Japan (Vol. 9, pages 282 to 344, published by Maruzen Co., Ltd.). For example, there is a method of rotary disc voltammetry. Specifically, a sample is dissolved in a solution of "methanol:Britton-Robinson buffer (pH 6.5)=10%:90% (volume %)", a nitrogen gas is passed therethrough for 10 minutes, and thereafter the oxidation potential can be measured at 25° C., 1000 rotation per minute, and a sweep speed of 20 mV/s, by using a rotary disc electrode (RDE) made of glassy carbon as a working electrode, a platinum wire as a counter electrode, and a saturated calomel electrode as a reference electrode. A half-wave potential (E1/2) can be determined based on the obtained voltammogram.

The oxidation potential of the reducing compounds according to the present invention preferably falls within, if measured by the above method, the range of about −0.3 V to 1.0 V, more preferably about −0.1 V to 0.8 V, especially preferably about 0 to 0.7 V.

The following are examples of the reducing compounds according to the present invention, however, the present invention is not limited to them.

The numbers in parentheses set forth under each reducing compound are [molecular weight/C/H value].

$B_1$-1

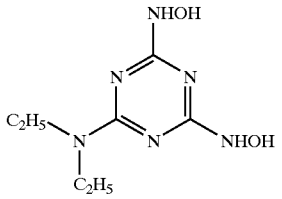

[214.23/0.88]

$B_1$-2

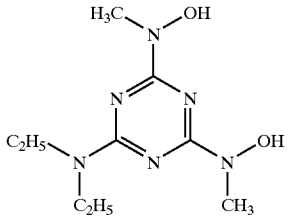

[242.28/0.88]

$B_1$-3

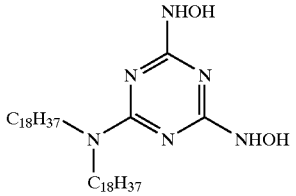

[663.08/4.88]

$B_1$-4

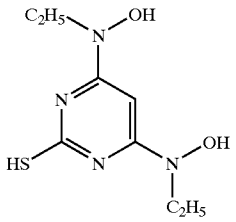

[230.29/1.14]

-continued $B_1$-5

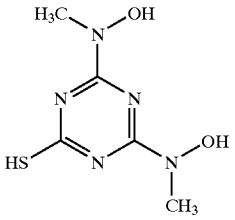

[203.22/0.63]

$B_1$-6

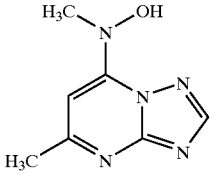

[179.18/1.17]

$B_1$-7

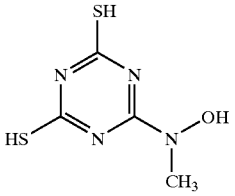

[190.25/0.57]

$B_1$-8

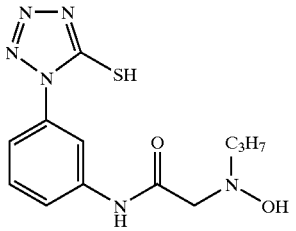

[308.36/1.33]

$B_1$-9

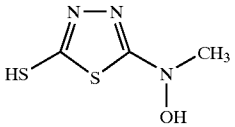

[163.22/0.50]

$B_1$-10

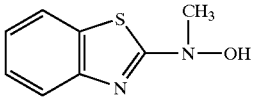

[180.23/2.00]

$B_1$-11

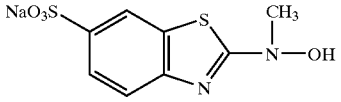

[260.29/1.00]

-continued
$B_1$-12
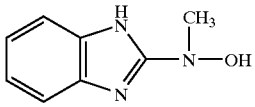
[163.18/2.00]
$B_1$-13
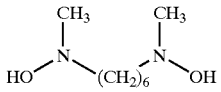
[176.26/2.00]
$B_1$-14
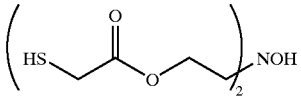
[269.34/1.00]
$B_1$-15
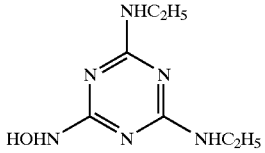
[198.23/1.00]
$B_1$-16
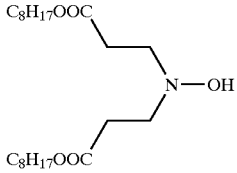
[465.72/3.67]
$B_1$-17
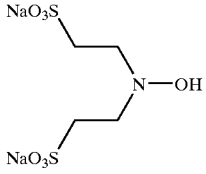
[249.27/0.40]
$B_1$-18
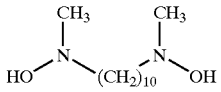
[232.37/3.00]
$B_2$-1
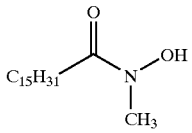
[285.47/4.25]
$B_2$-2
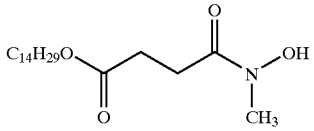
[343.51/3.80]
$B_2$-3
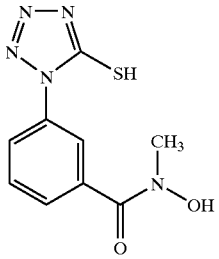
[251.27/1.13]
$B_2$-4
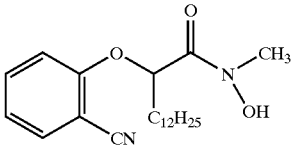
[374.56/4.40]
$B_2$-5
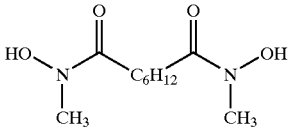
[232.28/1.67]
$B_2$-6
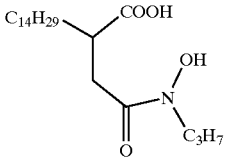
[371.56/4.20]
$B_2$-7
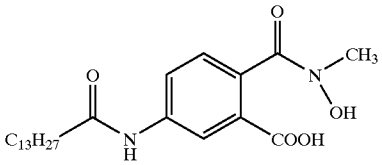
[420.55/3.29]
$B_2$-8
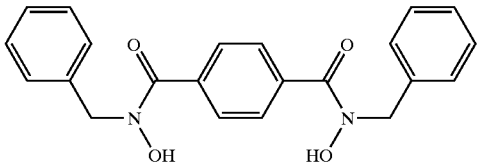
[376.41/3.67]
$B_2$-9
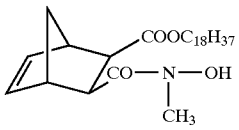
[463.70/5.60]

-continued
$B_2$-10
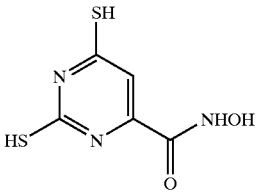
[203.25/0.71]
$B_2$-11
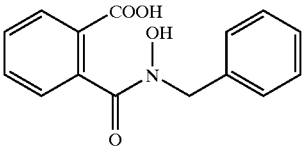
[495.70/6.20]
$B_2$-12
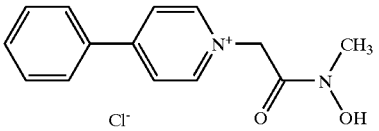
[278.74/2.80]
$B_2$-13
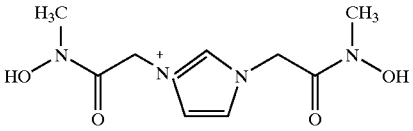
[278.70/1.00]
$B_3$-1
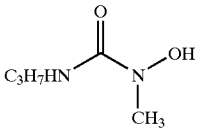
[132.16/1.25]
$B_3$-2
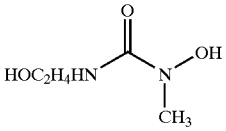
[134.14/0.80]
$B_3$-3
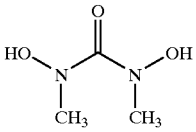
[120.11/0.60]
$B_3$-4
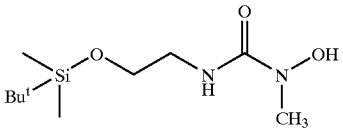
[248.40/2.20]
-continued
$B_3$-5
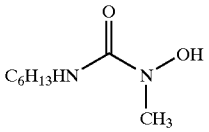
[174.24/2.00]
$B_3$-6
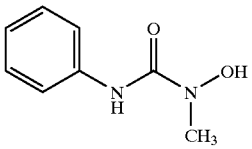
[166.18/2.00]
$B_3$-7
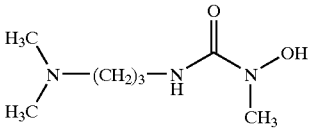
[175.23/1.40]
$B_3$-8
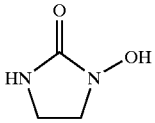
[102.09/0.75]
$B_3$-9
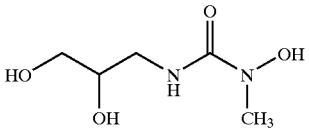
[164.16/0.83]
$B_3$-10
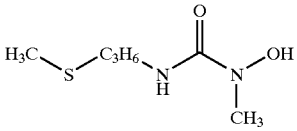
[178.26/1.20]
$B_3$-11
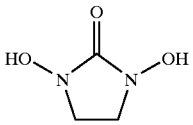
[118.09/0.60]
$B_3$-12
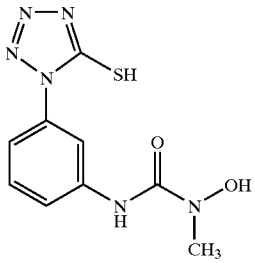
[266.28/1.00]

-continued
$B_3$-13
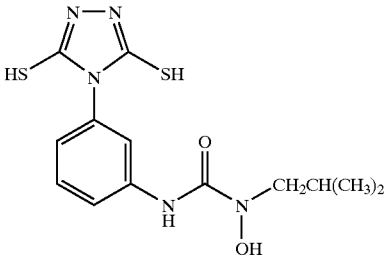
[339.44/1.44]
$B_3$-14
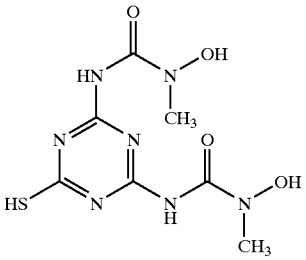
[298.28/0.58]
$B_3$-15
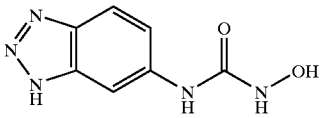
[193.17/1.00]
$B_3$-16
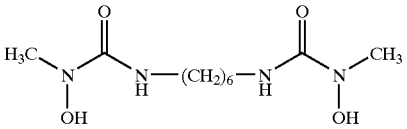
[262.31/1.25]
$B_3$-17
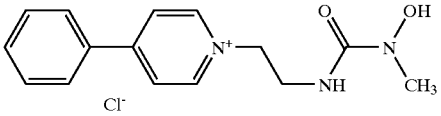
[307.78/2.50]
$B_3$-18
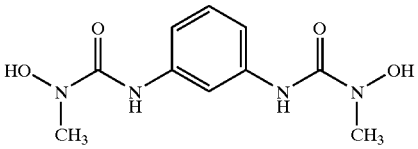
[254.25/1.25]
$B_3$-19
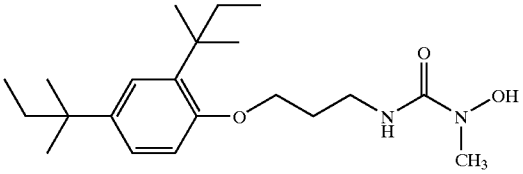
[364.53/4.20]
-continued
$B_4$-1
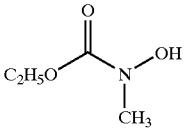
[119.12/1.00]
$B_4$-2
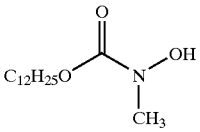
[259.39/3.50]
$B_4$-3
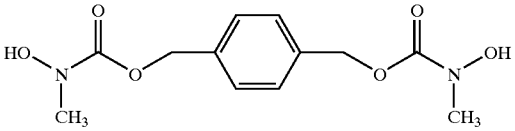
[260.25/1.25]
$B_4$-4
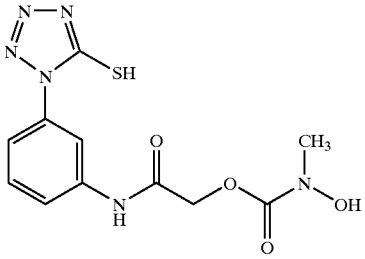
[324.32/1.00]
$B_5$-1
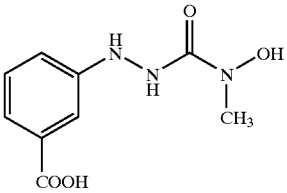
[225.20/1.29]
$B_5$-2
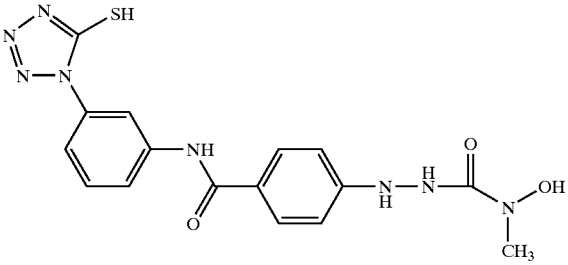
[400.42/1.33]
$B_5$-3
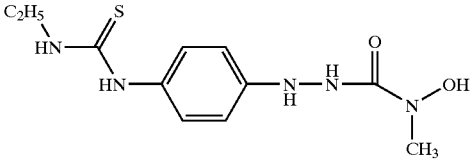
[283.35/1.38]

-continued
$B_5$-4
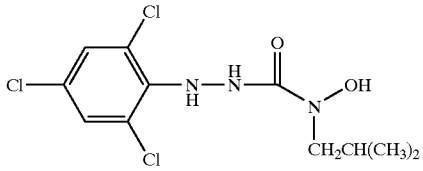
[326.61/1.38]
$B_5$-5
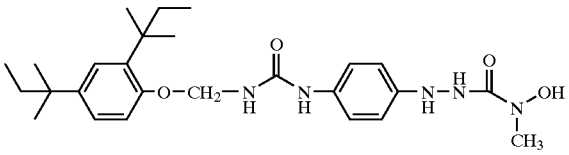
[470.61/3.25]
$B_5$-6
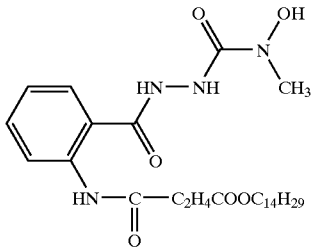
[520.67/2.70]
$B_6$-1
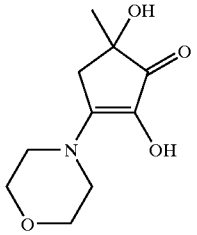
[213.23/2.00]
$B_6$-2
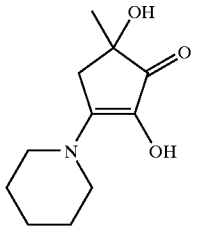
[211.26/2.75]
$B_6$-3
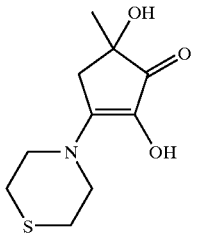
[229.30/2.00]
-continued
$B_6$-4
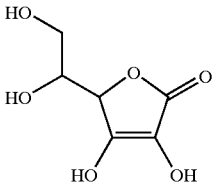
[176.13/1.00]
$B_6$-5
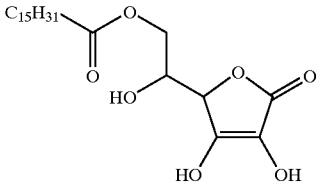
[414.54/3.14]
$B_6$-6
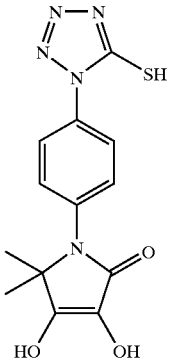
[307.33/1.33]
$B_6$-7
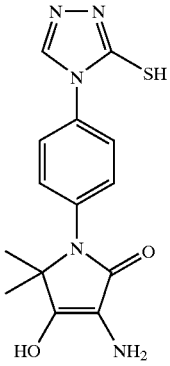
[305.36/1.63]
$B_6$-8
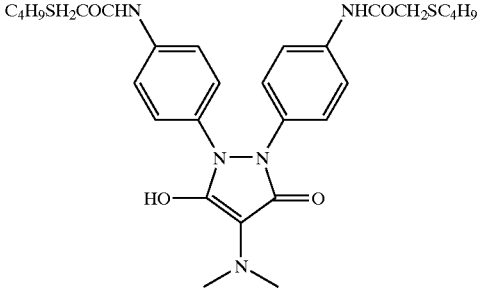
[585.79/2.64]

-continued
$B_6$-9
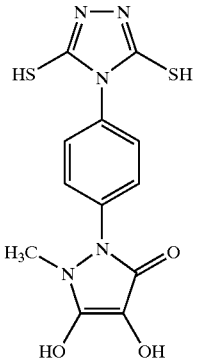
[337.38/1.20]
$B_6$-10
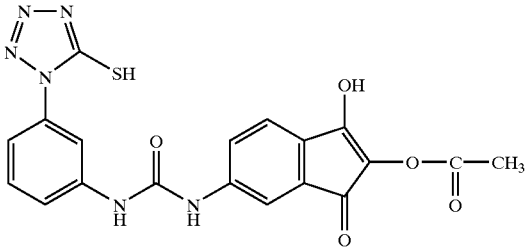
[438.42/1.58]
$B_6$-11
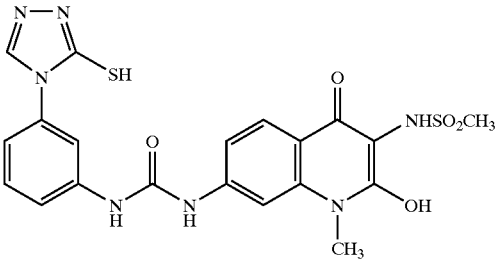
[501.55/1.43]
$B_8$-1
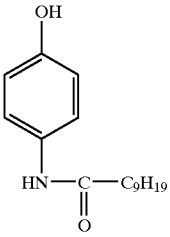
[263.38/5.33]
$B_8$-2
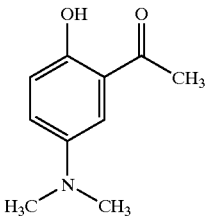
[179.22/3.33]
-continued
$B_8$-3
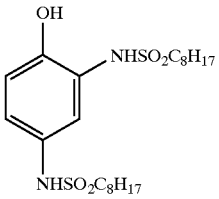
[476.70/2.44]
$B_8$-4
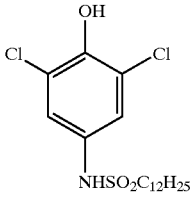
[410.40/2.57]
$B_8$-5
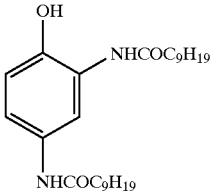
[503.55/5.20]
$B_8$-6
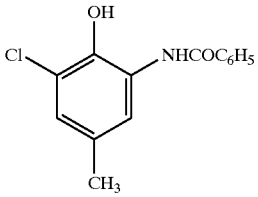
[216.71/3.50]
$B_8$-9
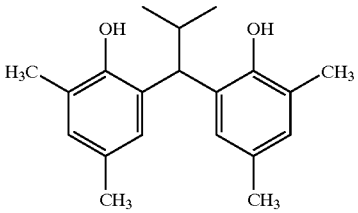
[298.43/10.00]
$B_8$-10
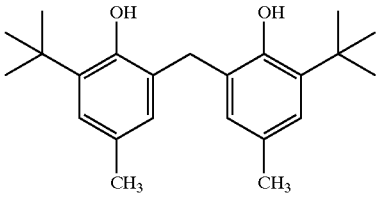
[340.51/11.50]

-continued
$B_8$-11
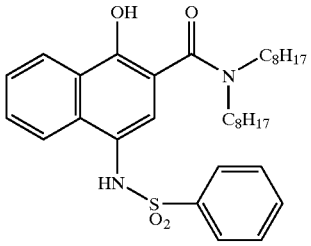
[566.81/4.71]
$B_8$-12
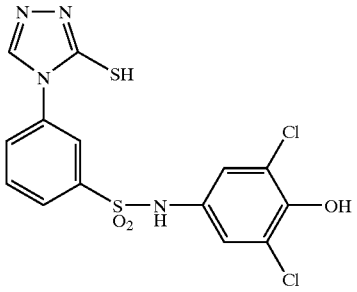
[417.30/1.27]
$B_9$-1
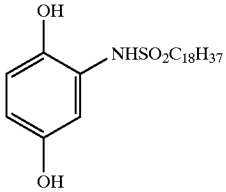
[441.68/4.00]
$B_9$-2
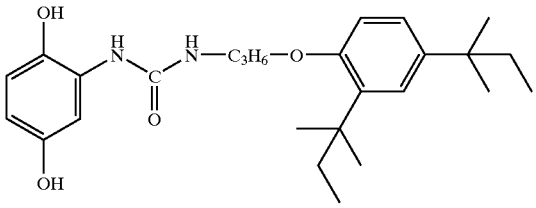
[442.60/4.33]
$B_9$-3
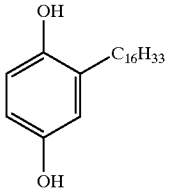
[334.54/11.00]
$B_9$-4
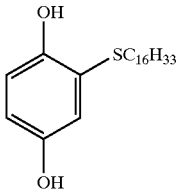
[366.61/7.33]
-continued
$B_9$-5
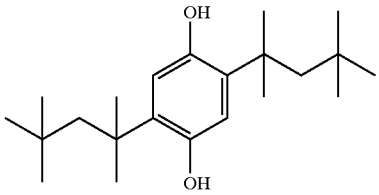
[334.54/11.00]
$B_9$-6
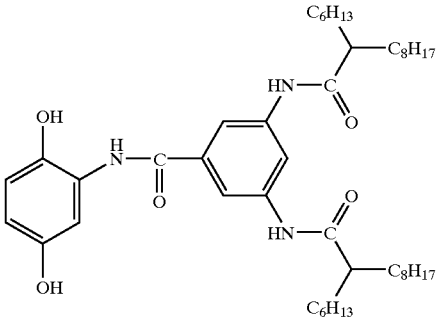
[736.09/5.63]
$B_9$-7
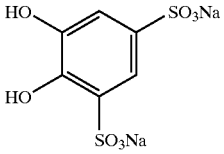
[270.24/0.60]
$B_9$-8
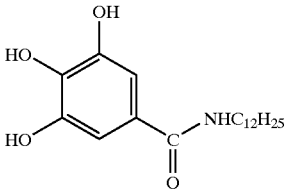
[337.46/3.80]
$B_9$-9
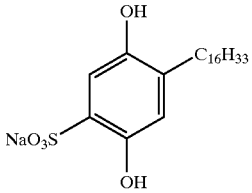
[414.61/3.67]
$B_9$-10
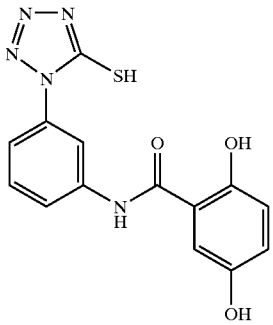
[329.34/1.56]

-continued
$B_9$-11
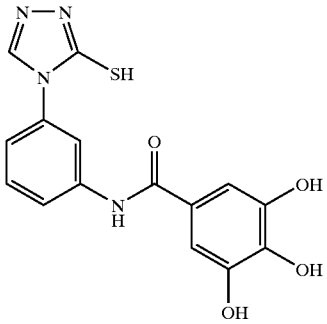
[344.35/1.67]
$B_9$-12
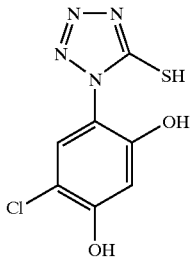
[244.66/0.88]
$B_9$-13
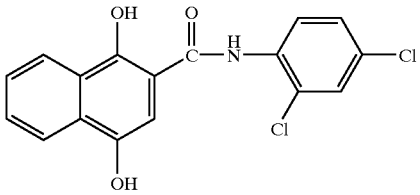
[348.18/2.83]
$B_9$-14
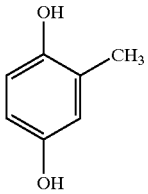
[124.14/3.50]
$B_{10}$-1
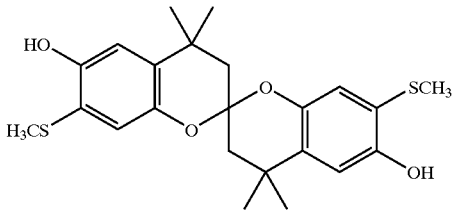
[432.60/3.83]
-continued
$B_{10}$-2
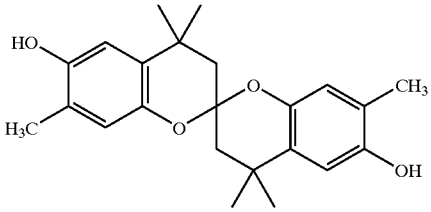
[368.47/5.75]
$B_{10}$-3
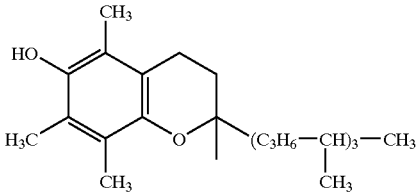
[418.70/14.00]
$B_{10}$-4
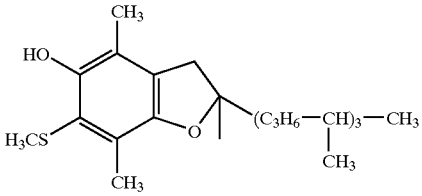
[448.75/9.33]
$B_{11}$-1
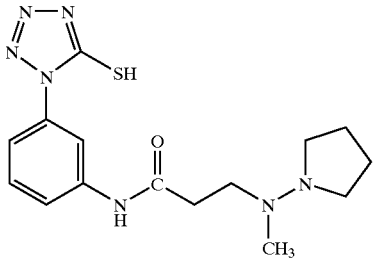
[347.44/1.67]
$B_{11}$-2
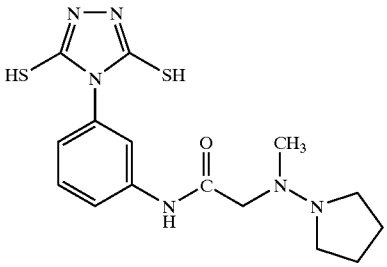
[364.50/1.67]
$B_{11}$-3
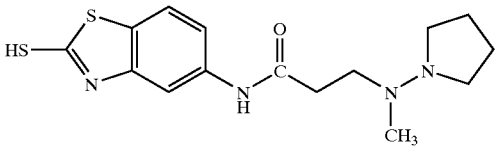
[336.48/2.14]

-continued
$B_{11}$-4
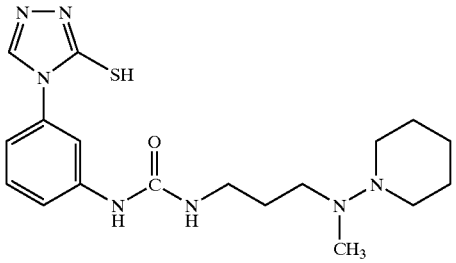
[389.52/2.00]
$B_{11}$-5
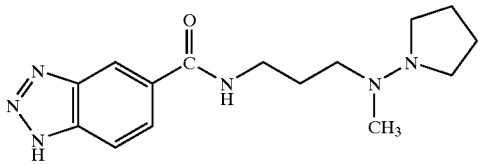
[302.38/2.14]
$B_{11}$-6
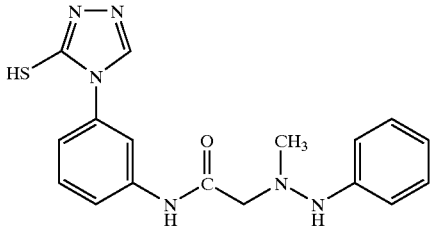
[354.44/2.13]
$B_{11}$-7
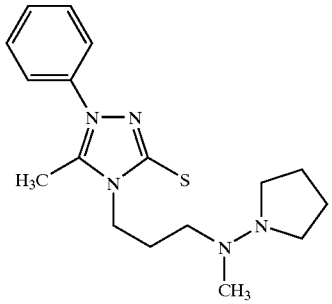
[331.49/2.83]
$B_{11}$-8
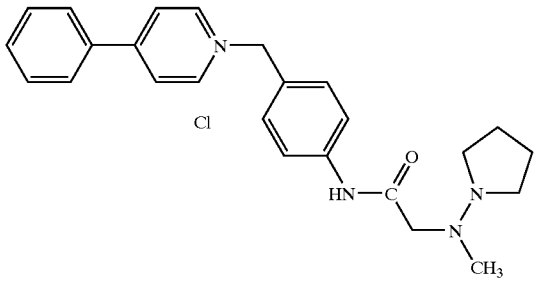
[436.98/4.17]
-continued
$B_{11}$-9
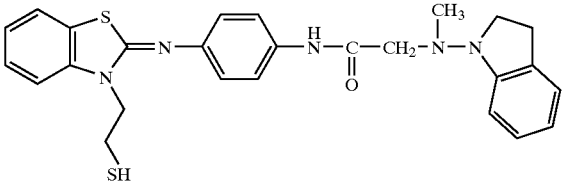
[489.67/3.25]
$B_{11}$-10
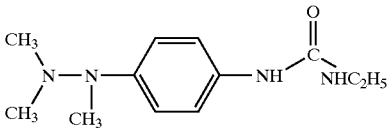
[252.38/2.40]
$B_{11}$-11
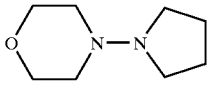
[156.23/2.67]
$B_{11}$-12
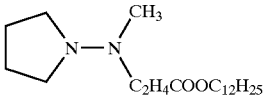
[340.55/5.00]
$B_{12}$-1
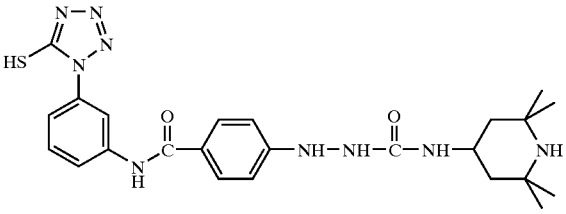
[509.64/2.00]
$B_{12}$-2
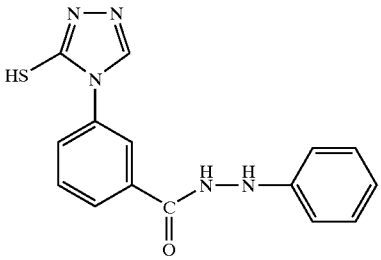
[311.37/2.14]
$B_{12}$-3
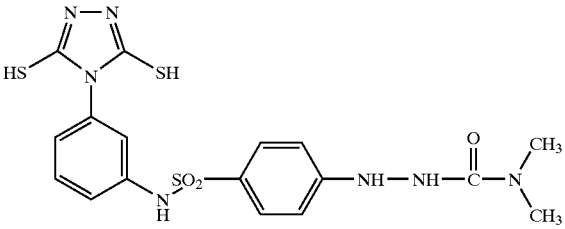
[465.58/1.31]

-continued
$B_{12}$-4
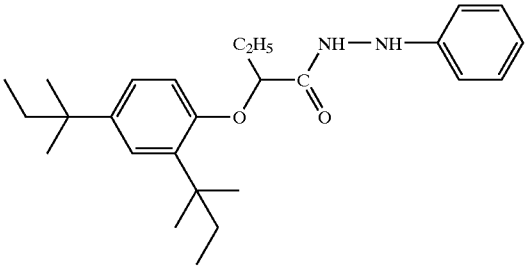
[410.6/6.50]
$B_{13}$-1
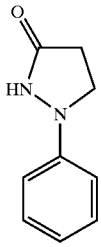
[162.19/3.00]
$B_{13}$-2
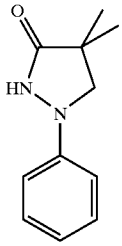
[190.25/3.67]
$B_{13}$-3
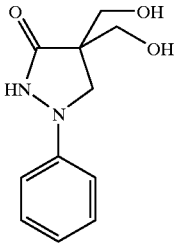
[222.24/2.20]
$B_{13}$-4
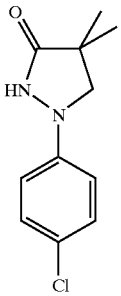
[224.69/2.75]
-continued
$B_{13}$-5
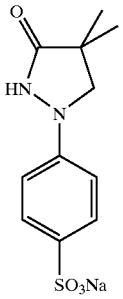
[269.30/1.57]
$B_{13}$-6
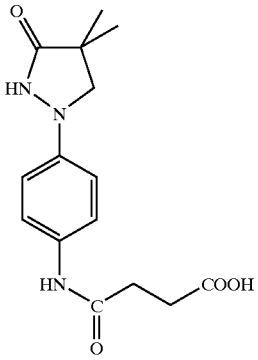
[305.33/2.14]
$B_{13}$-7
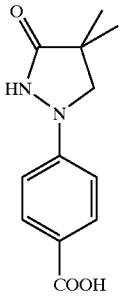
[234.25/2.40]
$B_{13}$-8
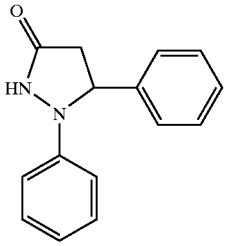
[237.28/5.00]

-continued $B_{13}$-9

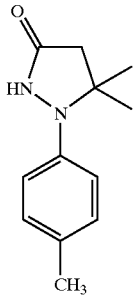

[204.27/4.00]

$B_{13}$-10

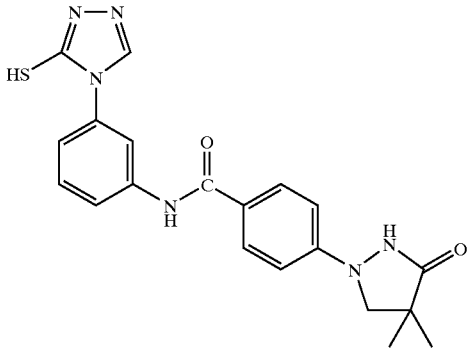

[408.48/2.22]

$B_{13}$-11

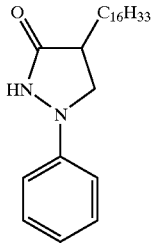

[385.61/8.33]

As other examples of the reducing compounds of the present invention, there can be mentioned compounds represented by the general formulae (II) to (VI), together with examples thereof, described in JP-A-2001-42466, the entire contents of which are incorporated herein by reference. Further, there can be mentioned compound examples described in the literature and patents cited therein.

In the present invention, although use is made of a compound selected from among reducing compounds having a C/H value of 3 or less and a compound selected from among reducing compounds having a C/H value of more than 3, it is also preferred to simultaneously use two or more compounds selected from among each of the reducing compound groups.

When two or more types selected from among the reducing compounds having a C/H value of 3 or less and/or the reducing compounds having a C/H value of more than 3 are employed, they may be added to the same layer or different layers. Also, different addition methods may be adopted.

Further, in the present invention, although use is made of a compound selected from reducing compounds having a molecular weight of 300 or less and a compound selected from reducing compounds having a molecular weight of more than 300, it is also preferred to simultaneously use two or more compounds selected from among each of the reducing compound groups.

When two or more types selected from the reducing compounds having a molecular weight of 300 or less and/or the reducing compounds having a molecular weight of more than 300 are employed, they may be added to the same layer, or different layers. Also, different addition methods may be adopted.

The reducing compound having a C/H value of 3 or less, that having a C/H value of more than 3, that having a molecular weight of 300 or less, and that having a molecular weight of more than 300, may be added to an emulsion or a silver halide photosensitive material by various methods in accordance with the property of respective compounds.

For example, the reducing compounds may be dissolved in water or a water soluble solvent, such as methanol or ethanol, or a mixed solvent therefrom before the addition. The pH value of the solution may be appropriately regulated with the use of an acid or a base, and further a surfactant may be incorporated therein.

Also, the reducing compounds may be dissolved in a soluble organic solvent, or dissolved in a high-boiling organic solvent into an emulsified dispersion, before the addition. Further, these reducing compounds may be added in the form of solid dispersion (microcrystal dispersion) formed by the use of known dispersing methods.

Those having an adsorptive group among the reducing compounds of the present invention are preferably added to silver halide emulsion layers. More preferably, the addition is performed at the time of emulsion preparation. When the addition is performed at the time of emulsion preparation, the addition may be carried out at any stage during the process. For example, the stage at which the addition is effected can be during the formation of silver halide grains, before the initiation of desalting, during desalting, before the initiation of chemical ripening, during chemical ripening, before the preparation of final emulsion, etc. Further, divided additions can be effected at each of these stages. Although the addition is preferably effected to emulsion layers, it is also practicable to effect the addition to not only an emulsion layer but also adjacent protective layer or interlayer so as to realize diffusion at the coating time.

The preferred addition amount thereof, although largely depending on the above addition method or added compound species, is generally in the range of $1\times10^{-8}$ to $5\times10^{-2}$ mol, preferably $1\times10^{-7}$ to $1\times10^{-3}$ mol per mol of lightsensitive silver halides.

Those not having any adsorptive group or ballasting group among the reducing compounds of the present invention can be added to not only silver halide emulsion layers but also other non-lightsensitive layers. Although the addition is preferably effected to emulsion layers, it is also practicable to effect the addition to not only an emulsion layer but also adjacent protective layer or interlayer so as to realize diffusion at the coating time. Although the addition can be effected at the time of emulsion preparation before chemical sensitization, during chemical sensitization or after the completion of chemical sensitization, it is preferred to effect the addition before the application of coating liquid or at the coating time.

The preferred addition amount thereof, although largely depending on the above addition method or added compound species, is generally in the range of $5\times10^{-6}$ to $5\times10^{-2}$ mol, preferably $1\times10^{-5}$ to $1\times10^{-3}$ mol per mol of lightsensitive silver halides.

Those having a ballasting group among the reducing compounds of the present invention can be added to not only silver halide emulsion layers but also other non-lightsensitive layers. Although the addition is preferably effected to emulsion layers, it is also practicable to effect the addition to not only an emulsion layer but also adjacent protective layer or interlayer so as to realize diffusion at the coating time. Although the addition may be effected at the time of emulsion preparation, it is preferred to effect the addition through emulsification dispersion.

The preferred addition amount thereof, although largely depending on the above addition method or added compound species, is generally in the range of $5\times10^{-5}$ to $5\times10^{-1}$ mol, preferably $1\times10^{-4}$ to $1\times10^{-1}$ mol per mol of lightsensitive silver halides.

Next, silver halide emulsions that may be used in the present invention will be described.

The silver halide grains for a photographic emulsion may have a regular crystal shape such as cube, octahedron, tetradecahedron, rhombododecahedron, or irregular crystal shape such as sphere or plate. In addition, the silver halide grains may have a face of a high order ((hkl) face), or may be a mixture of grains having these crystal shapes. Preferably the silver halide grains are tabular grains, which will be detailed below. With regard to the grains having a face of a high order reference can be made to Journal of Imaging Science, vol. 30 (1986), pp. 247–254.

The photosensitive material of the present invention preferably contains a lightsensitive silver halide emulsion containing tabular grains (silver halide grains each having two parallel main planes, hereinafter referred to as "tabular grains"). The silver halide grains will be described in detail below.

The aspect ratio of each silver halide grain of the present invention is defined as a value obtained by dividing an equivalent circle diameter of the two facing parallel main planes (a diameter of a circle having the same projected area as that of the main plane) of each grain by a distance between the main planes (that is, the thickness of the grain).

The aspect ratio of tabular grains is preferably 5 to 100. In order to attain the advantages of the present invention, the aspect ratio of the tabular grains is preferably 8 to 60, more preferably 10 to 30. When the average aspect ratios less than 2 or those greater than 100 are undesirable because if the average aspect ratio is less than 2, the merit of the tabular grains cannot be fully used and because if the average aspect ratio exceeds 100, the pressure resistance deteriorates. Further, as for the emulsion used in the present invention, the ratio occupied by the tabular grains is preferably 60% or more, more preferably 80% or more, and particularly preferably 90% or more of the total projected area of the emulsion. When the ratio occupied by tabular grains is less than 50%, the merits of tabular grains cannot be fully used, which is not preferable.

The average grain thickness in the present invention is an arithmetical average of the thickness of all the tabular grains. The average grain thickness of the tabular grains of the present invention is preferably 0.01 to 0.3 $\mu$m, more preferably 0.01 to 0.12 $\mu$m, and particularly preferably 0.01 to 0.07 $\mu$m. When the average grain thickness is less than 0.01 $\mu$m pressure resistance deteriorates, while when it exceeds 0.3 $\mu$m the advantages of the present invention is difficult to attain, which are not preferable.

In the present invention, the grain thickness and aspect ratio within the above mentioned ranges may be selected depending on purposes, but tabular grains having thin thickness and high aspect ratio are preferably used.

In the present invention, the diameter (equivalent circle diameter) of the tabular grains may be selected arbitrary, but is preferably 0.3 to 20 $\mu$m, and more preferably 0.5 to 10 $\mu$m. When the average equivalent circle diameter, which is an arithmetical average of the equivalent circle diameter of all the tabular grains, is less than 0.3 $\mu$m the advantages of the present invention is difficult to attain, while when it is more than 20 $\mu$m pressure resistance deteriorates, which are not preferable.

The grain diameter and the grain thickness can be obtained from an electron micrograph according to the method disclosed in U.S. Pat. No. 4,434,226. One Example of an aspect ratio measurement method comprises taking a transmission electron micrograph by a replica method and obtaining the diameter of a circle whose area is the same as the projected area of each grain (the equivalent circle diameter) and the thickness of each grain. In this method, the thickness can be calculated from the length of a shadow of replica.

It is preferable that the tabular grains used in the present invention be monodisperse. The variation coefficient of the grain diameter distribution of all the silver halide grains is preferably 35% or less, more preferably 25% or less, and particularly preferably 20% or less. When the variation coefficient exceeds 35%, it is not undesirable from the viewpoint of uniformity among grains. The variation coefficient of grain diameter distribution is a value obtained in such a manner that a distribution (standard deviation) of the equivalent sphere diameters of the silver halide grains is divided by the average equivalent sphere diameter and the resulting value is multiplied by 100. The grain size distribution of silver halide emulsion composed of silver halide grains of matched grain shape and of small grain size variation, show substantially normal distribution, thus the standard deviation can be easily obtained.

Preparation method of monodisperse tabular grains is described in the specification of JP-A-63-11928. That of monodisperse hexagonal tabular grains is described in the specification of JP-A-63-151618. That of circular monodisperse tabular grain emulsion is described in the specification of JP-A-1-131541. Further, an emulsion occupied by tabular grains having two twin planes that are parallel to a main plane in an amount of 95% or more and the size distribution of the tabular grains is monodisperse, is described in the specification of JP-A-2-838. A tabular grain emulsion prepared by using polyalkylene oxide block copolymer and having a variation coefficient of grain size of 10% or less, is described in the specification of EP 514742A1.

There are known the tabular grains whose main planes are (100) planes and the tabular grains whose main planes are (111) planes, to both of which the technique of the present invention can be applied. The tabular grains of the former type made of silver bromide are disclosed in the specification of U.S. Pat. No. 4,063,951 and JP-A-5-281640, while the tabular grains of the former type made of silver chloride are disclosed in the specifications of EP 5343955 A1 and U.S. Pat. No. 5,264,337. The tabular grains of the latter type can have various shapes wherein at least one above mentioned twin plane is present, and those of silver chloride are described in the specifications of U.S. Pat. Nos. 4,399,215, 4,983,508 and 5,183,732, and JP-A's-3-137632 and 3-116113.

As a method for forming the tabular grains, various methods can be used and, for example, the grain forming method disclosed in the specification of U.S. Pat. No. 5,494,789 can be used. In order to form tabular grains having a high aspect ratio, it is important to grow twin nuclei of small sizes. For this purpose, it is preferable to grow the nuclei at low temperature, high pBr and low pH, using a small amount of gelatin in a short time. As the kind of gelatin, gelatin with a low molecular weight, gelatin with a low methionine content, gelatin that has been phthalated, and the like are preferred.

After the formation of the nuclei, physical ripening is carried out to grow only tabular grain nuclei (parallel, multiple-layered twin nuclei) by eliminating other nuclei, i.e., nuclei of normal crystal habit, single-layered twin nuclei and non-parallel, multiple-layered twin nuclei, thereby causing the parallel, multiple-layered twin nuclei to remain selectively. Then, a soluble silver salt and a soluble halogen salt are added to the obtained nuclei to promote grain growth, and an emulsion comprising tabular grains is prepared.

It is also preferable to grow grains by supplying silver and halide through the addition of silver halide fine grains that have been prepared separately in advance or that are simultaneously prepared in another reaction vessel.

The tabular grains in the present invention may have a dislocation line. When tabular grains in the present invention have dislocation lines, the dislocation lines may be formed, for example, on the apex portion or fringe portion of grains or on the main plane of gains. As used herein, the fringe portion is the periphery of a tabular grain. More specifically, in the distribution of silver iodide from the edge to the center of a tabular grain, the fringe portion is a region outside a certain point at which the silver iodide content exceeds or becomes lower than the average silver iodide content of the whole grain for the first time when viewed from the edge.

When tabular grains have dislocation lines, the density of the dislocation lines is optional and any density may be selected, for example, 10 lines or more, 30 lines or more, 50 lines or more, per grain. The tabular grains used in the present invention may have a dislocation line inside the grain.

A technique of introducing, with control, dislocation in silver halide grains is described in JP-A-63-220238. It is demonstrated that tabular grain to which a dislocation line is introduced, compared with tabular grain having no dislocation line, can attain advantages such as improved photographic properties such as speed, reciprocity law, etc, an improvement in storability, an enhancement of latent image stability, a reduction of pressure mark, etc. According to the invention described in the publication, dislocation is introduced in the edge portion of tabular grain. Further, tabular grain to the central portion of which dislocation is introduced, is described in the specification of U.S. Pat. No. 5,238,796.

Dislocation lines in tabular grains can be observed by, for example, a direct method using a transmission electron microscope at low temperature described, for example, in J. F. Hamilton, Photo. Sci. Eng., 11, 57(1967) and T. Shiozawa, J. Soc. Photo. Sci. Japan, 35, 213 (1972). That is, silver halide grains, extracted carefully from an emulsion so as not to apply a pressure at which dislocations are produced in the grains, are placed on a mesh for electron microscopic observation. Observation is performed by a transmission method while the sample is cooled to prevent damage (e.g., print out) due to electron rays. In this case, the greater the thickness of a grain, the more difficult it becomes to transmit electron rays through it. Therefore, grains can be observed more clearly by using an electron microscope of high voltage type (200 kV or more for a grain having a thickness of 0.25 $\mu$m). From photographs of grains obtained by the above method, it is possible to obtain the positions and the number of dislocation lines in each grain viewed in a direction perpendicular to the main planes of the grain.

As the silver halide grains used in the present invention, silver bromide, silver chlorobromide, silver iodobromide, silver iodochloride, silver chloride, silver chloroiodobromide and the like can be used. It is preferable to use silver bromide, silver iodobromide, and silver chloroiodobromide.

It is also preferable, in respect of rapid processing property, to use silver chlorobromide, silver chloroiodide, silver chloroiodobromide, containing 50 mol % or more of silver chloride, or silver chloride, and having an aspect ratio of 2 or more. Although the upper limit of the silver chloride content is not specifically set, the silver chloride content is preferably 99.6% or less.

When the silver halide grains have a phase containing iodide or chloride, the phase may be uniformly distributed within the grain or they may be localized. Other silver salts, such as silver rhodanide, silver sulfide, silver selenide, silver carbonate, silver phosphate and silver salts of organic acids, may be contained as separate grains or as part of the silver halide grains.

The preferable range of silver iodide content in the tabular grains of the present invention is preferably 0.1 to 20 mol %, more preferably 0.1 to 15 mol %, and particularly preferably 0.2 to 10 mol %. A silver iodide content less than 0.1 mol % is undesirable because it is difficult to obtain the advantages of enhancing dye adsorption and increasing the intrinsic sensitivity. A silver iodide content exceeding 20 mol % is also undesirable because the developing speed generally lowers.

Although tabular grains containing 50 mol % or more of silver chloride and having an aspect ratio of 2 or more may contain silver iodide, its silver iodide content is preferably 6 mol % or less, more preferably 2 mol % or less.

The variation coefficient of distribution of silver iodide contents among grains of the tabular grains used in the present invention is preferably 30% or less, more preferably 25% or less, and particularly preferably 20% or less. If it exceeds 30%, it is not preferable from the viewpoint of uniformity among grains. The silver iodide content of individual tabular grain can be measured by analyzing the composition of the grain one by one with an X-ray microanalyzer. The coefficient of variation of distribution of silver iodide content used herein is a value obtained by dividing the standard deviation of the silver iodide content of individual grain by the average silver iodide content.

The tabular grains in the present invention may be epitaxial silver halide grains comprising host tabular grains having, on surfaces thereof, at least one kind of silver salt epitaxy.

In the present invention, a silver salt epitaxy may be formed in selected portions in the surface of a host tabular grain, and alternatively, may be formed restrictedly in corners and edges of the host tabular grain (that is, grain side faces and on the edge of each edge, respectively, when the grain is viewed from above).

In the case of forming a silver salt epitaxy, it is preferable to form the silver salt epitaxy in selected sites in the surfaces of host tabular grains uniformly in individual grain and between the grains. As a concrete site-direct method of a silver salt epitaxy, there are known a method, which is disclosed in U.S. Pat. No. 4,435,501, of causing host grains to adsorb a spectral sensitizing dye (for example, a cyanine dye) or an aminoazaindene (for example, adenine) before the formation of the silver salt epitaxy, a method of causing host grains to contain silver iodide, and the like. These methods may be employed. Further, it is also possible to add iodide ions before the formation of the silver salt epitaxy, thereby precipitating them on host grains. These site-directing methods may be chosen case by case and may be employed in combination of them.

In the case of forming a silver salt epitaxy, the ratio of the area occupied by the silver salt epitaxy with respect to the surface area of the host tabular grain on which the silver salt epitaxy is formed is preferably 1 to 50%, more preferably 2 to 40%, and particularly preferably 3 to 30%.

In the case of forming a silver salt epitaxy, the amount of silver in the silver salt epitaxy relative to the total amount of silver in the silver halide tabular grains is preferably 0.3 to 50 mol %, more preferably 0.3 to 25 mol %, and particularly preferably 0.5 to 15 mol %.

The composition of the silver salt epitaxy can be selected depending on a situation, and it may be silver halide containing any of a chloride ion, a bromide ion and an iodide ion. However, it is preferably a silver halide containing at least a chloride ion. Silver chloride easily forms an epitaxy because it forms a face-centered cubic lattice structure that is the same as silver bromide and silver iodobromide, which form host tabular grains. However, there is a difference between the lattice spaces formed of two kinds of silver halides, and therefore, this will cause the formation of an epitaxy junction which contributes the increase in photographic sensitivity.

The content of the silver chloride contained in a silver halide epitaxy is preferably greater than the content of the silver chloride contained in host tabular grains by at least 10 mol %, more preferably by at least 15 mol %, and particularly preferably by at least 20 mol %. A difference between the silver chloride contents of the epitaxy and the host of less than 10 mol % is undesirable because it makes the effect difficult to be obtained.

In the introduction of a halide ion to a silver halide epitaxy, it is preferable, for the purpose of increasing its introduction amount, to introduce a halide ion in the order depending on the composition of the epitaxy. For example, when forming an epitaxy in which a greater amount of silver chloride is contained in the inside portion, a greater amount of silver bromide is contained in the intermediate portion and a greater amount of silver iodide is contained in the outside portion, the addition of these halide ions is conducted in the order, a chloride ion, a bromide ion and then an iodide ion, thereby making the solubility of a silver halide containing the halide ion added smaller than the solubilities of the other silver halides to precipitate the silver halide, thereby forming a layer rich in the silver halide. Silver salts other than silver halides, such as silver rhodanide, silver sulfide, silver selenide, silver carbonate, silver phosphate and silver salts of organic acids, may be contained in a silver salt epitaxy.

Examples of a method for forming a silver salt epitaxy include a method of adding a halide ion, a method of adding an aqueous silver nitride solution and an aqueous halide solution by the double jet method, and a method of adding silver halide fine grains. These methods may be selected case by case and also may be used in combination. In the formation of a silver salt epitaxy, the temperature, pH and pAg of the system, the kind and concentration of a protective colloid such as gelatin, the presence, kind and concentration of a silver halide solvent, and the like may be selected widely.

In the case of an epitaxial silver halide grain, for maintaining the form of a host tabular grain or site-directing of a silver salt epitaxy to the edge/corner sites of the grain, it is preferable that the silver iodide content in the outside region, this being the portion that precipitates lastly and forming the edge/corner sites of the grain, of the host tabular grain is at least 1 mol % higher than the silver iodide content in the center region. At this time, the silver iodide content in the outside region is preferably 1 to 20 mol %, and more preferably 5 to 15 mol %. A content of less than 1 mol % is undesirable because the above-described effect cannot be obtained. A content exceeding 20 mol % is also undesirable because the development speed lowers. In this case, the ratio of the total silver amount in the outside region containing silver iodide relative to the total silver amount of the host tabular grains is preferably 10 to 30% and more preferably 10 to 25%. An mount less than 10% and an amount exceeding 30% are undesirable because the above-described effect cannot be obtained. At this time, the silver iodide content in the center region is preferably 0 to 10 mol %, more preferably 1 to 8 mol %, and particularly preferably 1 to 6 mol %. A content exceeding 10 mol % is undesirable because the development speed lowers.

An oxidizer capable of oxidizing silver is preferably used during the process of producing the emulsion for use in the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate.

The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate(II)) and thiosulfonates.

Examples of suitable organic oxidizers include quinones such as p-quinone, organic peroxides such as peracetic acid and perbenzoic acid and active halogen-releasing compounds (e.g., N-bromosuccinimide, chloramine T and chloramine B).

Oxidizers preferred in the present invention are inorganic oxidizers selected from among ozone, hydrogen peroxide and its adducts, halogen elements and thiosulfonates and organic oxidizers selected from quinones. A combined use of the reducing sensitizer with the oxidizer to silver is a preferable embodiment. A method of performing reduction sensitization after the oxidizer is used or a method of vice versa, or a method of making both compounds coexist simultaneously, may be selected and used. These methods may be selected and used in the grain formation step or chemical sensitization step.

It is advantageous to use gelatin as a protective colloid for use in preparation of emulsions of the invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; sugar derivatives, such as cellulose derivatives, e.g., cellulose sulfates, hydroxyethylcellulose, and carboxymethylcellulose, soda alginate, and starch derivatives; and a variety of synthetic hydrophilic high polymers, such as homopolymers or copolymers, e.g., polyvinyl alcohol, polyvinyl alcohol with partial acetal, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin described in Bull. Soc. Sci. Photo. Japan, 16, page 30 (1966). In addition, a hydrolyzed product or an enzyme-decomposed product of gelatin can also be used.

It is preferable to wash with water an emulsion of the present invention to desalt, and disperse into a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of the emulsion of the invention, it is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to modify the grain surface or used as a chemical sensitizer. The salt can be doped in any of an overall grain, only the core portion or the shell portion of a grain. Examples of the dopant are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi.

These metals can be added as long as they are in the form of salt that can be dissolved during grain formation, such as ammonium salt, acetate, nitrate, sulfate, phosphate, hydroxide, hexa-coordinated complex salt, or ttetra-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_4[Fe(CN)_6]$, $K_2IrCl_6$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

In the silver halide grains used in the invention, at least one of chalcogen sensitization including sulfur sensitization and selenium sensitization, and noble metal sensitization including gold sensitization and palladium sensitization, and reduction sensitization can be performed at any point during the process of preparing a silver halide emulsion. The use of two or more different sensitizing methods is preferable.

Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the present invention, the position of a chemical sensitization nucleus can be selected in accordance with the intended use. However, it is generally preferable to form at least one type of a chemical sensitization nucleus in the vicinity of the surface.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, the specifications of U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred.

In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and the above mentioned G. F. Duffin, Photographic Emulsion Chemistry, pages 138 to 143.

A preferable amount of a sulfur sensitizer used in the invention is $1\times10^{-4}$ to $1\times10^{-7}$ mol, and more preferably, $1\times10^{-5}$ to $5\times10^{-7}$ mol per mol of a silver halide. A preferable range of the palladium compound is $1\times10^{-3}$ to $5\times10^{-7}$ mol.

Preferable amount of sulfur sensitizer used in the present invention is $1\times10^{-4}$ to $1\times10^{-7}$ mol, and more preferably $1\times10^{-5}$ to $5\times10^{-7}$ mol per mol of silver halide.

As a preferable sensitizing method for the emulsion of the invention, selenium sensitization can be mentioned. As a selenium sensitize used in the invention, selenium compounds disclosed in hitherto published patents can be used as the selenium sensitizer in the present invention. In the use of labile selenium compound and/or nonlabile selenium compound, generally, it is added to an emulsion and the emulsion is agitated at high temperature, preferably 40° C. or above, for a given period of time. Compounds described in, for example, Jpn. Pat. Appln. KOKOKU Publication No. (hereinafter referred to as JP-B-) 44-15748, JP-B-43-13489, JP-A's-4-25832 and 4-109240 are preferably used as the unlabile selenium compound.

Specific examples of the labile selenium sensitizers include isoselenocyanates (for example, aliphatic isoselenocyanates such as allyl isoselenocyanate), selenoureas, selenoketones, selenoamides, selenocarboxylic acids (for example, 2-selenopropionic acid and 2-selenobutyric acid), selenoesters, diacyl selenides (for example, bis(3-chloro-2, 6-dimethoxybenzoyl)selenide), selenophosphates, phosphine selenides and colloidal metal selenium.

The labile selenium compounds, although preferred types thereof are as mentioned above, are not limited thereto. It is generally understood by persons of ordinary skill in the art to which the invention pertains that the structure of the labile selenium compound as a photographic emulsion sensitizer is not so important as long as the selenium is labile and that the labile selenium compound plays no other role than having its selenium carried by organic portions of selenium sensitizer molecules and causing it to present in labile form in the emulsion. In the present invention, the labile selenium compounds of this broad concept can be used advantageously.

Compounds described in JP-B's-46-4553, 52-34492 and 52-34491 can be used as the nonlabile selenium compound used in the present invention. Examples of the nonlabile selenium compounds include selenious acid, potassium selenocyanate, selenazoles, quaternary selenazole salts, diaryl selenides, diaryl diselenides, dialkyl selenides, dialkyl diselenides, 2-selenazolidinedione, 2-selenoxazolidinethione and derivatives thereof.

These selenium sensitizers are dissolved in water or in a single solvent or a mixture of organic solvents selected from methanol and ethanol and added at the time of chemical sensitization. Preferably, the addition is performed prior to the initiation of chemical sensitization. The use of the above selenium sensitizers is not limited to a single kind, but the combined use of two or more kinds may be acceptable. The combined use of a labile selenium compound and an unlabile selenium compound is preferred.

The addition amount of the selenium sensitizer for use in the invention, although varied depending on the activity of employed selenium sensitizer, the type and size of silver halide, the ripening temperature and time, etc., is preferably in the range of $1\times10^{-8}$ or more. More preferably, the amount is $1\times10^{-7}$ mol or more and $5\times10^{-5}$ mol or less per mol of silver halide. The temperature of chemical ripening in the use of a selenium sensitizer is preferably 40° C. or more and 80° C. or less. The pAg and pH are arbitrary. For example, with respect to pH, the effect of the present invention can be exerted even if it widely ranges from 4 to 9.

Selenium sensitization is preferably used in combination with sulfur sensitization or noble metal sensitization or both of them. Further, in the present invention, a thiocyanic acid salt is preferably added in the silver halide emulsion at the chemical sensitization. As the thiocyanate, potassium thiocyanate, sodium thiocyanate, ammonium thiocyanate, and the like are used. It is usually added by being dissolved in an aqueous solution or a water-soluble solvent. The addition amount per mol of silver halide is $1\times10^{-5}$ mol to $1\times10^{-2}$ mol, and more preferably $5\times10^{-5}$ mol to $5\times10^{-3}$ mol.

It is preferred that in the silver halide emulsion of the present invention, an appropriate amount of calcium ion and/or a magnesium ion be contained. Thereby, the grain shape is made better, the quality of an image is improved, and the preservation property is made better. The range of the appropriate amount is 400 to 2500 ppm for calcium and/or 50 to 2500 ppm for magnesium, and calcium is more preferably 500 to 2000 ppm and magnesium is 200 to 2000 ppm. Herein, 400 to 2500 ppm for calcium and/or 50 to 2500 ppm for magnesium means that at least one of calcium and magnesium is a concentration within the range prescribed. When the content of calcium or magnesium is higher than these values, it is not preferable that inorganic salts which calcium salt, magnesium salt, a gelatin or the like has preliminarily retained precipitate and become the cause of trouble at the manufacture of the photographic material. Herein, the content of calcium or magnesium is represented by weight converted to calcium atom or magnesium atom for all of the compounds containing calcium or magnesium such as a calcium ion, a magnesium ion, a calcium salt, a magnesium salt and the like, and represented by concentration based on the unit weight of the emulsion.

The adjustment of the calcium content in the silver halide tabular emulsion of the invention is preferably carried out adding the calcium salt at the chemical sensitization. The gelatin generally used at manufacturing an emulsion contains already calcium by 100 to 4000 ppm as a solid gelatin, and calcium may be adjusted by adding a calcium salt to the gelatin to be increased. Further, if necessary, after carrying out the desalting (removal of calcium) from the gelatin according to a known method such as a washing method with water or an ion exchange method or the like, the content can be also adjusted by a calcium salt. As the calcium salt, calcium nitrate and calcium chloride are preferable, and calcium nitrate is most preferable. Similarly, the adjustment of the magnesium content can be carried out adding a magnesium salt. As the magnesium salt, magnesium nitrate, magnesium sulfate and magnesium chloride are preferable, and magnesium nitrate is most preferable. As the quantitative determination method of calcium or magnesium, it can be determined by ICP emission spectral analysis method. Calcium and magnesium may be used alone and a mixture of both may be used. It is more preferable to contain calcium. The addition of calcium or magnesium can be carried out at the arbitrary period of the manufacturing steps of the silver halide emulsion, but is preferably from after the grain formation to just after completion of the spectral sensitization and the chemical sensitization, and more preferably after addition of a sensitizing dye. Further, it is preferable in particular to add after addition of a sensitizing dye and before carrying out the chemical sensitization.

Photographic emulsions used in the present invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt; nitroimidazoles; nitrobenzimidazoles; chlorobenzimidazoles; bromobenzimidazoles; mercaptothiazoles; mercaptobenzothiazoles; mercaptobenzimidazoles; mercaptothiadiazoles; aminotriazoles; benzotriazoles; nitrobenzotriazoles; and mercaptotetrazoles (particularly 1-phenyl-5-mercaptotetrazole); mercaptopyrimidines; mercaptotriazines; a thioketo compound such as oxazolinethione; azaindenes such as triazaindenes, tetrazaindenes (particularly 4-hydroxy-substituted(1,3,3a,7) tetrazaindenes), and pentazaindenes. For example, compounds described in the specifications of U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

The photographic emulsion for use in the present invention is preferably subjected to a spectral sensitization with a methine dye or the like to thereby exert the effects of the invention. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. These dyes may contain any of nuclei commonly used in cyanine dyes as basic heterocyclic nuclei. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have substituents on carbon atoms thereof.

The merocyanine dye or composite merocyanine dye may have a 5 or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus as a nucleus having a ketomethylene structure.

These spectral sensitizing dyes may be used either individually or in combination. The spectral sensitizing dyes are often used in combination for the purpose of attaining supersensitization. Representative examples thereof are described in the specifications of U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, and 3,837,862, 4,026,707, GB's 1,344,281 and 1,507,803, JP-B's-43-4936 and 53-12375, and JP-A's-52-110618 and 52-109925, the entire contents of which are incorporated herein by reference.

The emulsion used in the present invention may contain a dye which itself exerts no spectral sensitizing effect or a substance which absorbs substantially none of visible radiation and exhibits supersensitization, together with the above spectral sensitizing dye.

Further, the present invention is preferably used together with a technique of increasing light absorptivity by a spectrum sensitizing dye. For example, there is a method, by utilizing an intermolecular force, of causing more sensitizing dyes to adsorb to silver halide grain surfaces in comparison with those in a single-layer saturated absorption (that is, one-layer adsorption), or a method of adsorbing, to silver halide grains, a coupling dye having two or more chromophores which are not separately conjugated but coupled by a covalent bond. Among them, the present invention is preferably used together with the techniques disclosed in the following patent publications and specifications: JP-A's-10-239789, 11-133531, 2000-267216, 2000-275772, 2001-75222, 2001-75247, 2001-75221, 2001-75226, 2001-75223, 2001-255615, 2002-23294, 10-171058, 10-186559, 10-197980, 2000-81678, 2001-5132, 2001-166413, 2002-49113, 64-91134, 10-110107, 10-171058, 10-226758, 10-307358, 10-307359, 10-310715, 2000-231174, 2000-231172, 2000-231173, and 2001-356442, and E.P. Nos. 985965A, 985964A, 985966A, 985967A, 1085372A, 1085373A, 1172688A, 1199595A, and 887700A1, the entire contents of which are incorporated herein by reference.

In particular, the present invention is preferably used together with the following patent publications: JP-A's-10-239789, 2001-75222, and 10-171058.

The addition timing of the spectral sensitizing dye to the emulsion may be performed at any stage of the process for preparing the emulsion which is known as being useful. Although the doping is most usually conducted at a stage between the completion of the chemical sensitization and the coating, the spectral sensitizing dye can be added simultaneously with the chemical sensitizer to thereby simultaneously effect the spectral sensitization and the chemical sensitization as described in the specifications of U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above sensitizing dye can be divided prior to addition, that is, part of the sensitizing dye can be added prior to the chemical sensitization with the rest of the sensitizing dye added after the chemical sensitization as taught in the specification of U.S. Pat. No. 4,225,666. Still further, the spectral sensitizing dye can be added at any stage during the formation of silver halide grains according to the method disclosed in the specification of U.S. Pat. No. 4,183,756 and other methods.

The addition thereof may be set from $4\times10^{-6}$ to $8\times10^{-3}$ mol per mol of silver halide.

The silver halide color photosensitive material of the present invention is only required to have at least one light-sensitive layer on a support. Preferably, the silver halide photosensitive material is provided with at least one of a blue-sensitive layer, green-sensitive layer and red-sensitive layer on a support, and the number and order of the lightsensitive layer and non-lightsensitive layer are not particularly limited. Typical Example thereof is a silver halide photosensitive material having at least one light-sensitive unit layer comprising a plural of silver halide emulsion layers each having the substantially the same color sensitivity but different in speed. The light-sensitive unit layer is a unit layer having color sensitivity to any one of blue light, green light and red light. In a multi-layered silver halide color photosensitive material, the arrangement of the unit layer is generally, in the order, from a support, of a red-sensitive layer, green-sensitive layer and blue-sensitive layer. However, the arrangement order may be reversed depending on the purpose of the photographic material. And such an arrangement order that a light-sensitive layer having a different color sensitivity is sandwiched between layers having the same color sensitivity, may be acceptable.

A non-lightsensitive layer can be formed between the silver halide lightsensitive layers and as the uppermost layer and the lowermost layer.

These intermediate layers may contain, e.g., couplers and DIR compounds described in JP-A's-61-43748, 59-113438, 59-113440, 61-20037 and 61-20038, and may contain color-mixing inhibitors as usually do so.

As for a plurality of silver halide emulsion layers constituting respective unit lightsensitive layer, a two-layered structure of high- and low-speed emulsion layers can be preferably used in this order so as to the speed becomes lower toward the support as described in the specification of DE (German Patent) 1,121,470 or GB 923,045, the entire contents of which are incorporated herein by reference. Usually, preferable order is such that the speed is gradually lowered toward the support. Further, a non-lightsensitive layer may be provided between respective silver halide emulsion layers. Also, as described in JP-A's-57-112751, 62-200350, 62-206541 and 62-206543, the entire contents of which are incorporated herein by reference, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the entire contents of which are incorporated herein by reference, layers can be arranged from the farthest side from a support in the order of blue-sensitive layer/GH/RH/GL/RL. Furthermore, as described in JP-A's-56-25738 and 62-63936, the entire contents of which are incorporated herein by reference, layers can be arranged from the farthest side from a support in the order of blue-sensitive layer/GL/RL/GH/RH.

As described in JP-B-49-15495, the entire contents of which are incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the entire contents of which are incorporated herein by reference.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

In order to improve the color reproducibility, a donor layer (CL) of an interlayer effect having a spectral sensitivity distribution different from the main lightsensitive layers BL, GL and RL as described in the specifications of U.S. Pat. Nos. 4,663,271, 4,705,744 and 4,707,436 and JP-A's-62-160448 and 63-89850, the entire contents of which are incorporated herein by reference, is preferably arranged adjacent to or close to the main lightsensitive layers.

In the silver halide color photosensitive material of the present invention, various additives can be used in conformity with the object thereof.

These additives are described in detail in Research Disclosure Item 17643 (December 1978), Item 18716 (November 1979) and Item 308119 (December 1989), all the contents of which are incorporated herein by reference. A summary of the locations where they are described will be listed in the following table.

| Types of additives | RD17643 | RD18716 | RD308119 |
|---|---|---|---|
| 1 Chemical sensitizers | page 23 | page 648 right column | page 996 |
| 2 Sensitivity increasing agents | | page 648 right column | |
| 3 Spectral sensitizers, super-sensitizers | pages 23–24 | page 648, right column to page 649, right column | page 996, right column to page 998, right column |
| 4 Brighteners | page 24 | | page 998 right column |
| 5 Antifoggants, stabilizers | pages 24–25 | page 649 right column | page 998, right column to page 1000, right column |
| 6 Light absorbents, filter dyes, ultraviolet absorbents | pages 25–26 | page 649, right column to page 650, left column | page 1003, left column to page 1003, right column |
| 7 Stain preventing agents | page 25, right column | page 650, left to right columns | page 1002, right column |
| 8 Dye image stabilizers | page 25 | | page 1002, right column |
| 9 Film hardeners | page 26 | page 651, left column | page 1004, right column page 1005, left column |
| 10 Binders | page 26 | page 651, left column | page 1003, right column to page 1004, right column |
| 11 Plasticizers, lubricants | page 27 | page 650, right column | page 1006, left to right columns |
| 12 Coating aids, surfactants | pages 26–27 | page 650, right column | page 1005, left column to page 1006, left column |

-continued

| Types of additives | RD17643 | RD18716 | RD308119 |
|---|---|---|---|
| 13 Antistatic agents | page 27 | page 650, right column | page 1006, right column to page 1007, left column |
| 14 Matting agents | | | page 1008, left column to page 1009, left column |

In order to inhibit deterioration in photographic properties due to formaldehyde gas, a compound capable of reacting with and solidifying formaldehyde as disclosed in U.S. Pat. Nos. 4,411,987 and 4,435,503 can be incorporated in the light-sensitive material.

Various color couples may be used in the present invention, and the specific examples thereof are described in the patents described in the patents described in the aforementioned Research Disclosure No. 17643, VII-C to G and No. 307105, VII-C to G.

Preferred yellow couplers are those described in, for example, specifications of U.S. Pat. Nos. 3,933,051, 4,022,620, 4,326,024, 4,401,752 and 4,248,961, JP-B-58-10739, GB's 1,425,020 and 1,476,760, U.S. Pat. Nos. 3,973,968, 4,314,023 and 4,511,649, and EP 249,473A.

Particularly preferred magenta couplers are 5-pyrazolone and pyrazoloazole compounds. Particularly preferred are those described in the specifications of U.S. Pat. Nos. 4,310,619 and 4,351,897, EP 73,636, U.S. Pat. Nos. 3,061,432 and 3,725,067, Research Disclosure No. 24220 (June, 1984), JP-A-60-33552, Research Disclosure No. 24230 (June, 1984), JP-A's-60-43659, 61-72238, 60-35730, 55-118034 and 60-185951, U.S. Pat. Nos. 4,500,630, 4,540,654 and 4,556,630, and International Publication No. WO 88/04795.

The cyan couplers usable in the present invention are phenolic and naphtholic couplers. Particularly preferred are those described in the specifications of U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Published Application No. 3,329,729, EP's 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658.

Typical examples of the polymerized color-forming couplers are described in, for example, the specifications of U.S. Pat. Nos. 3,451,820, 4,080,211, 4,367,282, 4,409,320 and 4,576,910, GB 2,102,137 and EP 341,188A.

The couplers capable of forming a colored dye having a suitable diffusibility are preferably those described in the specifications of U.S. Pat. No. 4,366,237, GB 2,125,570, EP 96,570 and West German Patent (Publication) No. 3,234,533.

Colored couplers used for compensation for unnecessary absorption of the colored dye are preferably those described in Research Disclosure No. 17643, VII-G and No. 307105, VII-G, and the specifications of U.S. Pat. No. 4,163,670, JP-B-57-39413, U.S. Pat. Nos. 4,004,929 and 4,138,258 and GB 1,146,368. Other couplers preferably used herein include couplers capable of compensating for an unnecessary absorption of the colored dye with a fluorescent dye released during the coupling as described in U.S. Pat. No. 4,774,181 and couplers having, as a removable group, a dye precursor group capable of forming a dye by reacting with a developing agent as described in the specification of U.S. Pat. No. 4,777,120.

Further, compounds that release a photographically useful residue during a coupling reaction are also preferably usable in the present invention. DIR couplers which release a development inhibitor are preferably those described in the patents shown in the above described RD 17643, VII-F and No. 307105, VII-F as well as those described in JP-A's-57-151944, 57-154234, 60-184248, 63-37346 and 63-37350 and U.S. Pat. Nos. 4,248,962 and 4,782,012.

The couplers which release a nucleating agent or a development accelerator in the image-form in the development step are preferably those described in GB's 2,097,140 and 2,131,188 and JP-A's-59-157638 and 59-170840. Further, compounds capable of releasing a fogging agent, development accelerator, solvent for silver halides, etc. upon the oxidation-reduction reaction with an oxidized developing agent as described in JP-A's-60-107029, 60-252340, 1-44940 and 1-45687 are also preferred.

Other compounds usable for the photosensitive material according to the present invention include competing couplers described in U.S. Pat. No. 4,130,427, polyequivalent couplers described in U.S. Pat. Nos. 4,283,472, 4,338,393 and 4,310,618, DIR redox compound-releasing couplers, DIR coupler-releasing couplers, DIR coupler-releasing redox compounds and DIR redox-releasing redox compounds described in JP-A's-60-185950 and 62-24252, couplers which release a dye that restores the color after coupling-off as described in EP's 173,302 A and 313,308 A, ligand-releasing couplers described in U.S. Pat. No. 4,555,477, leuco dye-releasing couplers described in JP-A-63-75747 and fluorescent dye-releasing couplers described in U.S. Pat. No. 4,774,181.

The couplers used in the present invention can be incorporated into the photosensitive material by various known dispersion methods.

High-boiling solvents used for an oil-in-water dispersion method are described in, for example, U.S. Pat. No. 2,322,027.

The high-boiling organic solvents having a boiling point under atmospheric pressure of at least 175° C. and usable in the oil-in-water dispersion method include, for example, phthalates (such as dibutyl phthalate, dicyclohexyl phthalate, di-2-ethylhexyl phthalate, decylphthalate, bis(2,4-di-t-amylphenyl)phthalate, bis(2,4-di-t-amylphenyl) isophthalate and bis(1,1-diethylpropyl)phthalate); phosphates and phosphonates (such as triphenyl phosphate, tricresyl phosphate, 2-ethylhexyldihenyl phosphate, tricyclohexyl phosphate, tri-2-ethylhexyl phosphate, tridodecyl phoshate, tributoxyethyl phosphate, trichloropropyl phosphate and di-2-ethylhexylphenyl phosphate); benzoates (such as 2-ethylhexyl benzoate, dodecyl benzoate and 2-ethylhexyl-p-hydroxybenzoate); amides (such as N,N-diethyldodecaneamide, N,N-diethyllaurylamide and N-tetradecylpyrrolidone); alcohols and phenols (such as isostearyl alcohol and 2,4-di-tert-amylphenol); aliphatic carboxylates (such as bis(2-ethylhexyl)sebacate, dioctyl azelate, glycerol tributyrate, isostearyl lactate and trioctyl citrate); aniline derivatives (such as N,N-dibutyl-2-butoxy-5-tert-octylaniline) and hydrocarbons (such as paraffin, dodecylbenzene and diisopropylnaphthalene).

Co-solvents usable in the present invention include, for example, organic solvents having a boiling point of at least about 30° C., preferably 50 to about 160° C. Typical examples of them include ethyl acetate, butyl acetate, ethyl propionate, methyl ethyl ketone, cyclohexanone, 2-ethoxyethyl acetate and dimethylformamide.

The steps and effects of the latex dispersion method and examples of the lates usable for the impregnation are described in, for example, U.S. Pat. No. 4,199,363 and West German Patent Application (OLS) Nos. 2,541,274 and 2,541,230.

The color photosensitive material of the present invention preferably contains phenethyl alcohol or an antiseptic or mold-proofing agent described in JP-A's-63-257747, 62-272248 and 1-80941 such as 1,2-benzoisothiazolin-3-one, n-butyl p-hydroxybenzoate, phenol, 4-chloro-3,5-dimethylphenol, 2-phenoxyethanol or 2-(4-thiazolyl) benzimidazole.

The present invention is applicable to various color photosensitive materials such as ordinary color negative films, cinema color negative films, reversal color films for slides or televisions, color papers, positive color films and reversal color papers. The present invention may be particularly preferably used as color dupe films.

Suitable supports usable in the present invention are described, for example, on page 28 of the above-described RD. No. 17643, from right column, page 647 to left column, page 648 of RD. No. 18716 and on page 879 of RD. No. 307105.

In the photosensitive material of the present invention, hydrophilic colloid layers (called "back layers") having a total dried film thickness of 2 to 20 $\mu$m are preferably formed on the side opposite to the side having emulsion layers. The back layers preferably contain the above light absorbent, filter dye, ultraviolet absorbent, antistatic agent, film hardener, binder, plasticizer, lubricant, coating aid and surfactant. The swelling ratio of the back layers is preferably 150% to 500%.

The photosensitive material of the present invention can be developed by conventional methods described in RD. No. 17643, pages 28 and 29; RD. No. 18716, page 651, left to right columns; and RD No. 307105, pages 880 and 881.

A photographic emulsion layer is generally bleaching processed after being color development processed. A bleaching process and a fixing process may be carried out at the same time (bleach-fixing process) or may be performed separately. A processing method comprising carrying out a bleach-fixing process after a bleaching process can be adopted for further rapid processing. Also, processing in two successive bleach-fixing baths, fixing process before bleach-fixing process, or bleaching process after bleach-fixing process may optionally be selected according to purposes. Compounds of polyvalent metals such as iron(III), peracids, quinones, and nitro compounds are used as a bleaching agent. Representative examples of bleaching agents which are preferably used in the present invention include a complex salt such as organic complex salts of iron(III) with aminopolycarboxylic acids, e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid or malic acid. The use of aminopolycarboxylic acid iron(III) complex salts such as ethylenediaminetetraacetic acid iron(III) complex salts and 1,3-diaminopropanetetraacetic acid iron(III) complex salts is particularly preferred of them from the point of providing rapid processing and preventing environmental pollution. Further, aminopolycarboxylic acid iron(III) complex salts are particularly useful in both of a bleaching solution and a bleach-fixing solution. The pH of the bleaching solution or the bleach-fixing solution in which these aminopolycarboxylic acid iron(III) complex salts are included is generally from 4.0 to 8, but lower pH can be used to speed up the processing.

Bleaching accelerators can be used, if necessary, in the bleaching solution, the bleach-fixing solution, or the prebaths thereof. Specific examples of useful bleaching accelerators are disclosed in the following specifications: the compounds which have a mercapto group or a disulfido group disclosed in U.S. Pat. No. 3,893,858, German Patents 1,290,812, 2,059,988, JP-A's-53-32736, 53-57831, 53-37418, 53-72623, 53-95630, 53-95631, 53-104232, 53-124424, 53-141623, and 53-28426, and RD, No. 17129 (July, 1978); the thiazolidine derivatives disclosed in JP-A-50-140129; the thiourea derivatives disclosed in JP-B-45-8506, JP-A-52-20832, JP-A-53-32735, and U.S. Pat. No. 3,706,561; the iodides disclosed in German Patent 1,127,715 and JP-A-58-16235; the polyoxyethylene compounds disclosed in German Patents 966,410 and 2,748,430; the polyamine compounds disclosed in JP-B-45-8836; the other compounds disclosed in JP-A's-49-40943, 49-59644, 53-94927, 54-35727, 55-26506 and 58-163940; and bromide ions. The compounds which have a mercapto group or a disulfido group are preferred from the point of providing large accelerating effect, and those disclosed in U.S. Pat. No. 3,893,858, German Patent 1,290,812 and JP-A-53-95630 are particularly preferred of all. Further, the compounds disclosed in U.S. Pat. No. 4,552,834 are also preferred. These bleaching accelerators can be included in photographic materials. These bleaching accelerators are especially effective when bleach-fixing color photographic materials for photographing.

It is preferred to include organic acids in a bleaching solution and a bleach-fixing solution, in addition to the above compounds, for inhibiting bleaching stain. Particularly preferred organic acids are compounds having an acid dissociation constant (pKa) of from 2 to 5, specifically, acetic acid, propionic acid, and hydroxyacetic acid are preferred.

Thiosulfate, thiocyanate, thioether based compounds, thioureas, and a large amount of iodide can be used as the fixing agent which is used in a fixing solution and a bleach-fixing solution, but thiosulfate is generally used, in particular, ammonium thiosulfate can be most widely used. Further, the combined use of thiosulfate with thiocyanate, thioether based compounds and/or thiourea is also preferred. As preservatives for a fixing solution and a bleach-fixing solution, sulfite, bisulfite, carbonyl-bisulfite addition products or the sulfinic acid compounds disclosed in EP 294769A are preferred. Moreover, aminopolycarboxylic acids and organic phosphonic acids are preferably added to a fixing solution and a bleach-fixing solution for stabilizing the solutions.

In the present invention, compounds having a pKa of from 6.0 to 9.0 are preferably added to a fixing solution or a bleach-fixing solution for controlling pH, preferably imidazoles such as imidazole, 1-methylimidazole, 1-ethylimidazole and 2-methylimidazole, in an amount of from 0.1 to 10 mol per liter.

The total processing time of the desilvering process is preferably shorter in the range not generating a desilvering failure. The desilvering processing time is preferably from 1 minute to 3 minutes and more preferably from 1 minute to 2 minutes. Further, the processing temperature is generally from 25° C. to 50° C., and preferably from 35° C. to 45° C. In the preferred temperature range, the desilvering rate is increased and the occurrence of staining after processing is effectively prevented.

The color photosensitive material of the present invention may be built in (incorporated) a color-developing agent, for the purpose of simplification of the processing and advances in processing speed. For building in, various kinds of precursors of the color developing agent are preferably used. Examples of the precursor include indoaniline-series compounds described in U.S. Pat. No. 3,342,597; Schiff base type compounds described in U.S. Pat. No. 3,342,599, R.D. No. 14850 and ibid. No. 15159; aldol compounds described in R.D. No. 13924; metal complex salts described in U.S. Pat. No. 3,719,492; and urethane-series compounds described in JP-A-53-135628.

The color photosensitive material of the present invention may be built in various kinds of 1-phenyl-3-pyrazolidones in order to accelerate color development, as occasion demands. Typical are described in JP-A's-56-64339, 57-144547, and 58-115438.

The silver halide photosensitive material of the present invention may be applied to heat development photosensitive material described in the specifications of U.S. Pat. No. 4,500,626, JP-A's-60-133449, 59-218443 and 61-238056, and EP 210,660A2.

The photosensitive material of the present invention described above can more easily express the advantages when it is used for lens-equipped film units disclosed in JP-B-2-32615 and Jpn. U.M. Appln. KOKOKU Pub. No. 3-39784.

EXAMPLE

The present invention will be described in greater detail below with reference to the following Examples, which, however, in no way limit the scope of the present invention.

Example 1

The reconciliation of high photographic speed and low fog by the combined use of compounds of types (1) to (5) and compounds represented by the general formulae ($B_1$) to ($B_{13}$) according to the present invention will be described below.

(Preparation of Seed Emulsion A)

1,164 mL of an aqueous solution containing 0.017 g of KBr and 0.4 g of oxidized gelatin with an average molecular weight of 20,000 was agitated while maintaining the temperature of the solution at 35° C. (preparation of the 1st solution). An aqueous solution of $AgNO_3$ (1.6 g), an aqueous solution of KBr and an aqueous solution of oxidized gelatin with an average molecular weight of 20,000 (2.1 g) were added by the triple jet method over a period of 48 sec (addition 1). During this period, the silver potential was maintained at 13 mV against saturated calomel electrode. An aqueous solution of KBr was added so as to adjust the silver potential to −66 mV, and the temperature of the mixture was raised to 60° C. 21 g of gelatin succinate with an average molecular weight of 100,000 was added, and an aqueous solution of NaCl (5.1 g) was added. An aqueous solution of $AgNO_3$ (206.3 g) and an aqueous solution of KBr were added by the double jet method over a period of 61 min while increasing the flow rate (addition 2). During this period, the silver potential was maintained at −44 mV against saturated calomel electrode. Desalting was performed, and gelatin succinate with an average molecular weight of 100,000 was added so as to adjust the pH and pAg at 40° C. to 5.8 and 8.8, respectively. Thus, a seed emulsion a was obtained. This seed emulsion a contained 1 mol of Ag and 80 g of gelatin per kg of emulsion, and was comprised of tabular grains, 65% or more of which were those having an average equivalent circle diameter of 1.81 μm, a variation coefficient of equivalent circle diameter of 28%, an average thickness of 0.046 μm, an average aspect ratio of 39 and a twin plane spacing of 0.016 μm or less.

(Formation of Core)

1,200 mL of an aqueous solution containing 134 g of the thus obtained seed emulsion a, 1.9 g of KBr and 22 g of gelatin succinate with an average molecular weight of 100,000 was agitated while maintaining the temperature of the solution at 75° C. An aqueous solution of $AgNO_3$ (43.9 g), an aqueous solution of KBr and an aqueous solution of gelatin with a molecular weight of 20,000 were mixed together in a separate chamber equipped with magnetic coupling induction type agitator as described in JP-A-10-43570, and immediately thereafter added to the 75° C. solution over a period of 25 min. During this period, the silver potential was maintained at −40 mV against saturated calomel electrode.

(Formation of 1st Shell)

After the above formation of core grains, an aqueous solution of $AgNO_3$ (43.9 g), an aqueous solution of KBr and an aqueous solution of gelatin with a molecular weight of 20,000 were mixed together in the above separate chamber, and immediately thereafter added to the core grain mixture over a period of 20 min. During this period, the silver potential was maintained at −40 mV against saturated calomel electrode.

(Formation of 2nd Shell)

After the above formation of 1st shell, an aqueous solution of $AgNO_3$ (42.6 g), an aqueous solution of KBr and an aqueous solution of gelatin with a molecular weight of 20,000 were mixed together in the above separate chamber, and immediately thereafter added to the core grain mixture after the 1st shell formation over a period of 17 min. During this period, the silver potential was maintained at −20 mV against saturated calomel electrode. Thereafter, the temperature of the mixture was lowered to 55° C.

(Formation of 3rd Shell)

After the above formation of 2nd shell, the silver potential was adjusted to −55 mV, and an aqueous solution of $AgNO_3$ (7.1 g), an aqueous solution of KI (6.9 g) and an aqueous solution of gelatin with a molecular weight of 20,000 were mixed together in the above separate chamber, and immediately thereafter added to the core grain mixture after the 2nd shell formation over a period of 5 min.

(Formation of 4th Shell)

After the above formation of 3rd shell, an aqueous solution of $AgNO_3$ (66.4 g) and an aqueous solution of KBr were added to the core grain mixture after the 3rd shell formation at fixed flow rates by the double jet method over a period of 30 min. In the middle of the addition, potassium iridium hexachloride and yellow prussiate of potash were added thereto. During the double jet addition, the silver potential was maintained at 30 mV against saturated calomel electrode. Customary washing was conducted, and gelatin was added so as to adjust the pH and pAg at 40° C. to 5.8 and 8.8, respectively. This emulsion was designated emulsion A. The emulsion A was comprised of tabular grains having an average equivalent circle diameter of 4.1 μm, a variation coefficient of equivalent circle diameter of 21%, an average thickness of 0.090 μm and an average aspect ratio of 46. 70% or more of the total projected area thereof was occupied by tabular grains having an equivalent circle diameter of 4.1 μm or more and a thickness of 0.090 μm or less.

The emulsion A was heated to 60° C., and the following sensitizing dyes 11 and 12 were added thereto. Thereafter, potassium thiocyanate, chloroauric acid, sodium thiosulfate and N,N-dimethylselenourea were added to the emulsion to thereby effect optimum chemical sensitization. At the completion of chemical sensitization, compounds 13 and 14 were added thereto. Herein, the optimum chemical sensitization refers to adding sensitizing dyes and compounds in an amount selected within the range of $10^{-1}$ to $10^{-8}$ mol per mol of silver halides. The resultant emulsion was designated emulsion A-1.

Sensitizing dye 11

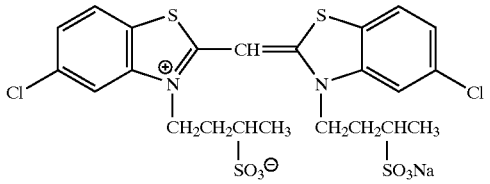

Sensitizing dye 12

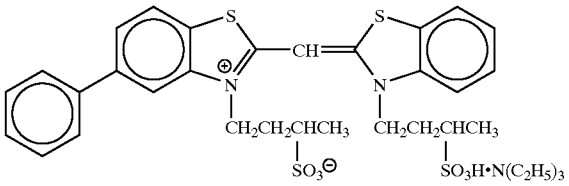

Compound 13

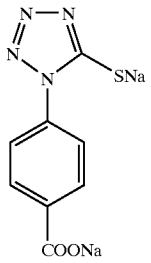

-continued

Compound 14

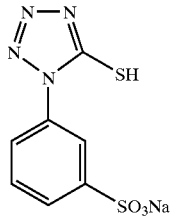

(Preparation of Emulsions A-2 to A-5)

Emulsions A-2 to A-5 were produced in the same manner as the emulsion A-1 except that after the completion of chemical sensitization, after the completion of chemical sensitization, compounds 13 and 14 were added and then compound examples 11, 23, 24 and 56 being compounds which would undergo a one-electron oxidation so as to form one-electron oxidation products capable of releasing one or more electrons according to the present invention, were added as shown in Table 1 in an amount of $8\times10^{-6}$ mol per mol of silver contained in the emulsions.

(Preparation of Emulsions A-6 to A-20)

Emulsions A-6 to A-20 were produced by adding compound examples $B_1$-1 and $B_{11}$-11 being reducing compounds having a C/H value of 3 or less and/or having a molecular weight of 300 or less according to the present invention to the previously prepared emulsions A-1 to A-5 in amounts, based on the silver quantity of the emulsions, as set forth in Table 1.

(Preparation of Coating Samples 101 to 137)

Samples 101 to 137 were prepared by coating each of the above chemically sensitized emulsions A-1 to A-20 to a cellulose triacetate film support provided with a subbing layer together with a protective layer under the coating conditions of Table 2 (listed in Table 1 with respect to the addition of compound Example $B_2$-2 being a reducing compound having a C/H value of more than 3 and/or having a molecular weight of more than 300 according to the present invention).

TABLE 1

| Sample | Emulsion | Sensitivity-increasing compound (Addition amount) | Reducing compound of C/H ≦ 3.0 and/or M.W. ≦ 300 (Addition amount) | Reducing compound of C/H > 3.0 and/or M.W. > 300 (Addition amount) | Fresh photographic property Dmin | Fresh photographic property Relative speed | Raw stock storability Dmin | Raw stock storability Relative speed | Remarks |
|---|---|---|---|---|---|---|---|---|---|
| 101 | A-1 | none | none | none | 0.23 | 100 (control) | 0.28 | 96 | Comp. |
| 102 | A-2 | Compound example 24 ($8\times10^{-6}$/Ag) | none | none | 0.37 | 123 | 0.48 | 115 | Comp. |
| 103 | A-3 | Compound example 23 ($8\times10^{-6}$/Ag) | none | none | 0.32 | 128 | 0.43 | 112 | Comp. |
| 104 | A-4 | Compound example 11 ($8\times10^{-6}$/Ag) | none | none | 0.33 | 135 | 0.45 | 119 | Comp. |
| 105 | A-5 | Compound example 56 ($8\times10^{-6}$/Ag) | none | none | 0.35 | 140 | 0.47 | 120 | Comp. |
| 106 | A-6 | none | $B_1^{-1}$ ($1\times10^{-3}$ mol/Ag) | none | 0.22 | 99 | 0.25 | 98 | Comp. |
| 107 | A-7 | Compound example 24 ($8\times10^{-6}$/Ag) | $B_1^{-1}$ ($1\times10^{-3}$ mol/Ag) | none | 0.32 | 125 | 0.43 | 120 | Comp. |
| 108 | A-8 | Compound example 24 ($8\times10^{-6}$/Ag) | $B_1^{-1}$ ($5\times10^{-3}$ mol/Ag) | none | 0.28 | 110 | 0.36 | 107 | Comp. |
| 109 | A-9 | Compound example 23 ($8\times10^{-6}$/Ag) | $B_1^{-1}$ ($1\times10^{-3}$ mol/Ag) | none | 0.29 | 122 | 0.40 | 117 | Comp. |
| 110 | A-10 | Compound example 11 ($8\times10^{-6}$/Ag) | $B_1^{-1}$ ($1\times10^{-3}$ mol/Ag) | none | 0.31 | 137 | 0.41 | 131 | Comp. |

TABLE 1-continued

| Sample | Emulsion | | Reducing compound of C/H ≦ 3.0 and/or M.W. ≦ 300 (Addition amount) | Reducing compound of C/H > 3.0 and/or M.W. > 300 (Addition amount) | Fresh photographic property Dmin | Fresh photographic property Relative speed | Raw stock storability Dmin | Raw stock storability Relative speed | Remarks |
|---|---|---|---|---|---|---|---|---|---|
| 111 | A-11 | Compound example 11 ($8 \times 10^{-6}$/Ag) | $B_1^{-1}$ ($5 \times 10^{-3}$ mol/Ag) | none | 0.29 | 127 | 0.38 | 123 | Comp. |
| 112 | A-12 | Compound example 56 ($8 \times 10^{-6}$/Ag) | $B_1^{-1}$ ($1 \times 10^{-3}$ mol/Ag) | none | 0.30 | 139 | 0.43 | 133 | Comp. |
| 113 | A-13 | none | $B_{11}^{-11}$ ($1 \times 10^{-3}$ mol/Ag) | none | 0.21 | 98 | 0.25 | 98 | Comp. |
| 114 | A-14 | Compound example 24 ($8 \times 10^{-6}$/Ag) | $B_{11}^{-11}$ ($1 \times 10^{-3}$ mol/Ag) | none | 0.31 | 126 | 0.44 | 121 | Comp. |
| 115 | A-15 | Compound example 24 ($8 \times 10^{-6}$/Ag) | $B_{11}^{-11}$ ($5 \times 10^{-3}$ mol/Ag) | none | 0.29 | 114 | 0.37 | 108 | Comp. |
| 116 | A-16 | Compound example 23 ($8 \times 10^{-6}$/Ag) | $B_{11}^{-11}$ ($1 \times 10^{-3}$ mol/Ag) | none | 0.29 | 121 | 0.41 | 118 | Comp. |
| 117 | A-17 | Compound example 23 ($8 \times 10^{-6}$/Ag) | $B_{11}^{-11}$ ($5 \times 10^{-3}$ mol/Ag) | none | 0.27 | 111 | 0.37 | 107 | Comp. |
| 118 | A-18 | Compound example 11 ($8 \times 10^{-6}$/Ag) | $B_{11}^{-11}$ ($1 \times 10^{-3}$ mol/Ag) | none | 0.30 | 136 | 0.40 | 130 | Comp. |
| 119 | A-19 | Compound example 11 ($8 \times 10^{-6}$/Ag) | $B_{11}^{-11}$ ($5 \times 10^{-3}$ mol/Ag) | none | 0.28 | 126 | 0.37 | 120 | Comp. |
| 120 | A-20 | Compound example 56 ($8 \times 10^{-6}$/Ag) | $B_{11}^{-11}$ ($1 \times 10^{-3}$ mol/Ag) | none | 0.31 | 140 | 0.40 | 131 | Comp. |
| 121 | A-1 | none | none | $B_2^{-2}$ ($1 \times 10^{-2}$ mol/Ag) | 0.21 | 100 | 0.26 | 100 | Comp. |
| 122 | A-2 | Compound example 24 ($8 \times 10^{-6}$/Ag) | none | $B_2^{-2}$ ($1 \times 10^{-2}$ mol/Ag) | 0.29 | 128 | 0.39 | 120 | Comp. |
| 123 | A-2 | Compound example 24 ($8 \times 10^{-6}$/Ag) | none | $B_2^{-2}$ ($3 \times 10^{-2}$ mol/Ag) | 0.26 | 119 | 0.34 | 111 | Comp. |
| 124 | A-3 | Compound example 23 ($8 \times 10^{-6}$/Ag) | none | $B_2^{-2}$ ($1 \times 10^{-2}$ mol/Ag) | 0.27 | 120 | 0.40 | 115 | Comp. |
| 125 | A-4 | Compound example 11 ($8 \times 10^{-6}$/Ag) | none | $B_2^{-2}$ ($1 \times 10^{-2}$ mol/Ag) | 0.29 | 137 | 0.40 | 129 | Comp. |
| 126 | A-4 | Compound example 11 ($8 \times 10^{-6}$/Ag) | none | $B_2^{-2}$ ($3 \times 10^{-2}$ mol/Ag) | 0.26 | 124 | 0.34 | 118 | Comp. |
| 127 | A-5 | Compound example 56 ($8 \times 10^{-6}$/Ag) | none | $B_2^{-2}$ ($1 \times 10^{-2}$ mol/Ag) | 0.30 | 138 | 0.38 | 129 | Comp. |
| | | Speed-increasing compound (Addition amount) | | | | | | | |
| 128 | A-6 | none | $B_1^{-1}$ ($1 \times 10^{-3}$ mol/Ag) | $B_2^{-2}$ ($1 \times 10^{-2}$ mol/Ag) | 0.21 | 101 | 0.24 | 99 | Comp. |
| 129 | A-7 | Compound example 24 ($8 \times 10^{-6}$/Ag) | $B_1^{-1}$ ($1 \times 10^{-3}$ mol/Ag) | $B_2^{-2}$ ($1 \times 10^{-2}$ mol/Ag) | 0.24 | 132 | 0.30 | 127 | Inv. |
| 130 | A-9 | Compound example 23 ($8 \times 10^{-6}$/Ag) | $B_1^{-1}$ ($1 \times 10^{-3}$ mol/Ag) | $B_2^{-2}$ ($1 \times 10^{-2}$ mol/Ag) | 0.22 | 124 | 0.28 | 120 | Inv. |
| 131 | A-10 | Compound example 11 ($8 \times 10^{-6}$/Ag) | $B_1^{-1}$ ($1 \times 10^{-3}$ mol/Ag) | $B_2^{-2}$ ($1 \times 10^{-2}$ mol/Ag) | 0.23 | 139 | 0.30 | 134 | Inv. |
| 132 | A-12 | Compound example 56 ($8 \times 10^{-6}$/Ag) | $B_1^{-1}$ ($1 \times 10^{-3}$ mol/Ag) | $B_2^{-2}$ ($1 \times 10^{-2}$ mol/Ag) | 0.22 | 142 | 0.31 | 139 | Inv. |
| 133 | A-13 | none | $B_{11}^{-11}$ ($1 \times 10^{-3}$ mol/Ag) | $B_2^{-2}$ ($1 \times 10^{-2}$ mol/Ag) | 0.22 | 102 | 0.23 | 101 | Comp. |
| 134 | A-14 | Compound example 24 ($8 \times 10^{-6}$/Ag) | $B_{11}^{-11}$ ($1 \times 10^{-3}$ mol/Ag) | $B_2^{-2}$ ($1 \times 10^{-2}$ mol/Ag) | 0.23 | 134 | 0.29 | 130 | Inv. |
| 135 | A-16 | Compound example 23 ($8 \times 10^{-6}$/Ag) | $B_{11}^{-11}$ ($1 \times 10^{-3}$ mol/Ag) | $B_2^{-2}$ ($1 \times 10^{-2}$ mol/Ag) | 0.23 | 126 | 0.26 | 122 | Inv. |
| 136 | A-18 | Compound example 11 ($8 \times 10^{-6}$/Ag) | $B_{11}^{-11}$ ($1 \times 10^{-3}$ mol/Ag) | $B_2^{-2}$ ($1 \times 10^{-2}$ mol/Ag) | 0.24 | 141 | 0.29 | 131 | Inv. |
| 137 | A-20 | Compound example 56 ($8 \times 10^{-6}$/Ag) | $B_{11}^{-11}$ ($1 \times 10^{-3}$ mol/Ag) | $B_2^{-2}$ ($1 \times 10^{-2}$ mol/Ag) | 0.25 | 144 | 0.30 | 140 | Inv. |

TABLE 2

| Emulsion coating condition | |
|---|---|
| (1) Emulsion layer | |
| Emulsion: Each emulsion | (Silver $1.63 \times 10^{-2}$ mol/m$^2$) |
| Coupler | ($2.26 \times 10^{-3}$ mol/m$^2$) |

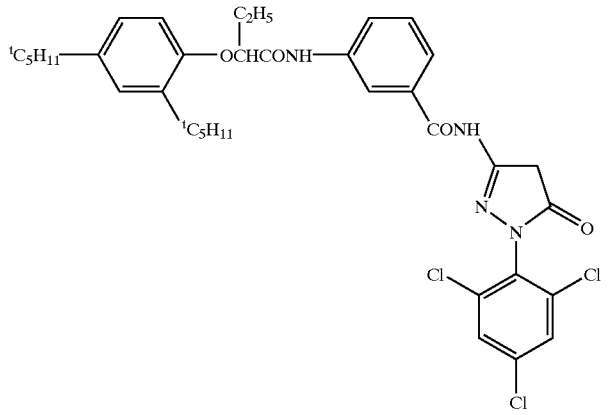

| | |
|---|---|
| Reducing compound of C/H > 300 and/or M.W. > 300 | Compound used and the amount thereof are set forth in Table 1 |
| Tricresyl phosphate | (1.32 g/m$^2$) |
| Gelatin | (3.24 g/m$^2$) |
| 2) Protective layer | |
| 2,4-dichloro-6-hydroxy-s-triazine sodium solt | (0.08 g/m$^2$) |
| Gelatin | (1.80 g/m$^2$) |

These samples were exposed for 1/100 sec through a gelatin filter SC-39 (a long-wavelength light transmitting filter having a cutoff wavelength of 390 nm) manufactured by Fuji Photo Film Co., Ltd. and a continuous wedge. Then, these samples were subjected to the development processing to be described later and evaluation of photographic properties (flesh photographic property) was conducted by measuring density using a green filter.

Separately, each of the samples were kept under the conditions of 50° C. and 80%RH for three days. Then, the samples were exposed to light, processed and conducted the evaluation of photographic property in the same manner as above, to evaluate raw stock storability (raw stock storability).

The development was done as follows by using an automatic processor FP-350 manufactured by Fuji Photo Film Co., Ltd (until the accumulated replenishing amount becomes three times the mother tank solution).

(Processing Steps)

| Step | Time | Temperature | Replenishing amount* |
|---|---|---|---|
| Color development | 3 min 15 sec | 38° C. | 45 mL |
| Bleaching | 1 min 00 sec | 38° C. | 20 mL<br>All of the overflow of the bleach solution was flown to the tank of bleach-fix |

-continued

| Step | Time | Temperature | Replenishing amount* |
|---|---|---|---|
| Bleach-fix | 3 min 15 sec | 38° C. | 30 mL |
| Washing (1) | 40 sec | 35° C. | Counter current flow from (2) to (1) |
| Washing (2) | 1 min 00 sec | 35° C. | 30 mL |
| Stabilization | 40 sec | 38° C. | 20 mL |
| Drying | 1 min 15 sec | 55° C. | |

*The replenishment rate is a value per 1.1 m of a 35-mm wide lightsensitive material (equivalent to one role of 24 Ex. film).

The composition of each processing solution was as follows.

| (Color developer) | Tank solution (g) | Replenisher (g) |
|---|---|---|
| Diethylenetriaminepentaacetic acid | 1.0 | 1.1 |
| 1-Hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-(β-hydroxyethyl)amino]-2-methylaniline sulfate | 4.5 | 5.5 |
| Water to make | 1.0 L | 1.0 L |
| pH (adjusted by the use of potassium hydroxide and sulfuric acid) | 10.05 | 10.10 |

-continued

| (Bleach solution) Common to tank solution and replenisher (unit: g) | |
|---|---|
| Fe(III) ammonium ethylenediaminetetraacetate dihydrate | 120.0 |
| Disodium ethylenediaminetetraacetate | 10.0 |
| Ammonium bromide | 100.0 |
| Ammonium nitrate | 10.0 |
| Bleach accelerator $(CH_3)_2N—CH_2—CH_2—S—S—CH_2—CH_2—N(CH_3)_2.2HCl$ | 0.005 mol |
| Aqueous ammonia (27%) | 15.0 mL |
| Water to make | 1.0 L |
| pH (adjusted by the use of aqueous ammonia and nitric acid) | 6.3 |

| (Bleach-fix sol) | Tank solution (g) | Replenisher (g) |
|---|---|---|
| Fe(III) ammonium ethylenediaminetetra-acetate Dihydrate | 50.0 | — |
| Disodium ethylenediaminetetraacetate | 5.0 | 2.0 |
| Sodium sulfite | 12.0 | 20.0 |
| Aqueous solution of ammonium thiosulfate (700 g/L) | 240.0 mL | 400.0 mL |
| Aqueous ammonia (27%) | 6.0 ml | — |
| Water to make | 1.0 L | 1.0 L |
| pH (adjusted by aqueous ammonia and acetic acid) | 7.2 | 7.3 |

(Washing Water)

Tap water was passed through a mixed-bed column filled with H-type strongly acidic cation exchanged resin (Amberlite IR-120B produced by Rohm & Haas Co.) and OH-type strongly basic anion exchanged resin (Amberlite IR-400 produced by the same maker) so as to set the concentration of calcium and magnesium ions at 3 mg/L or less. Subsequently, 20 mg/L of sodium dichloroisocyanurate and 0.15 g/L of sodium sulfate were added. The pH of the solution ranged from 6.5 to 7.5.

| (Stabilizer) | Common to tank solution and replenisher (unit: g) |
|---|---|
| Sodium p-toluenesulfinate | 0.03 |
| Polyoxyethylene-p-monononylphenyl ether (av. polymerization degree: 10) | 0.2 |
| Disodium Ethylenediaminetetraacetic acid | 0.05 |
| 1,2,4-Triazole | 1.3 |
| 1,4-Bis(1,2,4-triazol-1-ylmethyl)piperazine | 0.75 |
| Water to make | 1.0 L |
| pH | 8.5 |

The results of photographic performances of the samples are shown in Table 1 above. The speed of each sample was indicated by a relative value of a reciprocal of an exposure amount required to give the density of the fog density plus 0.2. (Sample 101 was regarded as a control: 100).

As is apparent from Table 1, the addition of compound examples 24, 23, 11 and 56 according to the present invention realizes a speed increase in fresh photographic property but simultaneously invites a clear increase of unexposed part density (fog). Further, it is apparent that the fog increase of samples after raw stock storage is conspicuous to thereby diminish the speed increase by the addition of the compounds (samples 102 to 105 vs. sample 101).

In the case where the compounds $B_1$-1 and $B_{11}$-11 being reducing compounds having a C/H value of 3 or less and/or those having a molecular weight of 300 or less, are added alone, an increase of the addition amount thereof realizes a fog reduction as compared with the fog without the addition but unfavorably invites a simultaneous speed drop (samples 107, 108, 114 and 115 vs. sample 102), or (samples 116 and 117 vs. sample 103), or (samples 110, 111, 118 and 119 vs. sample 104).

Also, in the sole addition of compound $B_2$-2 being a reducing compound having a C/H value of more than 3 and/or those having a molecular weight of more than 300, an increase of the addition amount thereof realizes a fog reduction as compared with the fog without the addition but unfavorably invites a simultaneous speed drop (samples 122 and 123 vs. sample 102), or (samples 125 and 126 vs. sample 104).

As demonstrated by the samples of the present invention, a fog reduction can be accomplished without any photographic speed drop by the simultaneous addition of at least one reducing compound having a C/H value of 3 or less and at least one reducing compound having a C/H value of more than 3. The same can be applied to the simultaneous addition of at least one reducing compound having a molecular weight of 300 or less and at least one reducing compound having a molecular weight of more than 300.

Example 2

The reconciliation of high photographic speed and low fog by the combined use of compounds of types (1) to (5) and compounds represented by the general formulae ($B_1$) to ($B_{13}$) according to the present invention will be described below.

Emulsion B-1 was prepared in the same manner as in Example 1 except that the chemical sensitization conditions for the emulsion A were changed as follows:

(1) the emulsion was heated to 56° C.;

(2) sensitizing dyes I, II and III were added in place of the sensitizing dyes 11 and 12; and (3) at the completion of chemical sensitization, compound I was added in place of the compounds 13 and 14.

Sensitizing dye I

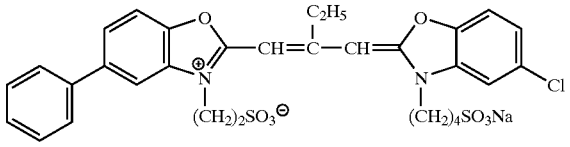

Sensitizing dye II

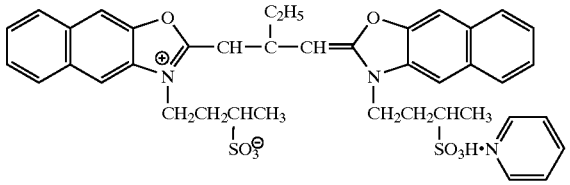

Sensitizing dye III

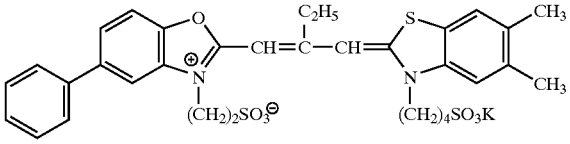

-continued

Compound I

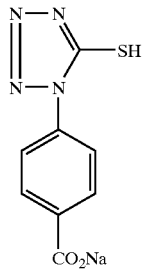

(Preparation of Emulsions B-2 and B-4)

Emulsions B-2 and B-4 were produced in the same manner as the emulsion B-1 except that after the completion of chemical sensitization compound I was added and then, compound examples 25 and 60 being compounds which would undergo a one-electron oxidation so as to form one-electron oxidation products capable of releasing one or more electrons according to the present invention, were added, respectively, in an amount of $8\times10^{-6}$ mol per mol of silver contained in the emulsions.

(Preparation of Emulsions B-3 and B-5)

Emulsions B-3 and B-5 were produced in the same manner as the emulsion B-1 except that at the time of after the heating to 56° C. and before the addition of chemical sensitizing dyes and the chemical sensitization, compound examples 25 and 60 being compounds which would undergo a one-electron oxidation so as to form one-electron oxidation products capable of releasing one or more electrons according to the present invention, were added, respectively, in an amount of $8\times10^{-6}$ mol per mol of silver contained in the emulsions.

(Preparation of Emulsions B-6 to B-11)

Emulsions B-6 to B-11 were prepared by adding compound Example $B_1$-1 being a reducing compound having a C/H value of 3 or less and/or that having a molecular weight of 300 or less according to the present invention to the previously produced emulsions B-1 to B-5, respectively, in amounts, based on the silver quantity of the emulsions, as set forth in Table 3.

(Preparation of Coating Samples 201 to 220)

In the same manner as in Example 1, samples 201 to 220 were prepared by coating each of the above chemically sensitized emulsions B-1 to B-11 to a cellulose triacetate film support provided with a subbing layer together with a protective layer under the coating conditions of Table 2 (provided that the reducing compound having a C/H value of more than 3 and/or that having a molecular weight of more than 300 was replaced with compound Example $B_1$-3, the addition amount thereof being set forth in Table 3).

TABLE 3

| | | Speed-increasing compound (Addition timing) | | Reducing compound of | Reducing compound of | Fresh photographic property | | Raw stock storability | | |
|---|---|---|---|---|---|---|---|---|---|---|
| Sample | Emulsion | (After chemical sensitization) | (Before dye addition) | C/H ≦ 3.0 and/or M.W. ≦ 300 (Addition amount) | C/H > 3.0 and/or M.W. > 300 (Addition amount) | Dmin | Relative speed | Dmin | Relative speed | Remark |
| 201 | B-1 | none | none | none | none | 0.28 | 100 (control) | 0.41 | 88 | Comp. |
| 202 | B-2 | Compound example 25 | none | none | none | 0.56 | 112 | 0.82 | 93 | Comp. |
| 203 | B-3 | none | Compound example 25 | none | none | 0.57 | 111 | 0.81 | 92 | Comp. |
| 204 | B-4 | Compound example 60 | none | none | none | 0.61 | 115 | 0.88 | 97 | Comp. |
| 205 | B-5 | none | Compound example 60 | none | none | 0.59 | 116 | 0.86 | 101 | Comp. |
| 206 | B-6 | none | none | $B_1^{-1}$ ($1\times10^{-3}$ mol/Ag) | none | 0.27 | 100 | 0.35 | 93 | Comp. |
| 207 | B-7 | Compound example 25 | none | $B_1^{-1}$ ($1\times10^{-3}$ mol/Ag) | none | 0.38 | 118 | 0.65 | 105 | Comp. |
| 208 | B-8 | Compound example 25 | none | $B_1^{-1}$ ($5\times10^{-3}$ mol/Ag) | none | 0.34 | 110 | 0.52 | 103 | Comp. |
| 209 | B-9 | Compound example 60 | none | $B_1^{-1}$ ($1\times10^{-3}$ mol/Ag) | none | 0.39 | 120 | 0.67 | 111 | Comp. |
| 210 | B-10 | Compound example 60 | none | $B_1^{-1}$ ($5\times10^{-3}$ mol/Ag) | none | 0.36 | 117 | 0.58 | 108 | Comp. |
| 211 | B-1 | none | none | none | $B_1^{-3}$ ($1\times10^{-2}$ mol/Ag) | 0.26 | 101 | 0.33 | 94 | Comp. |
| 212 | B-2 | Compound example 25 | none | none | $B_1^{-3}$ ($1\times10^{-2}$ mol/Ag) | 0.36 | 120 | 0.62 | 110 | Comp. |
| 213 | B-2 | Compound example 25 | none | none | $B_1^{-3}$ ($3\times10^{-2}$ mol/Ag) | 0.33 | 111 | 0.51 | 107 | Comp. |
| 214 | B-4 | Compound example 60 | none | none | $B_1^{-3}$ ($1\times10^{-2}$ mol/Ag) | 0.38 | 122 | 0.64 | 113 | Comp. |
| 215 | B-4 | Compound example 60 | none | none | $B_1^{-3}$ ($3\times10^{-2}$ mol/Ag) | 0.34 | 115 | 0.55 | 109 | Comp. |
| 216 | B-6 | none | none | $B_1^{-1}$ ($1\times10^{-3}$ mol/Ag) | $B_1^{-3}$ ($1\times10^{-2}$ mol/Ag) | 0.26 | 102 | 0.32 | 97 | Comp. |
| 217 | B-7 | Compound example 25 | none | $B_1^{-1}$ ($1\times10^{-3}$ mol/Ag) | $B_1^{-3}$ ($1\times10^{-2}$ mol/Ag) | 0.30 | 125 | 0.45 | 117 | Inv. |
| 218 | B-10 | none | Compound example 25 | $B_1^{-1}$ ($1\times10^{-3}$ mol/Ag) | $B_1^{-3}$ ($1\times10^{-2}$ mol/Ag) | 0.29 | 126 | 0.44 | 117 | Inv. |

TABLE 3-continued

| Sample | Emulsion | Speed-increasing compound (Addition timing) (After chemical sensitization) | (Before dye addition) | Reducing compound of C/H ≦ 3.0 and/or M.W. ≦ 300 (Addition amount) | Reducing compound of C/H > 3.0 and/or M.W. > 300 (Addition amount) | Fresh photographic property Dmin | Relative speed | Raw stock storability Dmin | Relative speed | Remark |
|---|---|---|---|---|---|---|---|---|---|---|
| 219 | B-9 | Compound example 60 | none | $B_1^{-1}$ ($1 \times 10^{-3}$ mol/Ag) | $B_1^{-3}$ ($1 \times 10^{-2}$ mol/Ag) | 0.32 | 134 | 0.46 | 130 | Inv. |
| 220 | B-11 | none | Compound example 60 | $B_1^{-1}$ ($1 \times 10^{-3}$ mol/Ag) | $B_1^{-3}$ ($1 \times 10^{-2}$ mol/Ag) | 0.31 | 137 | 0.45 | 132 | Inv. |

These samples were allowed to stand still at 40° C. in a relative humidity of 70% for 14 hr to harden the films. Thereafter, exposure thereof was conducted through gelatin filter SC-50 (long-wave light transmission filter of 500 nm cutoff wavelength) produced by Fuji Photo Film Co., Ltd. and a continuous wedge for 1/100 sec. The resultant samples were developed under the same processing conditions as in Example 1, and subjected to density measurement through a green filter so as to evaluate the photographic performance thereof. Further, the same samples as samples 201 to 220 were separately prepared. After the same film hardening, they were left to stand under the conditions of 50° C. in 80% RH for 3 days. The thus prepared samples were processed in the same manner as above.

The results of photographic performance are listed in Table 3 above. The speed of each sample was indicated by a relative value of a reciprocal of an exposure amount required to give the density of the fog density plus 0.2. (Sample 201 was regarded as a control: 100).

As apparent from Table 3, with respect to the green-sensitive emulsion as well, the addition of compound Example 25 or 60 according to the present invention realizes a photographic speed increase in fresh photography but simultaneously invites a clear increase of unexposed part density (fog). Further, it is apparent that with respect to the stage of addition of the compound Example 25 or 60, similar effects are exerted before and after the initiation of chemical sensitization.

Still further, it is apparent that the fog increase of samples after raw stock storage is more conspicuous than that exhibited in the use of the blue-sensitive emulsion of Example 1, thereby countervailing the photographic speed increase by the compound addition (samples 202 to 205 vs. sample 201).

In the sole addition of the compound $B_1$-1 being a reducing compound having a C/H value of 3 or less and/or that having a molecular weight of 300 or less, an increase of the addition amount thereof realizes a fog reduction as compared with the fog without the addition but unfavorably invites a simultaneous speed drop (samples 207 and 208 vs. sample 202), or (samples 209 and 210 vs. sample 204).

Also, in the sole addition of compound $B_1$-3 being a reducing compound having a C/H value of more than 3 and/or that having a molecular weight of more than 300, an increase of the addition amount thereof realizes a fog reduction as compared with the fog without the addition but unfavorably invites a simultaneous speed drop (samples 212 and 213 vs. sample 202), or (samples 214 and 215 vs. sample 204).

As demonstrated by the samples of the present invention, a fog reduction in fresh photography can be accomplished without any photographic speed drop by the simultaneous addition of at least one reducing compound having a C/H value of 3 or less and at least one reducing compound having a C/H value of more than 3. The same can be applied to the simultaneous addition of at least one reducing compound having a molecular weight of 300 or less and at least one reducing compound having a molecular weight of more than 300. Further, in view of the suppression of fog after sample storage, it is seen that the effect of photographic speed increase attributed to the addition of compound Example 20 or 60 is maintained even after the sample storage. Moreover, irrespective of the stage of addition of compound Example 25 or 60, a photographic speed increase and fog reducing effects in fresh photography and after storage can be ascertained.

Example 3

The reconciliation of high photographic speed and low fog by the combined use of compounds of types (1) to (5) and compounds represented by the general formulae ($B_1$) to ($B_{13}$) in a multi-layer color photosensitive material according to the present invention will be described below.

Emulsions Em-A to Em-O were prepared by the following preparation methods.

(Preparation of Em-A)

An aqueous solution (42.2 L) containing 31.7 g of a phthalated low molecular weight gelatin, which has a phthalation ratio of 97% and a molecular weight of 15,000, and 31.7 g of KBr was vigorously stirred by keeping the temperature at 35° C. An aqueous solution (1,583 mL) containing 316.7 g of $AgNO_3$, and an aqueous solution (1,583 mL) containing 221.5 g of KBr and 52.7 g of a low molecular weight gelatin with a molecular weight of 15,000 were added by a double-jet method for 1 min. Immediately after completion of the addition, 52.8 g of KBr was added, followed by adding an aqueous solution (2,485 mL) containing 398.2 g of $AgNO_3$ and an aqueous solution (2,581 mL) containing 291.1 g of KBr by the double-jet method for 2 min. Immediately after completion of the addition, 44.8 g of KBr was added, and the mixed solution was ripened by increasing the temperature to 40° C. After completion of the ripening, 923 g of phthalated gelatin with a phthalation ratio of 97% and a molecular weight of 100,000 and 79.2 g of KBr were added, and an aqueous solution (15,974 mL) containing 5,103 g of $AgNO_3$ and an aqueous KBr solution were added by the double-jet method for 10 minutes by accelerating the flow rate such that the final flow rate was 1.4 times the initial flow rate. The silver potential was kept at −60 mV relative to the saturated calomel electrode. After washing the emulsion with water, gelatin was added, and then a seed emulsion was prepared by adjusting pH to 5.7, pAg to 8.8, weight of the emulsion in terms of silver per kg thereof to 131.8 g, and the gelatin weight to 64.1 g.

An aqueous solution (1,211 mL) containing 46 g of gelatin with a phthalation ratio of 97% and 1.7 g of KBr was vigorously stirred by keeping the temperature at 75° C. After adding 9.9 g of the seed emulsion, 0.3 g of denatured silicone oil (L7602 made by Nihon Unicar Co.) was added. After adjusting pH at 5.5 by adding $H_2SO_4$, an aqueous solution (67.6 mL) containing 7.0 g of $AgNO_3$ and an aqueous KBr solution were added for 6 min by the double-jet method by accelerating the flow rate such that the final flow rate was 5.1 times the initial flow rate. During the time, the silver potential was kept at −20 mV relative to the saturated calomel electrode. After adding 2 mg of sodium benzenethiosulfonate and 2 mg of thiourea dioxide, an aqueous solution (328 mL) containing 105.6 g of $AgNO_3$ and aqueous KBr solution were added for 56 min by the double-jet method by accelerating the flow rate such that the final flow rate was 3.7 times the original flow rate. During the addition, a AgI fine grain emulsion with a grain size of 0.037 $\mu$m was simultaneously added by accelerating the flow rate such that the final content of silver iodide was 27 mol % while maintaining the silver potential at −50 mV relative to the saturated calomel electrode. An aqueous solution (121.3 mL) containing 45.6 g of $AgNO_3$ and an aqueous KBr solution were added by the double jet method for 22 min. The silver potential was kept at +20 mV relative to the saturated calomel electrode. The temperature was increased at 82° C. and, after adjusting the silver potential at −80 mV, the afore mentioned AgI fine grain emulsion in an amount 6.33 g in terms of KI weight was added. Immediately after completion of the addition, an aqueous solution (206.2 mL) containing 66.4 g of $AgNO_3$ was added for 16 minutes. The silver potential during the initial five minutes was kept at −80 mV with a KBr aqueous solution. After washing the emulsion with water, the pH and pAg were adjusted to 5.8 and 8.7, respectively by adding gelatin.

The temperature of the emulsion was increased to 56° C., and the following sensitizing dyes I, II and III, compound I, potassium thiocyanate, aurichloric acid, sodium thiosulfate and N,N-dimethylselenourea were added to perform optimum chemical sensitization. The sensitizing dyes used were fine solid dispersions prepared by the method described in JP-A-11-52507. In this method, 0.8 parts by weight of sodium nitrate and 3.2 parts by weight of sodium sulfate were dissolved in 43 parts by weight of ion-exchanged water, 13 parts by weight of the sensitizing dyes were added, and the dyes were dispersed at 60° C. at 2,000 rpm for 20 minutes using a dissolver blade to obtain a solid dispersion of the sensitizing dyes.

Sensitizing dye I

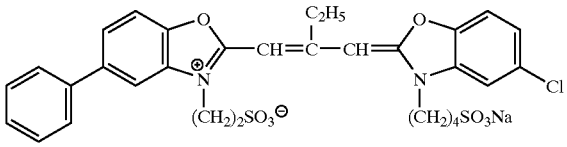

Sensitizing dye II

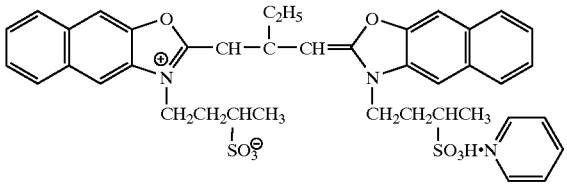

-continued

Sensitizing dye III

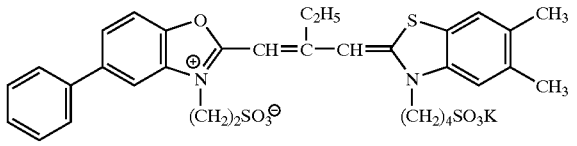

Compound I

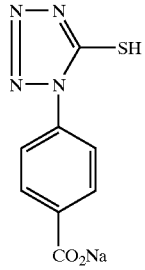

(Preparation of Em-B)

An aqueous solution (1,192 mL) containing 0.96 g of a low molecular weight gelatin and 0.9 g of KBr was vigorously stirred by keeping the temperature at 40° C. An aqueous solution (37.5 mL) containing 1.49 g of $AgNO_3$ and an aqueous solution (37.5 mL) containing 1.05 g of KBr were added for 30 seconds by the double-jet method. After adding 1.2 g of KBr, the mixture was ripened by increasing the temperature at 75° C. After the ripening, 35 g of trimellitated gelatin, in which amino groups were chemically modified with trimellitic acid, with a molecular weight of 100,000 was added, and pH of the solution was adjusted to 7 followed by adding 6 mg of thiourea dioxide. An aqueous solution (116 mL) containing 29 g of $AgNO_3$ and an aqueous solution of KBr were added by the double-jet method by accelerating the flow rate such that the final flow rate was three times the initial flow rate.

The silver potential was kept at −20 mV relative to the saturated calomel electrode. An aqueous solution (440.6 mL) containing 110.2 g of $AgNO_3$ and an aqueous solution of KBr were added by the double-jet method by accelerating the flow rate such that the final flow rate was 5.1 times the initial flow rate. The AgI fine grain emulsion used in the preparation of Em-A was simultaneously added by accelerating the flow speed such that the content of silver iodide was 15.8 mol % while keeping the silver potential at 0 mV relative to the saturated calomel electrode. Then, an aqueous solution (96.5 mL) containing 24.1 g of $AgNO_3$ and an aqueous KBr solution were added by the double-jet method for 3 min while maintaining the silver potential at 0 mV. After adding 26 mg of sodium ethylthiosulfonate, the temperature was increased at 55° C., and the silver potential was adjusted to −90 mV by adding an aqueous KBr solution.

The AgI fine grain emulsion was added in an amount of 8.5 g in terms KI weight. Immediately after the addition, an aqueous solution (228 mL) containing 57 g of $AgNO_3$ was added over 5 min. The silver potential, at the end of the addition, of the solution was adjusted to +20 mV by the addition of a KBr solution. After adding the compounds 11 and 12, the temperature of the solution was increased to 60° C. Potassium thiocyanate, aurichloric acid, sodium thiosulfate and N,N-dimethyl selenourea were added after adding the sensitizing dyes 11 and 12 for optimum chemical sensitization. The compounds 13 and 14 were added at the completion of the chemical sensitization. Herein, the optimum chemical sensitization refers to adding sensitizing dyes and compounds in an amount selected within the range of $10^{-1}$ to $10^{-8}$ mol per mol of silver halides.

Compound I

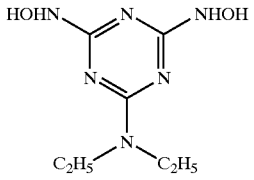

(Compound example $B_1$-1)

Compound 12

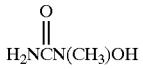

Sensitizing dye 11

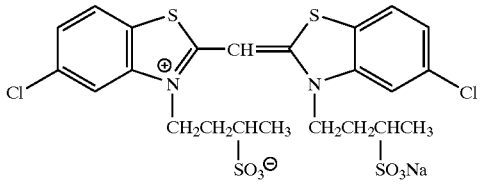

Sensitizing dye 12

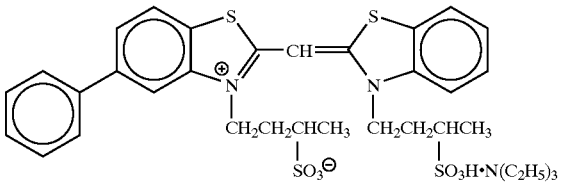

Compound 13

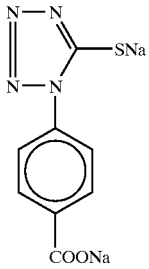

Compound 14

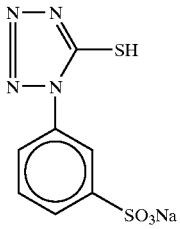

(Preparation of Em-C)

An aqueous solution (1,192 mL) containing 1.02 g of phthalated gelatin, which contains 35 μmol of methionine per gram of gelatin, with a molecular weight of 100,000 and phthalation ratio of 97% and 0.9 g of KBr was vigorously stirred while keeping the temperature at 35° C. An aqueous solution (42 mL) containing 4.47 g of $AgNO_3$ and an aqueous solution (42 mL) containing 3.16 g of KBr were added by the double-jet method for 9 sec. After adding 2.6 g of KBr, the temperature of the solution was increased to 63° C. for ripening. After completion of the ripening, 41.2 g of trimellitated gelatin with a molecular weight of 100,000, which had been used for preparing Em-B, and 18.5 g of NaCl were added. Then, 8 mg of dimethylamino borane was added after adjusting the pH of the solution to 7.2. An aqueous solution (203 mL) containing 26 g of $AgNO_3$ and an aqueous KBr solution were added by the double-jet method such that the final flow rate was 3.8 times the initial flow rate. The silver potential was kept at −30 mV relative to the saturated calomel electrode. An aqueous solution (440.6 mL) containing 110.2 g of $AgNO_3$ and an aqueous solution of KBr were added by the double-jet method over 24 min by accelerating the flow rate such that the final flow rate was 5.1 times the initial flow rate. The AgI fine grain emulsion used in preparing Em-A was also simultaneously added by accelerating the flow rate so that the content of silver iodide becomes 2.3 mol % while maintaining the silver potential at −20 mV relative to the calomel electrode. After adding 10.7 mL of 1N aqueous potassium thiocyanate solution, 153.5 mL of an aqueous solution containing 24.1 g of $AgNO_3$ and an aqueous KBr solution were added by the double-jet method for 2 minutes and 30 seconds while maintaining the silver potential at 10 mV. The silver potential was adjusted to −70 mV by adding an aqueous KBr solution. The AgI fine grain emulsion was added in an amount of 6.4 g in terms of KI weight. Immediately after completion of the addition, an aqueous solution (404 mL) containing 57 g of $AgNO_3$ was added for 45 minutes. The silver potential at the end of addition was controlled to −30 mV with the aqueous KBr solution, followed by washing with water as in chemical sensitization of Em-B.

(Preparation of Em-D)

Em-D was prepared by the substantially same method as preparing Em-C, except that the addition amount of $AgNO_3$ during nucleation was increased to 2.3 times, and the silver potential at the completion of the addition of the final solution (404 mL) containing 57 g of $AgNO_3$ was adjusted to +90 mV by an aqueous solution of KBr.

(Preparation of Em-E)

An aqueous solution (1,200 mL) containing 0.75 g of a low molecular weight gelatin with a molecular weight of 15,000, 0.9 g of KBr and 0.2 g of modified silicone oil used in the preparation Em-A was kept at 39° C., and was vigorously stirred while maintaining pH at 1.8. An aqueous KBr solution containing 0.45 g of $AgNO_3$ and 1.5 mol % of KI was added by the double-jet method for 16 sec while maintaining the excess concentration of KBr constant. The solution was heated to 54° C. and ripened. After the ripening, phthalated gelatin with a molecular weight of 100,000 and phthalation ratio of 97%, which contains 35 μmol of methionine per g of gelatin, was added. After adjusting pH to 5.9, 2.9 g of KBr was added. An aqueous solution (288 mL) containing 28.8 g of $AgNO_3$ and an aqueous solution of KBr were added by the double-jet method over 53 min. The AgI fine grain emulsion used in preparing Em-A was simultaneously added such that the silver iodide content was 4.1 mol % while maintaining the silver potential at −60 mV relative to the calomel electrode. After adding 2.5 g of KBr, an aqueous solution containing 87.7 g of $AgNO_3$ and an aqueous KBr solution was added by the double-jet method over 63 min by accelerating the flow rate such that the final flow rate was 1.2 times the initial flow rate. The AgI fine grain emulsion was simultaneously added by accelerating the flow rate such that the content of silver iodide was 10.5 mol % while maintaining the silver potential at −70 mV. After adding 1 mg of thiourea dioxide, 132 mL of an aqueous solution containing 41.8 g of $AgNO_3$ and an aqueous solution of KBr were added by the double-jet method over 25 min. Addition of the aqueous KBr solution was controlled such that the silver potential at the completion of the addition was +20 mV. After adding 2 mg of sodium benzenethiosulfate, pH of the solution was adjusted to 7.3. After adjusting the silver potential to −70 mV by adding KBr, the above mentioned AgI fine grain emulsion was added in an amount of 5.73 g in terms of KI weight. Immediately after completion of the addition, an aqueous solution (609 mL) containing 66.4 g of $AgNO_3$ was added over 10 minutes. The silver potential was kept at −70 mV with the KBr solution for the initial 6 minutes of addition. After washing the emulsion with water, the pH and pAg values were adjusted at 6.5 and 8.2, respectively, at 40° C. by adding gelatin. The temperature of the solution was increased to 56° C. after adding the compounds 11 and 12. After adding 0.0004 mole of the AgI fine grain emulsion per of silver, the sensitizing dyes 13 and 14 were added. Potassium thiocyanate, aurichloric acid, sodium thiosulfate and N,N-dimethyl selenourea were added for optimum chemical sensitization. The compounds 13 and 14 were added at the end of chemical sensitization.

Sensitizing dye 13

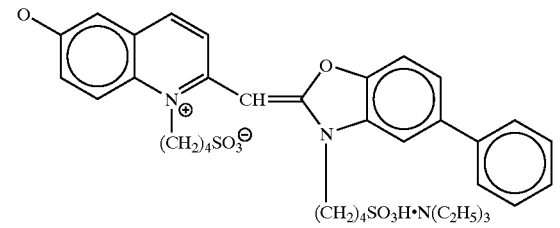

Sensitizing dye 14

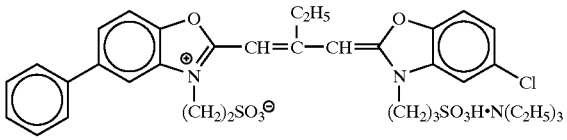

(Preparation of Em-F)

Em-F was prepared by substantially the same method as in Em-E except that the addition amount of $AgNO_3$ during nucleation was changed to 4.12 times, and the sensitizing dyes used in Em-E were replaced with sensitizing dyes 12, 15, 16 and 17.

Sensitizing dye 15

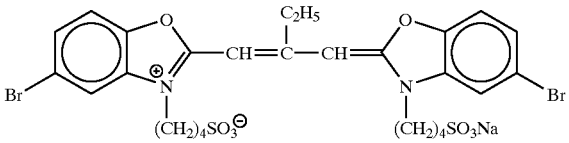

Sensitizing dye 16

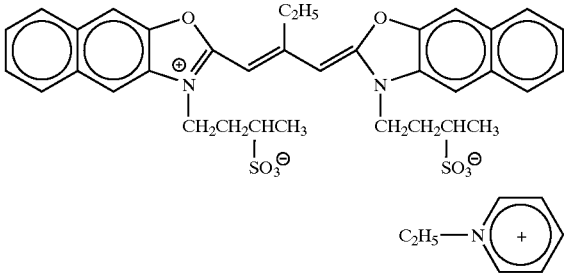

-continued

Sensitizing dye 17

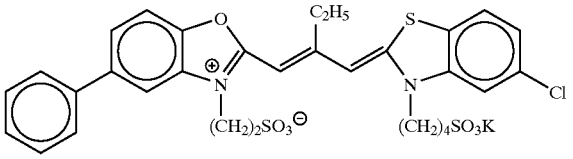

(Preparation of Em-G)

An aqueous solution (1,200 mL) containing 0.70 g of a low molecular weight gelatin with a molecular weight of 15,000, 0.9 g of KBr, 0.175 g of KI and 0.2 g of modified silicone oil used in Em-A was kept at 33° C., and was vigorously stirred after adjusting the pH to 1.8. An aqueous solution containing 1.8 g of $AgNO_3$ and an aqueous KBr solution containing 3.2 mol % of KI were added by the double-jet method for 9 sec while maintaining the excess concentration of KBr constant. The temperature of the solution was increased at 62° C. for ripening. After completion of the ripening, 27.8 g of trimellitated gelatin, in which amino groups were chemically modified with trimellitic acid, with a molecular weight of 100,000 and containing 35 $\mu$mol of methionine per g of gelatin, was added. After adjusting the pH of the solution to 6.3, 2.9 g of KBr was added. An aqueous solution (270 mL) containing 27.58 g of $AgNO_3$ and an aqueous KBr solution of were added by the double-jet method for 37 min. An AgI fine grain emulsion with a grain size of 0.008 $\mu$m was prepared by mixing an aqueous solutions of a low molecular weight gelatin with a molecular weight of 15,000, an aqueous solution of $AgNO_3$ and an aqueous solution of KI in a different chamber equipped with a magnetic coupling induction stirrer described in JP-A-10-43570. Immediately after preparation, this emulsion was added to the solution above such that the silver iodide content was 4.1 mol % while maintaining the silver potential at −60 mV relative to the saturated calomel electrode. After adding 2.6 g of KBr, an aqueous solution containing 87.7 g of $AgNO_3$ and an aqueous KBr solution were added by the double-jet method for 49 min by accelerating the flow rate such that the final flow rate was 3.1 times the initial flow rate. The above mentioned AgI fine grain emulsion prepared by mixing immediately before the addition was simultaneously added by accelerating the flow rate such that the silver iodide content was 7.9 mol % while maintaining the silver potential at −70 mV. After adding 1 mg of thiourea dioxide, 132 mL of an aqueous solution containing 41.8 g of $AgNO_3$ and an aqueous solution of KBr were added by the double-jet method for 20 min. The addition of the aqueous KBr solution was controlled so that the silver potential becomes +20 mV at the end of the double-jet addition. After increasing the temperature of the solution at 78° C. while adjusting pH at 9.1, the silver potential was adjusted to −60 mV by adding KBr. The AgI fine grain emulsion used in preparing Em-A was added in an amount of 5.73 g in terms of KI weight. Immediately after completion of the addition, 321 mL of an aqueous solution containing 66.4 g of $AgNO_3$ was added over 4 min. The silver potential was kept at −60 mV with the aqueous solution of KBr during the initial two min of the addition. The emulsion obtained was washed with water, followed by chemical sensitization in substantially the same manner as in Em-F.

(Preparation of Em-H)

An aqueous solution containing 17.8 g of ion-exchanged gelatin with a molecular weight of 100,000, 6.2 g of KBr and 0.46 g of KI was vigorously stirred while maintaining the temperature at 45° C. An aqueous solution containing 11.85 g of $AgNO_3$ and 3.8 g of KBr was added by the double-jet method over 45 sec. After raising the temperature to 63° C., 24.1 g of ion-exchanged gelatin with a molecular weight of 100,000 was added, and the solution was ripened. After completion of the ripening, an aqueous solution containing 133.4 g of $AgNO_3$ and an aqueous solution containing KBr were added by the double-jet method over 20 min such that the final flow rate was 2.6 times the initial flow rate while maintaining the silver potential at +40 mV relative to the saturated calomel electrode. Also added 10 minutes after the start of addition was 0.1 mg of $K_2IrCl_6$. After adding 7 g of NaCl, an aqueous solution containing 45.6 g of $AgNO_3$ and an aqueous KBr solution were added by the double-jet method over 12 min while maintaining the silver potential at +90 mV. An aqueous solution (100 mL) containing 29 mg of yellow prussiate of potash was also added for the initial 6 min from the initiation of the addition. After adding 14.4 g of KBr, the AgI fine grain emulsion used in Em-A was added in an amount of 6.3 g in terms of KI weight. Immediately after completion of the addition, an aqueous solution containing 42.7 g of $AgNO_3$ and an aqueous solution of KBr were added by the double-jet method over 11 minutes while maintaining the silver potential at +90 mV. The emulsion obtained was washed with water and chemically sensitized by substantially the same manner as in Em-F.

(Preparation of Em-I)

Em-I was prepared by substantially the same manner as in Em-H except that the temperature during nucleation was changed to 35° C.

(Preparation of Em-J)

An aqueous solution (1,200 mL) containing 0.38 g of phthalated gelatin with a phthalation ratio of 97% and a molecular weight of 100,000 and 0.9 g of KBr was kept at 60° C., and was vigorously stirred while maintaining the pH value at 2. An aqueous solution containing 1.96 g of $AgNO_3$ and an aqueous solution containing 1.67 g of KBr and 0.172 g of KI were added by the double-jet method over 30 sec. After completion of ripening, 12.8 g of trimellitated gelatin chemically modified with trimellitic acid was added. This gelatin contains 35 $\mu$mol of methionine per gram, and has a molecular weight of 100,000. After adjusting pH of the solution to 5.9, 2.99 g of KBr and 6.2 g of NaCl were added. An aqueous solution (60.7 mL) containing 27.3 g of $AgNO_3$ and an aqueous KBr solution were added by the double-jet method over 31 minutes while maintaining the silver potential at −50 mV against the calomel electrode. An aqueous solution containing 65.6 g of $AgNO_3$ and an aqueous KBr solution were added by the double-jet method over 37 minutes by accelerating the flow rate such that the final flow rate was 2.1 times the initial flow rate. The AgI fine grain emulsion used in Em-A was simultaneously added by accelerating the flow rate such that the silver iodide content was 6.5 mol % while maintaining the silver potential at −50 mV. After adding 1.5 mg of thiourea dioxide, 132 mL of an aqueous solution containing 41.8 g of $AgNO_3$ and an aqueous KBr solution were added by the double-jet method over 13 min. The amount of addition of the aqueous KBr solution was controlled such that the silver potential was +40 mV at the completion of the double-jet addition. After adding 2 mg of sodium benzenethiosulfate, the silver potential was adjusted to −100 mV by adding KBr. The AgI fine grain emulsion was added in an amount of 6.2 g in terms of KI weight. Immediately after completion of the addition, 300 mL of an aqueous solution containing 88.5 g of $AgNO_3$ were added over 8 min. The silver potential at the completion of the addition was so controlled by adding a KBr solution that the potential became +60 mV. After washing the emulsion with water, gelatin was added, and the pH and pAg were adjusted to 6.5 and 8.2, respectively, at 40° C. After adding the compounds 11 and 12, the temperature of the solution was increased to 61° C. After adding the sensitizing dyes 18, 19, 20 and 21, $K_2IrCl_6$, potassium thiocyanate, aurichloric aid, sodium thiosulfate and N,N-dimethyl selecourea were added for optimum chemical sensitization. The compounds 13 and 14 were added at the completion of the chemical sensitization.

Sensitizing dye 18

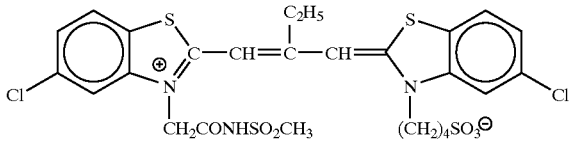

Sensitizing dye 19

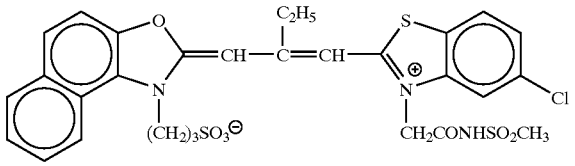

Sensitizing dye 20

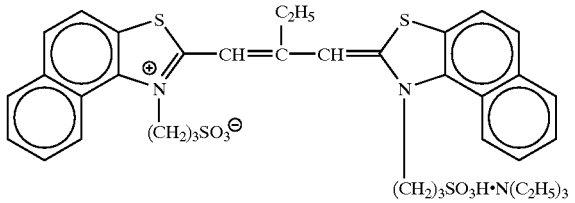

Sensitizing dye 21

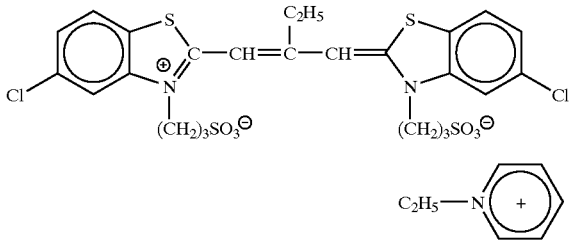

(Preparation of Em-K)

An aqueous solution (1,200 mL) containing 4.9 g of a low molecular weight gelatin with a molecular weight of 15,000 and 5.3 g of KBr was vigorously stirred while maintaining the temperature at 60° C. An aqueous solution (27 mL) containing 8.75 g of $AgNO_3$ and 36 mL of an aqueous solution containing 6.45 g of KBr were added by the double-jet method over 1 min. After increasing the temperature to 75° C., 21 mL of an aqueous solution containing 6.9 g of $AgNO_3$ was added over 2 min. After sequentially adding 26 g of $NH_4NO_3$ and 56 mL of 1N NaOH, the solution was ripened, and pH at the end of the ripening was adjusted to 4.8. An aqueous solution (438 mL) containing 141 g of $AgNO_3$ and an aqueous solution (458 mL) containing 102.6 g of KBr were added by the double-jet method by accelerating the flow rate such that the final flow rate was 4 times the initial flow rate. After decreasing the temperature to 55° C., 240 mL of an aqueous solution containing 7.1 g of $AgNO_3$ and an aqueous solution containing 6.46 g of KI were added by the double-jet method over 5 minutes. After adding 7.1 g of KBr, 4 mg of sodium benzenethiosulfonate and 0.05 mg of $K_2IrCl_6$ were added. An aqueous solution (177 mL) containing 57.2 g of $AgNO_3$ and an aqueous solution (223 mL) containing 40.2 g of KBr were added by the double-jet method over 8 min. The emulsion obtained was washed with water, and was chemically sensitized by substantially the same manner as in Em-J.

(Preparation of Em-L)

Em-L was prepared by substantially the same manner as in Em-K, except that the temperature during nucleation was changed to 40° C.

(Preparation of Em-M, Em-N and Em-O)

Em-M, Em-N and Em-O were prepared by substantially the same manner as in Em-H or Em-I except that they were chemically sensitized by substantially the same manner as in Em-J.

Characteristic values of the silver halide emulsions Em-A through Em-O are summarized in Table 4.

TABLE 4

| Emulsion No. | ECD (μm) COV (%) | Thickness (μm) COV (%) | Aspect ratio COV (%) | Tabularity | Twin plane spacing (μm) COV (%) | Ratio of tabular grains (%) | (100) face ratio to side faces (%) | Silver iodide content (mol %) COV (%) | Silver chloride content (mol %) | Surface silver iodide content (mol %) |
|---|---|---|---|---|---|---|---|---|---|---|
| Em-A | 1.98<br>23 | 0.198<br>28 | 10<br>35 | 51 | 0.014<br>32 | 92 | 23 | 15<br>17 | 0 | 4.3 |
| Em-B | 1.30<br>25 | 0.108<br>27 | 12<br>38 | 111 | 0.013<br>30 | 93 | 22 | 11<br>16 | 0 | 3.6 |
| Em-C | 1.00<br>27 | 0.083<br>26 | 12<br>37 | 145 | 0.012<br>30 | 93 | 18 | 4<br>8 | 1 | 1.8 |
| Em-D | 0.75<br>31 | 0.075<br>18 | 10<br>29 | 133 | 0.010<br>27 | 91 | 33 | 4<br>8 | 2 | 1.9 |
| Em-E | 2.02<br>31 | 0.101<br>19 | 20<br>42 | 198 | 0.013<br>33 | 99 | 20 | 7<br>7 | 0 | 2.4 |
| Em-F | 1.54<br>26 | 0.077<br>18 | 20<br>33 | 260 | 0.013<br>26 | 99 | 23 | 7<br>7 | 0 | 2.5 |
| Em-G | 1.08<br>18 | 0.072<br>15 | 15<br>19 | 208 | 0.008<br>22 | 97 | 23 | 6<br>5 | 0 | 2.0 |
| Em-H | 0.44<br>16 | 0.22<br>13 | 2<br>9 | 9 | 0. 013<br>18 | 90 | 38 | 3<br>6 | 2 | 1 |
| Em-I | 0.33<br>17 | 0.165<br>13 | 2<br>12 | 12 | 0.013<br>18 | 88 | 42 | 3<br>6 | 2 | 1 |
| Em-J | 1.83<br>18 | 0.122<br>20 | 15<br>22 | 123 | 0.012<br>19 | 98 | 23 | 5<br>6 | 1 | 1.8 |
| Em-K | 1.09<br>16 | 0.156<br>18 | 7<br>19 | 45 | 0.013<br>16 | 99 | 22 | 3<br>7 | 0 | 2.7 |
| Em-L | 0.84<br>17 | 0.12<br>18 | 7<br>19 | 58 | 0.013<br>16 | 99 | 25 | 3<br>7 | 0 | 2.7 |
| Em-M | 0.55<br>16 | 0.275<br>13 | 2<br>9 | 7 | 0.013<br>18 | 90 | 38 | 2<br>6 | 2 | 1 |
| Em-N | 0.44<br>17 | 0.22<br>13 | 2<br>12 | 9 | 0.013<br>18 | 88 | 42 | 2<br>6 | 2 | 1 |
| Em-O | 0.33<br>17 | 0.165<br>13 | 2<br>12 | 12 | 0.013<br>18 | 88 | 46 | 1<br>6 | 2 | 0.5 |

ECD = Equivalent circle diameter; COV = Coefficient of variation; Ratio of tabular grains = Ratio of tabular grains to the total projected area 1) Support A support used in this Example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and 0.22 g/m$^2$ of resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH—C_6H_3(CH_3)NCO)_3$ as a hardener and acetone, methylethylketone, and cyclohexane as solvents, thereby forming a 1.2-m thick magnetic recording layer. 10 mg/m$^2$ of silica grains (0.3 μm) were added as a matting agent, and 10 mg/m$^2$ of aluminum oxide (0.15 μm) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of DB of the magnetic recording layer measured by an X-light (blue filter) was about 0.1. The saturation magnetization moment, coercive force, and squareness ratio of the magnetic recording layer were 4.2 Am$^2$/kg, 7.3×104 A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-poly(polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmø stainless steel hard sphere, load 10 g, speed 6 cm/min), and the coefficient of static friction was 0.07 (clip method). The coefficient of kinetic friction between an emulsion surface (to be described later) and the slip layer also was excellent, 0.12.

4) Coating of Lightsensitive Layer

Next, on the opposite side of the support of the back layer obtained by the above, layers of the following compositions were coated in a superposed manner to prepare a color negative photosensitive material of Sample 301. (Composition of lightsensitive layers)

Main materials used for the layers are classified into the following:

| | |
|---|---|
| ExC: cyan coupler | UV: ultraviolet absorbent |
| ExM: magenta coupler | HBS: high-boiling organic solvent |
| ExY: yellow coupler | H: gelatin hardener |

(Specific compounds are shown in the following description. Numerical values are described after the symbols, and their chemical formulae are shown thereafter.)

The figures corresponding to respective components indicate coating amounts in terms of g/m$^2$. With respect to silver halide, the figures indicate a coating amount in terms of silver.

| | | |
|---|---|---|
| 1st layer (first antihalation layer) | | |
| Black colloidal silver | silver | 0.155 |
| Surface-fogged AgBrI having an equivalent shpere diameter of 0.07 μm | silver | 0.01 |
| Gelatin | | 0.87 |
| ExC-1 | | 0.002 |
| ExC-2 | | 0.002 |
| Cpd-2 | | 0.001 |
| HBS-1 | | 0.004 |
| HBS-2 | | 0.002 |
| 2nd layer (second antihalation layer) | | |
| Black colloidal silver | silver | 0.066 |
| Gelatin | | 0.407 |
| ExM-1 | | 0.050 |
| ExF-1 | | $2.0 \times 10^{-3}$ |
| HBS-1 | | 0.074 |
| Solid dispersion dye ExF-2 | | 0.015 |
| Solid dispersion dye ExF-3 | | 0.020 |
| 3rd layer (intermediate layer) | | |
| AgBrI grains having an equivalent circle diameter of 0.07 μm | silver | 0.020 |
| ExC-2 | | 0.022 |
| HBS-1 | | 0.068 |
| Cpd-1 | | 0.075 |
| Polyethylacrylate latex | | 0.085 |
| Gelatin | | 0.294 |
| 4th layer (low-speed red sensitive emulsion layer) | | |
| Em-M | silver | 0.065 |
| Em-N | silver | 0.100 |
| Em-O | silver | 0.158 |
| ExC-1 | | 0.109 |
| ExC-3 | | 0.044 |
| ExC-4 | | 0.072 |
| ExC-5 | | 0.011 |
| ExC-6 | | 0.003 |
| ExC-7 | | 0.052 |
| Cpd-2 | | 0.025 |
| Cpd-4 | | 0.025 |
| HBS-1 | | 0.17 |
| Gelatin | | 0.80 |
| 5th layer (medium-speed red sensitive emulsion layer) | | |
| Em-K | silver | 0.21 |
| Em-L | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| ExC-10 | | 0.007 |
| Cpd-2 | | 0.036 |
| Cpd-4 | | 0.028 |
| HBS-1 | | 0.16 |
| Gelatin | | 1.18 |
| 6th layer (high-speed red sensitive emulsion layer) | | |
| Em-J | silver | 1.47 |
| ExC-1 | | 0.18 |
| ExC-3 | | 0.07 |
| ExC-6 | | 0.029 |
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |

-continued

| | | |
|---|---|---|
| 7th layer (intermediate layer) | | |
| Cpd-1 | | 0.089 |
| Solid dispersion dye ExF-4 | | 0.030 |
| HBS-1 | | 0.050 |
| polyethylacrylate latex | | 0.83 |
| Gelatin | | 0.84 |
| 8th layer (layer for donating interlayer effect to red-sensitive layer) | | |
| Em-E | silver | 0.560 |
| Cpd-4 | | 0.030 |
| ExM-2 | | 0.096 |
| ExM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |
| 9th layer (low-speed green sensitive emulsion layer) | | |
| Em-G | silver | 0.39 |
| Em-H | silver | 0.28 |
| Em-I | silver | 0.35 |
| ExM-2 | | 0.36 |
| ExM-3 | | 0.045 |
| ExC-9 | | 0.008 |
| ExG-1 | | 0.005 |
| HBS-1 | | 0.28 |
| HBS-3 | | 0.01 |
| HBS-4 | | 0.27 |
| Gelatin | | 1.39 |
| 10th layer (medium-speed green sensitive layer) | | |
| Em-F | silver | 0.20 |
| Em-G | silver | 0.25 |
| ExC-6 | | 0.005 |
| ExC-10 | | 0.005 |
| ExC-9 | | 0.004 |
| ExM-2 | | 0.031 |
| ExM-3 | | 0.029 |
| ExY-1 | | 0.006 |
| ExM-4 | | 0.028 |
| ExG-1 | | 0.005 |
| HBS-1 | | 0.064 |
| HBS-2 | | $2.1 \times 10^{-3}$ |
| Gelatin | | 0.44 |
| 11th layer (high-speed green sensitive emulsion layer) | | |
| Em-A | silver | 0.99 |
| ExC-6 | | 0.004 |
| ExC-10 | | 0.007 |
| ExC-9 | | 0.002 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| ExG-1 | | 0.005 |
| Epd-4 | | 0.007 |
| HBS-1 | | 0.18 |
| Polyethylacrylate latex | | 0.099 |
| Gelatin | | 1.11 |
| 12th layer (yellow filter layer) | | |
| yellow colloidal silver | silver | 0.047 |
| Cpd-1 | | 0.16 |
| Solid dispersion dye ExF-5 | | 0.010 |
| Solid dispersion dye ExF-6 | | 0.010 |
| HBS-1 | | 0.082 |
| Gelatin | | 1.057 |

-continued

| | | |
|---|---|---|
| 13th layer (low-speed blue sensitive emulsion layer) | | |
| Em-B | silver | 0.18 |
| Em-C | silver | 0.20 |
| Em-D | silver | 0.07 |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| 14th layer (high-speed blue sensitive emulsion layer) | | |
| Emulsion A-1 of Example 1 silver | | 0.75 |
| ExC-1 | | 0.013 |
| ExY-2 | | 0.31 |
| ExY-3 | | 0.05 |
| ExY-6 | | 0.062 |
| Compound $B_2$-2 | | (The addition amount is described in Table 5) |
| HBS-1 | | 0.10 |
| Gelatin | | 0.91 |
| 15th layer (first protective layer) | | |
| AgBrI grains having an equivalent sphere diameter of 0.07 μm | silver | 0.30 |
| UV-1 | | 0.21 |
| UV-2 | | 0.10 |
| UV-3 | | 0.18 |
| UV-4 | | 0.025 |
| UV-5 | | 0.07 |
| F-18 | | 0.009 |
| F-19 | | 0.005 |
| F-20 | | 0.005 |
| HBS-1 | | 0.12 |
| HBS-4 | | $5.0 \times 10^{-2}$ |
| Gelatin | | 2.3 |
| 16th layer (second protective layer) | | |
| H-1 | | 0.40 |
| B-1 (diameter 1.7 μm) | | $5.0 \times 10^{-2}$ |
| B-2 (diameter 1.7 μm) | | 0.15 |
| B-3 | | 0.05 |
| S-1 | | 0.20 |
| Gelatin | | 0.75 |

In addition to the above components, to improve the storability, processability, resistance to pressure, antiseptic and mildewproofing properties, antistatic property and coating property the individual layers contained W-1 to W-5, B-4 to B-6, and F-1 to F-18, and iron salt, lead salt, gold salt, platinum salt, palladium salt, iridium salt, ruthenium salt and rhodium salt. Also in the coating liquids for the 8th and the 11th layers, $8.5\times10^{-3}$ g and $7.9\times10^{-3}$ g, respectively, per mol of silver halide of calcium was added in the form of calcium nitrate aqueous solution, thereby preparing samples.

Samples 302 to 305 were prepared in the same manner as Sample 301 except that Emulsion A-1 prepared in Example 1 and contained in the 14th layer was replaces with Emulsions A-2, A-4, A-7 and A-10, respectively. Further, Samples 306 to 309 were prepared in the same manner as Sample 302 to 305, respectively, except that compound Example $B_2$-2 was added to each emulsion.

Preparation of Dispersions of Organic Solid Disperse Dyes

ExF-3 was dispersed by the following method. That is, 21.7 mL of water, 3 mL of a 5% aqueous solution of p-octylphenoxyethoxyethoxyethanesulfonate soda, and 0.5 g of a 5% aqueous solution of p-octylphenoxy-polyoxyethyleneether (polymerization degree 10) were placed in a 700-mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K.K. The dispersion was extracted from the mill and added to 8 g of a 12.5% aqueous solution of gelatin. The beads were filtered away to obtain a gelatin dispersion of the solid dispersion dye ExF-3. The average grain size of the fine dye grains was 0.44 μm.

Following the same procedure as above, solid dispersions ExF-4 was obtained. The average grain sizes of these fine dye grains was 0.45 μm. ExF-2 was dispersed by a micro-precipitation dispersion method described in Example 1 of EP549,489A. The average grain size was found to be 0.06 μm.

A solid dispersion ExF-6 was dispersed by the following method. 4000 g of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

Compounds used in the formation of each layer were as follows.

ExC-1

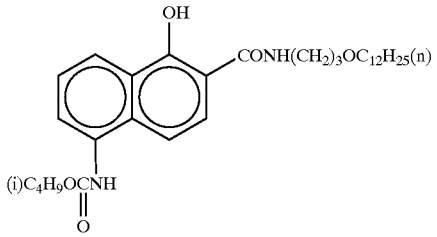

ExC-2

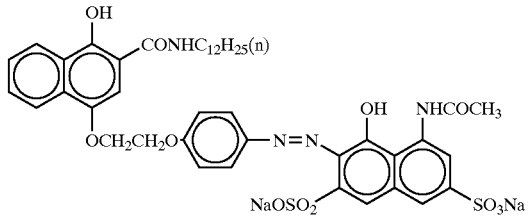

ExC-3

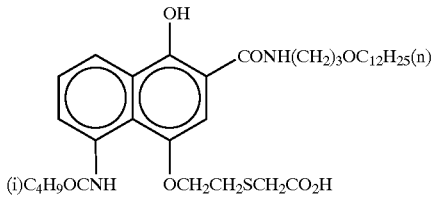

ExC-4

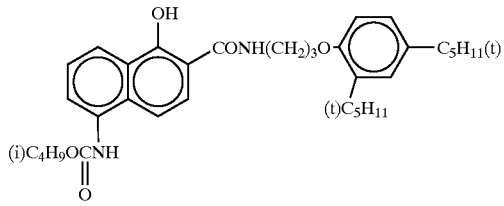

ExC-5

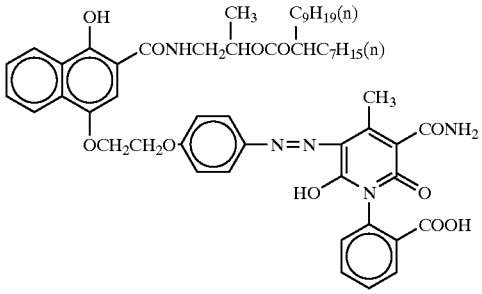

ExC-6

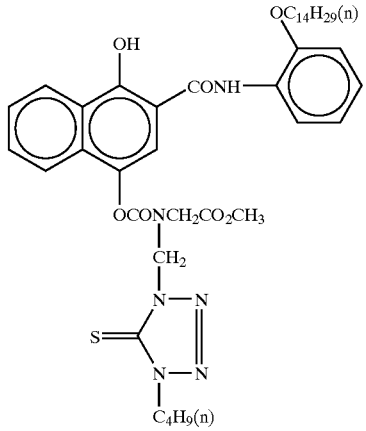

-continued
ExC-7
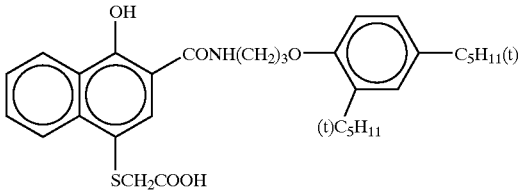
ExC-8
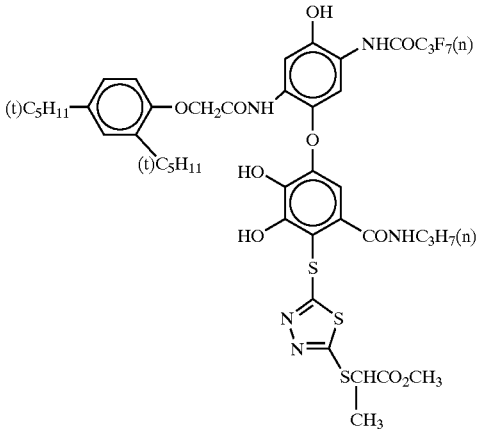
ExC-9
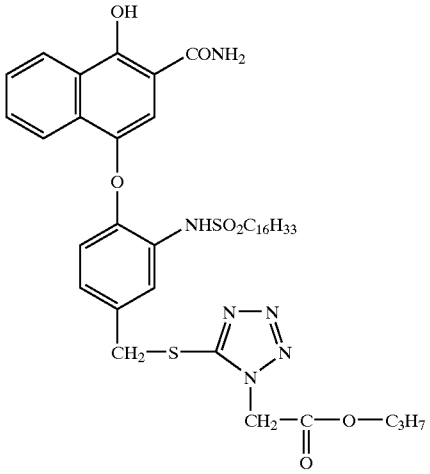
ExC-10
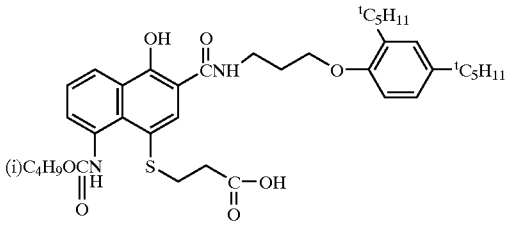
ExM-1
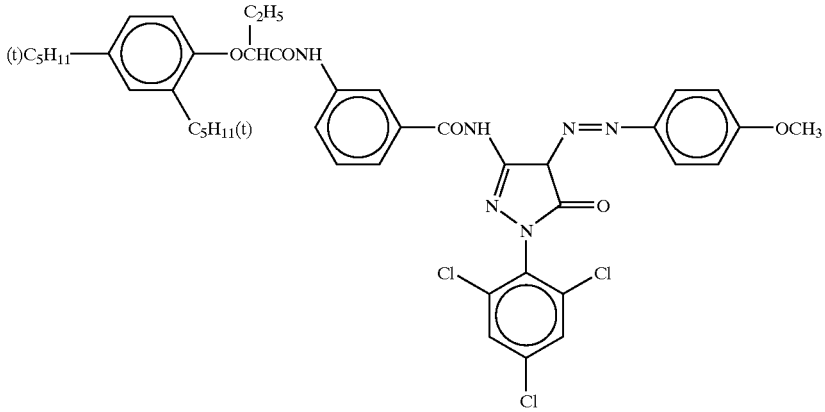

-continued
ExM-2
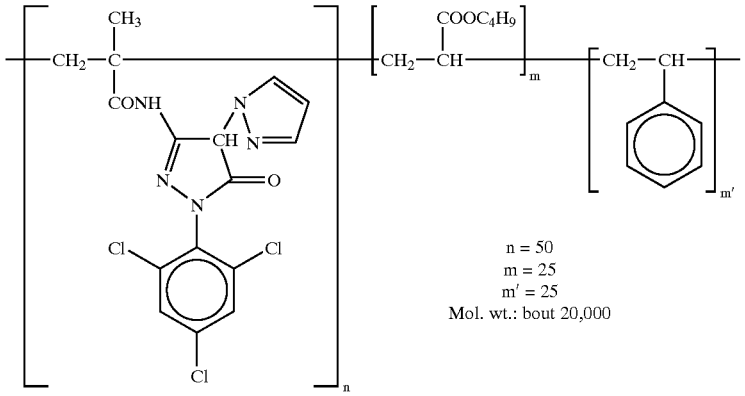
ExM-3
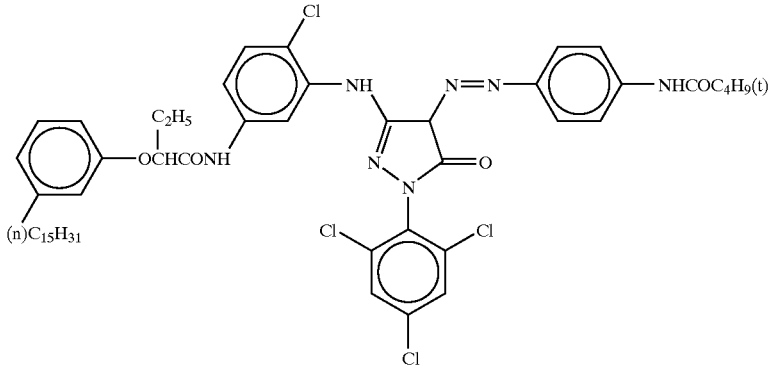
ExM-4
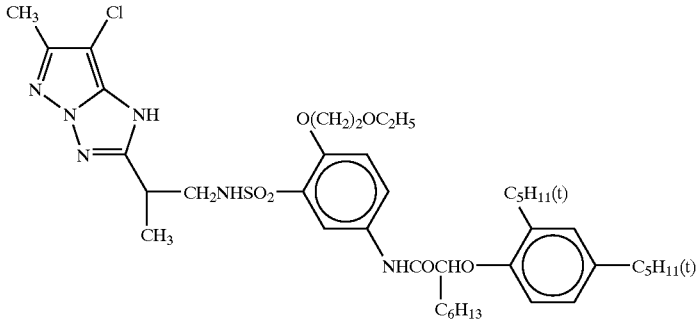
ExM-5
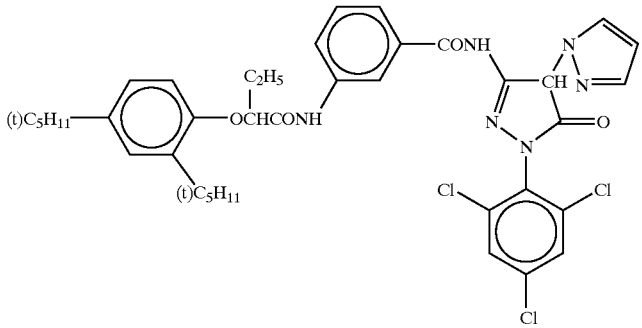

-continued
ExY-1
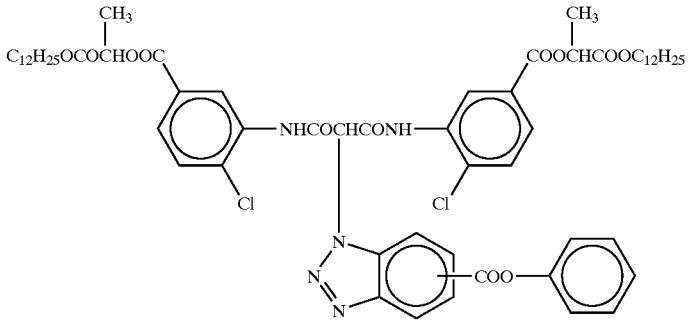
ExY-2
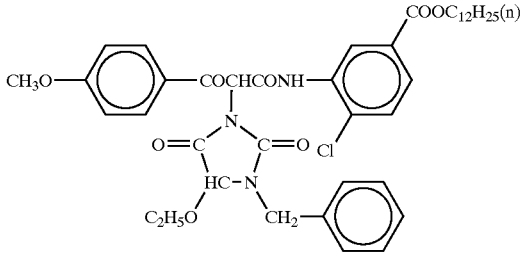
ExY-3
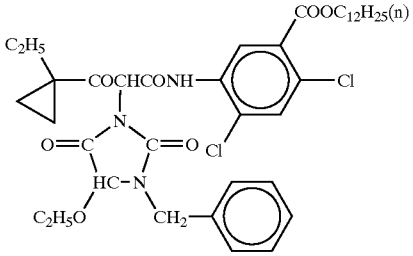
ExY-4
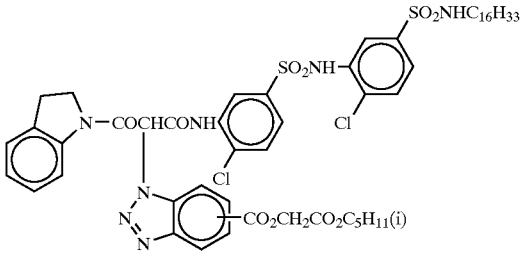
ExY-5
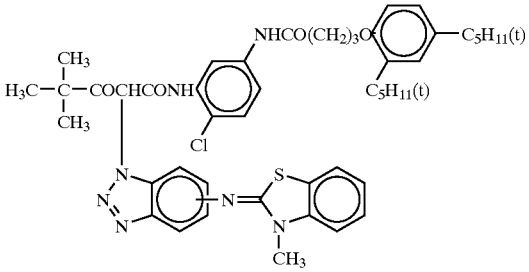
ExG-1
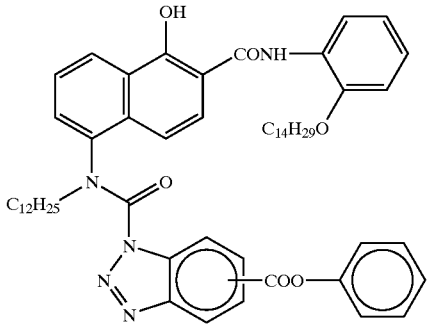
ExY-6
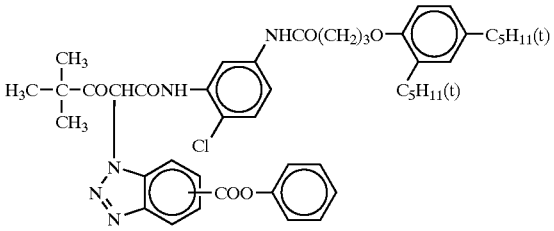
ExF-1
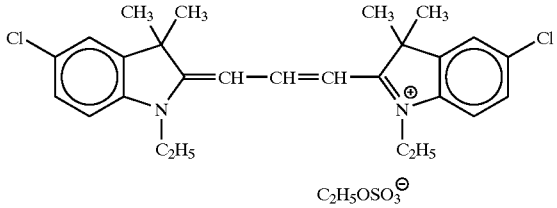
ExF-2
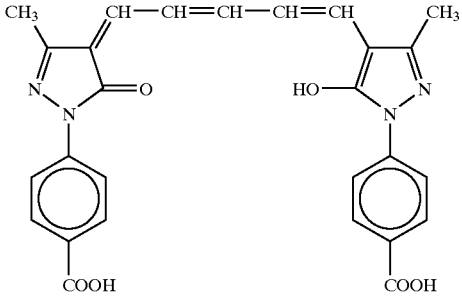

-continued
ExF-3
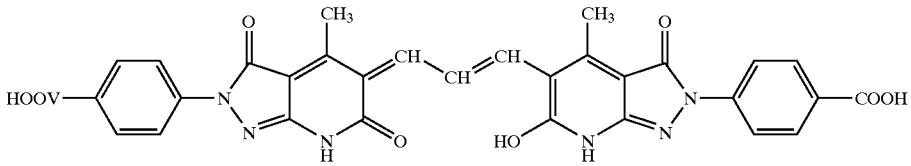
ExF-4
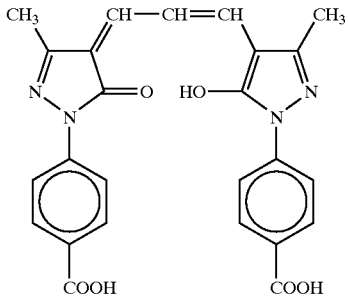
ExF-5
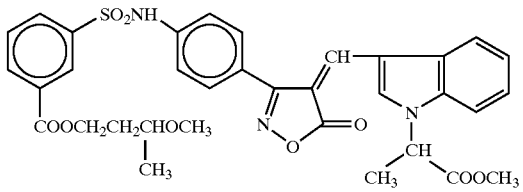
ExF-6
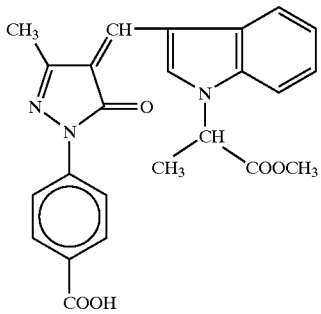
Cpd-1
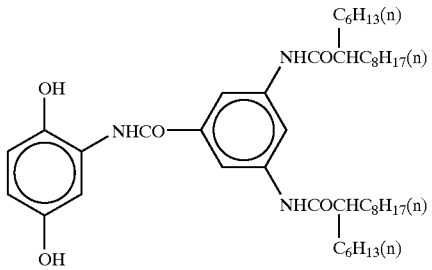
Cpd-2
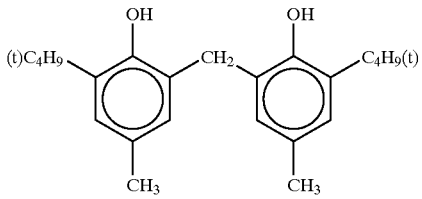
Cpd-3
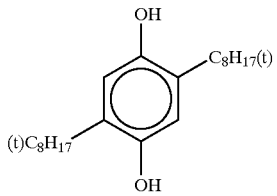
Cpd-4
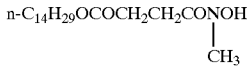
UV-1
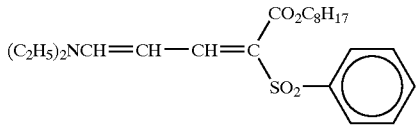
UV-2
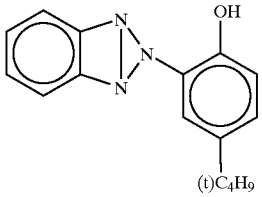
UV-3
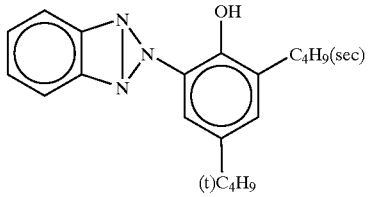
UV-4
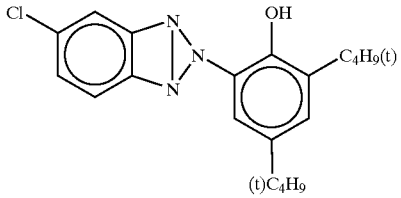
UV-5
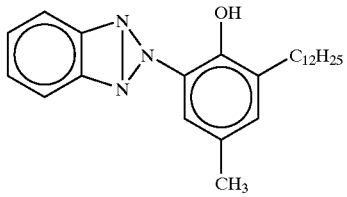

-continued
HBS-1
Tricresyl phosphate
HBS-2
Di-n-butyl phthalate
HBS-3
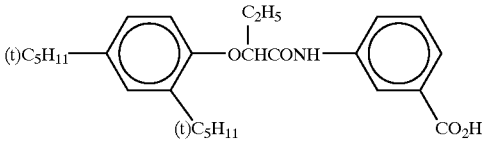
HBS-4
Tri(2-ethylhexyl) phosphate
H-1
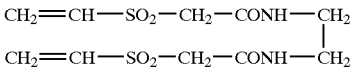
H-2
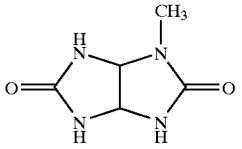
B-1
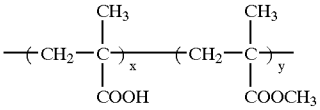
x/y = 10/90 (wt. ratio)
Av. mol. wt.: about 35,000
B-2
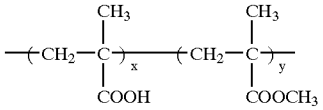
x/y = 40/60 (wt. ratio)
Av. mol. wt.: about 20,000
B-3
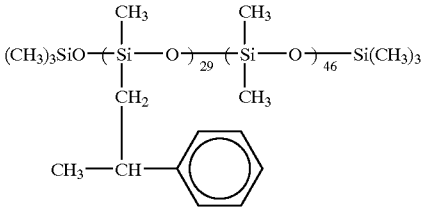
(Molar ratio)
Average mol. wt.: about 8,000
B-4
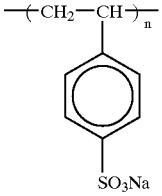
Av. mol. wt.: about 750,000
B-5
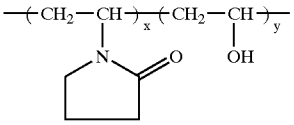
x/y = 70/30 (wt. ration)
Av. mol. wt.: about 17,000
B-6
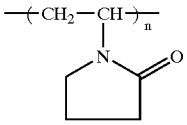
Av. mol. wt.: about 10,000
W-1
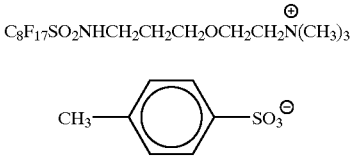
W-2
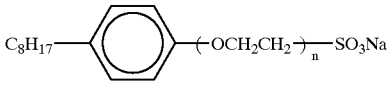
n = 2-4
W-3
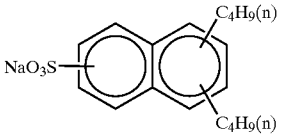
W-4
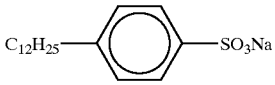
W-5
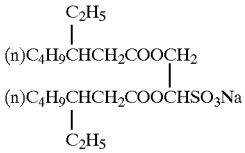
F-1
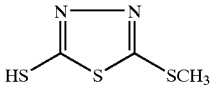

-continued
F-2
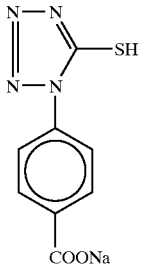
F-3
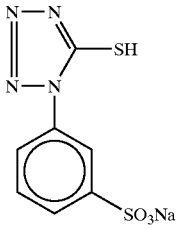
F-4
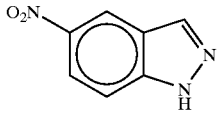
F-5
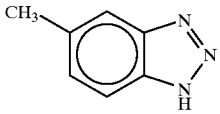
F-6
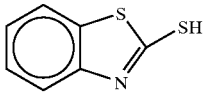
F-7
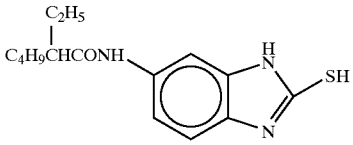
F-8
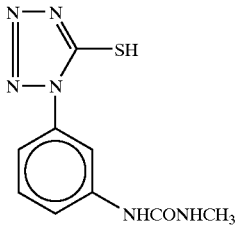
F-9
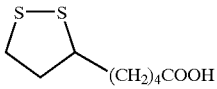
F-10
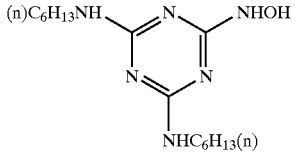
F-11
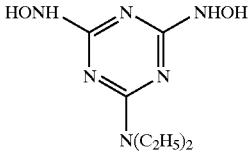
F-12
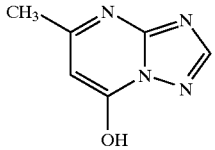
F-13
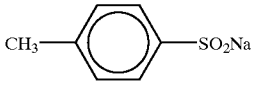
F-14
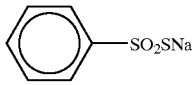
F-15
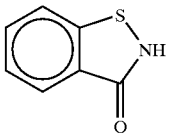
F-16
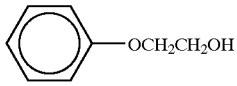
F-17
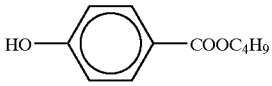
F18
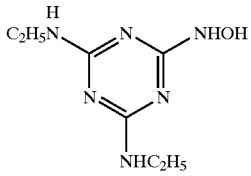
F-19
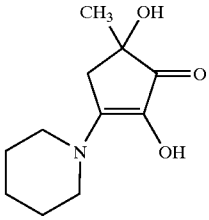

-continued

F-20

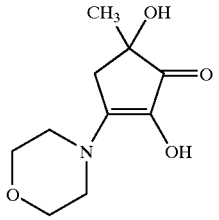

These samples were exposed for 1/100 sec through a gelatin filter SC-39 (a long-wavelength light transmitting filter having a cutoff wavelength of 390 nm) manufactured by Fuji Photo Film Co., Ltd. and a continuous wedge. Development was performed as follows by using an automatic developer FP-360B manufactured by Fuji Photo Film Co., Ltd. Note that FP-360B was modified such that the overflow solution of the bleaching bath was entirely discharged to a waste solution tank without being supplied to the subsequent bath. This FP-360B includes an evaporation correcting means described in JIII Journal of Technical Disclosure No. 94-4992.

The processing steps and the processing solution compositions are presented below.

(Processing Steps)

| Step | Time | Temperature | Replenishing rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide sensitized material (equivalent to one 24 Ex. 1)

The stabilizer and fixer were counterflowed from (2) to (1), and the overflow of washing water was entirely introduced to the fixing bath (2). Note that the amounts of the developer, bleaching solution, and fixer carried over to the bleaching step, fixing step, and washing step were 2.5 mL, 2.0 mL, and 2.0 mL, respectively, per 1.1 m of a 35-mm wide sensitized material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| | Tank solution (g) | Replenisher (g) |
|---|---|---|
| (Color developer) | | |
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (controlled by aqueous ammonia) | 4.6 | 4.0 |

(Fixing (1) tank solution)

A 5:95 (volume ratio) mixture of the above bleaching tank solution and the following fixing tank solution (pH 6.8).

| (Fixer (2)) | Tank solution (g) | Replenisher (g) |
|---|---|---|
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (adjusted by aqueous ammonia and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

(Stabilizer) Common to Tank Solution and Replenisher

| | |
|---|---|
| Sodium p-toluenesulfinate | 0.03 |
| Polyoxyethylene-p-monononylphenylether (average polymerization degree 10) | 0.2 |
| 1,2-benzoisothiazoline-3-one.sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 L |
| pH | 8.5 |

Yellow density of the thus processed samples were measured by using a blue filter to evaluate fresh photographic property. The speed of each sample was indicated by a relative value of a reciprocal of an exposure amount required to give the density of the fog density plus 0.2.

Further, the same samples as samples 301 to 319 were separately prepared. After the same film hardening, they were left to stand under the conditions of 50° C. in 80% RH for 3 days. The thus prepared samples were exposed to light, developed and evaluated in the same manner as above, to evaluate raw stock storability.

The results are set forth in Table 5.

Example 4

The samples corresponding to the sample 505 in Example 5 described in JP-A-2001-142170 were prepared by adding the compound 56, 24 or G-1 according to the invention that is a compound capable of releasing a electron, and the compound $B_1$-10, $B_3$-12 or $B_6$-2 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_{10}$-3 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by using the compound capable of releasing an electron of the invention in combination with the reducing compound having a C/H value of 3 or less and the reducing compound having a C/H value of more than 3, in photosensitive materials whose pressure property is improved by tabular grains of large size region. The same can be applied to the combined use of the compound capable of releasing an electron with the reducing compound having a molecular weight of 300 or less and the reducing compound having a molecular weight of more than 300, in the photosensitive materials.

Example 5

The samples corresponding to the sample 202 in Example 4 described in JP-A-2001-159799 were prepared by adding the compound 11, 35 or G-12 according to the invention that is a compound capable of releasing a electron, and the compound $B_{11}$-1, $B_1$-1 or $B_4$-1 that is a reducing compound having a C/H value of 3 or less and/or that having a molecular weight of 300 or less, in the high-speed and low-speed blue sensitive emulsion layers, high-speed, medium-speed and low-speed green sensitive emulsion

TABLE 5

| Sample | Emulsion of 14th layer | Speed-increasing compound (addition amount) | Reducing compound of C/H ≦ 3.0 and/or M.W. ≦ 300 (Addition amount) | Reducing compound of C/H > 3.0 and/or M.W. > 300 (Addition amount) | B filter Fresh photographic property Dmin | B filter Fresh photographic property Relative speed | B filter Raw stock storability Dmin | B filter Raw stock storability Relative speed | Remarks |
|---|---|---|---|---|---|---|---|---|---|
| 301 | A-1 | none | none | none | 0.25 | 100 (control) | 0.30 | 94 | Comp. |
| 302 | A-2 | Compound example 24 ($8 \times 10^{-6}$/Ag) | none | none | 0.34 | 136 | 0.47 | 125 | Comp. |
| 303 | A-4 | Compound example 11 ($8 \times 10^{-6}$/Ag) | none | none | 0.37 | 143 | 0.50 | 131 | Comp. |
| 304 | A-7 | Compound example 24 ($8 \times 10^{-6}$/Ag) | $B_1^{-1}$ ($1 \times 10^{-3}$ mol/Ag) | none | 0.31 | 138 | 0.43 | 130 | Comp. |
| 305 | A-10 | Compound example 11 ($8 \times 10^{-6}$/Ag) | $B_1^{-1}$ ($1 \times 10^{-3}$ mol/Ag) | none | 0.33 | 145 | 0.45 | 135 | Comp. |
| 306 | A-2 | Compound example 24 ($8 \times 10^{-6}$/Ag) | none | $B_2^{-2}$ ($1 \times 10^{-2}$ mol/Ag) | 0.29 | 136 | 0.41 | 131 | Comp. |
| 307 | A-4 | Compound example 11 ($8 \times 10^{-6}$/Ag) | none | $B_2^{-2}$ ($1 \times 10^{-2}$ mol/Ag) | 0.30 | 146 | 0.42 | 138 | Comp. |
| 308 | A-7 | Compound example 24 ($8 \times 10^{-6}$/Ag) | $B_1^{-1}$ ($1 \times 10^{-3}$ mol/Ag) | $B_2^{-2}$ ($1 \times 10^{-2}$ mol/Ag) | 0.26 | 144 | 0.32 | 140 | Inv. |
| 309 | A-10 | Compound example 11 ($8 \times 10^{-6}$/Ag) | $B_1^{-1}$ ($1 \times 10^{-3}$ mol/Ag) | $B_2^{-2}$ ($1 \times 10^{-2}$ mol/Ag) | 0.28 | 151 | 0.33 | 146 | Inv. |

Table 5 clearly shows that, also in a full color photosensitive material containing silver halide emulsions defined in the specification, the use of the compound Example 24 or 11 in combination with compound examples $B_1$-1 and $B_2$-2, can provide a photosensitive material whose speed is high, fog in fresh photograph is suppressed and storability is improved, can be obtained.

layers, and high-speed, medium-speed and low-speed red sensitive emulsion layers; and by allowing the compound $B_8$-10 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in large size tabular emulsions of high speed and low processing dependency. The same can be applied to the triple combined use of the compound capable of releasing an electron, the reducing compound having a molecular weight of 300 or less and the reducing compound having a molecular weight of more than 300, in the emulsions.

Example 6

The samples corresponding to the sample 905 in Example 7 described in JP-A-2000-347336 were prepared by adding the compound 56, 40 or 25 according to the invention that is a compound capable of releasing a electron, and the compound $B_6$-3, $B_9$-7 or $B_1$-15 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_2$-2 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in photosensitive materials containing inorganic fine particles in emulsion dispersion medium. The same can be applied to the triple combined use of the compound capable of releasing an electron, the reducing compound having a molecular weight of 300 or less and the reducing compound having a molecular weight of more than 300, in the photosensitive materials.

Example 7

The samples corresponding to the sample 904 in Example 9 described in JP-A-11-295832 were prepared by adding the compound 11, 32 or G-12 according to the invention that is a compound capable of releasing a electron, and the compound $B_1$-1, $B_{11}$-11 or $B_4$-1 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_1$-3 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in emulsions containing grains having high-iodide layer formed by rapidly generating iodide ions from iodide ion-releasing agents. The same can be applied to the triple combined use of the compound capable of releasing an electron, the reducing compound having a molecular weight of 300 or less and the reducing compound having a molecular weight of more than 300, in the emulsions.

Example 8

The samples corresponding to the sample 222 in Example 8 described in JP-A-2000-321698 were prepared by adding the compound 56, 25 or 35 according to the invention that is a compound capable of releasing a electron, and the compound $B_9$-7, $B_6$-2 or $B_{11}$-8 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_{10}$-2 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in emulsions containing grains having aspect ratio of 8 or more, an average iodide content of 2 mol % or more, dislocation lines of 10 or more and coefficient of variation of iodide distribution among grains of 20% or less. The same can be applied to the triple combined use of the compound capable of releasing an electron, the reducing compound having a molecular weight of 300 or less and the reducing compound having a molecular weight of more than 300, in the emulsions.

Example 9

The samples corresponding to the sample 109 in Example 1 described in JP-A-2000-231175 were prepared by adding the compound 11, 23 or 24 according to the invention that is a compound capable of releasing a electron, and the compound $B_1$-15, $B_{11}$-11 or $B_1$-10 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_2$-2 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention. The same can be applied to the triple combined use of the compound capable of releasing an electron, the reducing compound having a molecular weight of 300 or less and the reducing compound having a molecular weight of more than 300.

Example 10

The samples corresponding to the sample 302 in Example 3 described in JP-A-2001-324773 were prepared by adding the compound 11, 25 or G-24 according to the invention that is a compound capable of releasing a electron, and the compound $B_1$-10, $B_3$-12 or $B_6$-2 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_{10}$-3 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention. The same can be applied to the triple combined use of the compound capable of releasing an electron, the reducing compound having a molecular weight of 300 or less and the reducing compound having a molecular weight of more than 300.

Example 11

Samples 2301 to 2309 were prepared in the same manner as in Example 5 of the present specification except that infrared-absorbing dyes (62), (63), (64), (72), (74) and (87) described in JP-A-9-96891 were introduced to the 2nd layer of Example 5. The same evaluation as in Example 5 was conducted and excellent photographic property of high speed and low fog could be achieved.

Example 12

The samples corresponding to the sample 403 in Example 4 described in JP-A-2001-228572 were prepared by adding the compound 56, 25 or 35 according to the invention that is a compound capable of releasing a electron, and the compound $B_9$-7, $B_6$-2 or $B_{11}$-8 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_{10}$-2 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention in emulsions having a variation coefficient of equivalent circle diameter distribution of silver halide emulsion grains of 40 to 3%, containing silver iodochlorobromide tabular grains with (111) main planes, having equivalent circle diameter of 1.0 $\mu$m or more and grain thickness of 0.10 $\mu$m or less, and portion of edges or corners is not hollowed. The same can be applied to the triple combined use of the compound capable of releasing an electron, the reducing compound having a molecular weight of 300 or less and the reducing compound having a molecular weight of more than 300, in the emulsions.

Example 13

The samples corresponding to the sample in Example 6 described in JP-A-2001-264911 were prepared by adding the compound 11, 32 or G-24 according to the invention that is a compound capable of releasing a electron, and the compound $B_{11}$-1, $B_1$-1 or $B_4$-1 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_8$-10 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in photosensitive materials whose pressure property and storability are improved. The same can be applied to the triple combined use of the compound capable of releasing an electron, the reducing compound having a molecular weight of 300 or less and the reducing compound having a molecular weight of more than 300, in the photosensitive materials.

Example 14

The samples corresponding to the sample 713 in Example 7 described in JP-A-2001-281778 were prepared by adding the compound 56, 60 or 25 according to the invention that is a compound capable of releasing a electron, and the compound $B_6$-3, $B_9$-7 or $B_1$-15 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_2$-2 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in emulsions of silver iodochlorobromide grains each having a thickness of 0.1 $\mu$m or less, having an electron-trapping zone, having no annual grow ring observed inside thereof and having a silver iodobromide phase. The same can be applied to the triple combined use of the compound capable of releasing an electron, the reducing compound having a molecular weight of 300 or less and the reducing compound having a molecular weight of more than 300, in the emulsions.

Example 15

The samples corresponding to the sample 205 in Example 2 described in JP-A-2001-296627 were prepared by adding the compound 11, 60 or G-1 according to the invention that is a compound capable of releasing a electron, and the compound $B_1$-10, $B_3$-12 or $B_6$-2 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_{10}$-3 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in emulsions in which non-tabular grains, especially stick-like grains were reduced to generate during tabular grain preparation. The same can be applied to the triple combined use of the compound capable of releasing an electron, the reducing compound having a molecular weight of 300 or less and the reducing compound having a molecular weight of more than 300, in the emulsions.

Example 16

The samples corresponding to the sample 303 in Example 3 described in JP-A-2002-169240 were prepared by adding the compound 1, 23 or 25 according to the invention that is a compound capable of releasing a electron, and the compound $B_6$-3, $B_9$-7 or $B_1$-15 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_2$-2 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in emulsions whose aging stability in dissolved state is improved. The same can be applied to the triple combined use of the compound capable of releasing an electron, the reducing compound having a molecular weight of 300 or less and the reducing compound having a molecular weight of more than 300, in the emulsions.

Example 17

The samples corresponding to the sample 205 in Example 2 described in JP-A-2001-255613 were prepared by adding the compound 60, 11 or G-24 according to the invention that is a compound capable of releasing a electron, and the compound $B_1$-10, $B_3$-12 or $B_6$-2 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_{10}$-3 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, with large size region tabular grains having small pressure-induced fog. The same can be applied to the triple combined use of the compound capable of releasing an electron, the reducing compound having a molecular weight of 300 or less and the reducing compound having a molecular weight of more than 300, with the grains.

Example 18

The samples corresponding to the sample 304 in Example 3 described in JP-A-2002-268162 were prepared by adding the compound 1, 11 or 43 according to the invention that is a compound capable of releasing a electron, and the compound $B_1$-1, $B_{11}$-l1 or $B_4$-1 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_1$-3 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, with tabular grains whose fog during aging storage is reduced. The same can be applied to the triple combined use of the compound capable of releasing an electron, the reducing compound having a molecular weight of 300 or less and the reducing compound having a molecular weight of more than 300, with the tabular grains.

Example 19

The samples corresponding to the sample 209 in Example 3 described in JP-A-2001-235821 were prepared by adding the compound 11, 60 or 24 according to the invention that is a compound capable of releasing a electron, and the compound $B_1$-1, $B_{11}$-11 or $B_3$-12 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_1$-3 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in perfect epitaxial emulsions with silver chloride content of 1 to 6 mol % and silver iodide content of 0.5 to 10 mol %. The same can be applied to the triple combined use of the compound capable of releasing an electron, the reducing compound having a molecular weight of 300 or less and the reducing compound having a molecular weight of more than 300, in the emulsions.

Example 20

The samples corresponding to the sample 202 in Example 4 described in JP-A-2002-169241 were prepared by adding the compound 1, 56 or 32 according to the invention that is a compound capable of releasing a electron, and the compound $B_{11}$-1, $B_1$-15 or $B_6$-2 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_2$-2 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in emulsions comprising silver iodochlorobromide tabular grains having (111) planes as main planes and having an epitaxial junction on at least one apex portion. The same can be applied to the triple combined use of the compound capable of releasing an electron, the reducing compound having a molecular weight of 300 or less and the reducing compound having a molecular weight of more than 300, in the emulsions.

Example 21

The samples corresponding to one in Example 3 described in JP-A-2002-278008 were prepared by adding the compound 11, 60 or G-24 according to the invention that is a compound capable of releasing a electron, and the compound $B_1$-10, $B_3$-12 or $B_6$-2 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_{10}$-3 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in emulsions comprising silver iodochlorobromide tabular grains having (111) planes as main planes and having an epitaxial junction portion whose silver chloride content is 5 to 25 mol % on at least on apex portion of the hexagon of the tabular gain. The same can be applied to the triple combined use of the compound capable of releasing an electron, the reducing compound having a molecular weight of 300 or less and the reducing compound having a molecular weight of more than 300, in the emulsions.

Example 22

The samples corresponding to the sample 303 in Example 3 described in JP-A-2002-169239 were prepared by adding the compound 1, 60 or 23 according to the invention that is a compound capable of releasing a electron, and the compound $B_1$-15, $B_{11}$-11 or $B_1$-10 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_2$-2 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in emulsions comprising silver iodochlorobromide tabular grains having (111) planes as main planes, having an equivalent circle diameter of 3 $\mu$m or more, an aspect ratio of 8 or more, and an epitaxial junction portion. The same can be applied to the triple combined use of the compound capable of releasing an electron, the reducing compound having a molecular weight of 300 or less and the reducing compound having a molecular weight of more than 300, in the emulsions.

Example 23

The samples corresponding to the sample 101 in Example 5 described in JP-A-7-134351 were prepared by adding the compound 11, 56 or G-24 according to the invention that is a compound capable of releasing a electron, and the compound $B_1$-1, $B_6$-2 or $B_9$-7 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_2$-2 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in photosensitive materials containing a hydrazine compound as a group adsorptive to silver halide. The same can be applied to the triple combined use of the compound capable of releasing an electron, the reducing compound having a molecular weight of 300 or less and the reducing compound having a molecular weight of more than 300, in the photosensitive materials.

Example 24

The samples corresponding to the sample 602 in Example 6 described in JP-A-2000-250157 were prepared by adding the compound 11, 60 or 32 according to the invention that is a compound capable of releasing a electron, and the compound $B_1$-1, $B_{11}$-1 or $B_4$-1 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_8$-10 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in photosensitive material containing a bispyrizinium salt compound. The same can be applied to the triple combined use of the compound capable of releasing an electron, the reducing compound having a molecular weight of 300 or less and the reducing compound having a molecular weight of more than 300, in the photosensitive materials.

Example 25

The samples corresponding to the sample 218 in Example 2 described in JP-A-9-251193 were prepared by adding the compound 1, 23 or 43 according to the invention that is a compound capable of releasing a electron, and the compound $B_1$-1, $B_{11}$-11 or $B_4$-1 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_1$-3 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in emulsions prepared by an emulsion preparation method using, in a dispersing solution during nucleation, a low molecular weight gelatin having a molecular weight of 70,000 to 1,000, and using, in growing process, chemically modified gelatin having chemical modification ratio to amino groups of 15 to 100%. The same can be applied to the triple combined use of the compound capable of releasing an electron, the reducing compound having a molecular weight of 300 or less and the reducing compound having a molecular weight of more than 300, in the emulsions.

Example 26

The samples corresponding to the sample 103 in Example 2 described in JP-A-2001-100343 were prepared by adding the compound 11, 60 or 32 according to the invention that is a compound capable of releasing a electron, and the compound $B_1$-1, $B_{11}$-1 or $B_1$-8 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_{10}$-3 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in emulsions prepared by an emulsion preparation method in which grain growth was conducted in the presence of a chemically modified gelatin or a low molecular weight gelatin in an amount of 40 wt % or more of the dispersing medium. The same can be applied to the triple combined use of the compound capable of releasing an electron, the reducing compound having a molecular weight of 300 or less and the reducing compound having a molecular weight of more than 300, in the emulsions.

Example 27

The samples corresponding to the sample 305 in Example 3 described in JP-A-2001-281780 were prepared by adding the compound 11, 56 or G-12 according to the invention that is a compound capable of releasing a electron, and the compound $B_1$-10, $B_3$-12 or $B_6$-2 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_2$-2 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in emulsions containing a large content of a high molecular weight gelatin component. The same can be applied to the triple combined use of the compound capable of releasing an electron, the reducing compound having a molecular weight of 300 or less and the reducing compound having a molecular weight of more than 300, in the emulsions.

Example 28

The samples corresponding to the sample 203 in Example 3 described in JP-A-3-39946 were prepared by adding the compound 11, 23 or 24 according to the invention that is a compound capable of releasing a electron, and the compound $B_1$-15, $B_{11}$-11 or $B_1$-10 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_2$-2 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in tabular emulsions containing mercaptobenzothiazole compounds. The same can be applied to the triple combined use of the compound capable of releasing an electron, the reducing compound having a molecular weight of 300 or less and the reducing compound having a molecular weight of more than 300, in the tabular emulsions.

Example 29

The samples corresponding to the sample 001 in Example 1 described in JP-A-2001-75242 were prepared by adding the compound 11, 23 or 40 according to the invention that is a compound capable of releasing a electron, and the compound $B_1$-15, $B_6$-3 or $B_9$-7 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_2$-2 that is a reducing compound having a C/H value of more than 3 and/or that having a molecular weight of more than 300, to be contained in emulsified dispersions containing dye-forming couplers to be used in respective lightsensitive layers.

Accordingly, samples with and without the compound capable of releasing an electron, with and without a reducing compound and with the combined reducing compounds, were prepared as in Example 1.

The same evaluation as in Example 1 was conducted.

It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in photosensitive materials that have high speed and that realized faithful color reproduction with extremely reduced greenish tint. The same can be applied to the triple combined use of the compound capable of releasing an electron, the reducing compound having a molecular weight of 300 or less and the reducing compound having a molecular weight of more than 300, in the photosensitive materials.

Example 30

The samples corresponding to the sample 3-2 in Example 10 described in JP-A-3-243944 were prepared by adding the compound 11, 56 or G-24 according to the invention that is a compound capable of releasing a electron, and the compound $B_1$-10, $B_3$-12 or $B_6$-2 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_1$-3 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 10 of JP-A-3-243944 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in photosensitive materials with enhanced stability to oxidation. The same can be applied to the triple combined use of the compound capable of releasing an electron, the reducing compound having a molecular weight of 300 or less and the reducing compound having a molecular weight of more than 300, in the photosensitive materials.

Example 31

The samples corresponding to the sample 303 in Example 4 described in EP 1139164A were prepared by adding the compound 1, 11 or 43 according to the invention that is a compound capable of releasing a electron, and the compound $B_1$-1, $B_{11}$-11 or $B_4$-1 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_2$-2 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in photosensitive materials having high speed, low residual color and improved graininess. The same can be applied to the triple combined use of the compound capable of releasing an electron, the reducing compound having a molecular weight of 300 or less and the reducing compound having a molecular weight of more than 300, in the photosensitive materials.

Example 32

The samples corresponding to the sample 107 in Example 1 described in JP-A-2001-75224 were prepared by adding the compound 56, 60 or 24 according to the invention that is a compound capable of releasing a electron, and the compound $B_1$-10, $B_3$-12 or $B_6$-2 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_{10}$-3 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in photosensitive materials that attained both high speed and low residual color. The same can be applied to the triple combined use of the compound capable of releasing an electron, the reducing compound having a molecular weight of 300 or less and the reducing compound having a molecular weight of more than 300, in the photosensitive materials.

Example 34

The samples corresponding to the sample 4 in Example 4 described in JP-A-2001-214082 were prepared by adding the compound 1, 11 or 43 according to the invention that is a compound capable of releasing a electron, and the compound $B_1$-10, $B_3$-12 or $B_6$-2 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_{10}$-3 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in photosensitive materials that attained both high speed and low residual color. The same can be applied to the triple combined use of the compound capable of releasing an electron, the reducing compound having a molecular weight of 300 or less and the reducing compound having a molecular weight of more than 300, in the photosensitive materials.

Example 35

The samples corresponding to the sample 604 in Example 2 described in JP-A-2001-290234 were prepared by adding the compound 11, 23 or G-12 according to the invention that is a compound capable of releasing a electron, and the compound $B_1$-1, $B_{11}$-11 or $B_4$-1 that is a reducing compound having a C/H value of 3 or less and/or that having a molecular weight of 300 or less, in the high-speed and low-speed blue sensitive emulsion layers, high-speed, medium-speed and low-speed green sensitive emulsion layers, and high-speed, medium-speed and low-speed red sensitive emulsion layers; and by allowing the compound $B_1$-3 that is a reducing compound having a C/H value of more than 3 and/or that having a molecular weight of more than 300, to be contained in emulsified dispersions containing dye-forming couplers to be used in respective lightsensitive layers. Accordingly, samples with and without the compound capable of releasing an electron, with and without a reducing compound and with the combined reducing compounds, were prepared as in Example 1.

The same evaluation as in Example 1 was conducted. It was revealed that excellent photographic property of high speed and low fog could be achieved by triple combination of the compound capable of releasing an electron, the reducing compound having a C/H value of 3 or less and the reducing compound having a C/H value of more than 3 according to the present invention, in photosensitive materials with high speed and improved long term storage-induced fog. The same can be applied to the triple combined use of the compound capable of releasing an electron, the reducing compound having a molecular weight of 300 or less and the reducing compound having a molecular weight of more than 300, in the photosensitive materials.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photosensitive material comprising at least one light sensitive silver halide emulsion layer on a support, wherein the silver halide photosensitive material contains:

at least one compound capable of undergoing a one-electron oxidation to thereby form a one-electron oxidation product thereof, the one-electron oxidation product being capable of releasing further one or more electrons, and at least one reducing compound having a C/H value of 3 or less, and another reducing compound having a C/H value of more than 3, the C/H value representing a ratio of (the number of Group IV elements)/(the sum of Groups III, V, VI and VII elements).

2. A silver halide photosensitive material comprising at least one light sensitive silver halide emulsion layer on a support, wherein the silver halide photosensitive material contains:

at least one compound capable of undergoing a one-electron oxidation to thereby form a one-electron oxidation product thereof, the one-electron oxidation product being capable of releasing further one or more electrons, and at least one reducing compound having a molecular weight of 300 or less, and another reducing compound having a molecular weight of more than 300.

3. The silver halide photosensitive material according to claim 1, wherein the one-electron oxidation product-generated by one-electron oxidation, is capable of releasing further two or more electrons.

4. The silver halide photosensitive material according to claim 1, wherein the compound capable of undergoing a one-electron oxidation to thereby form a one-electron oxidation product thereof wherein the one-electron oxidation product is capable of releasing further one or more electrons, is selected from the following compounds of types 1 to 5:

(Type 1)

a compound capable of undergoing a one-electron oxidation to thereby form a one-electron oxidation product thereof, wherein the one-electron oxidation product is capable of releasing further two or more electrons accompanying a subsequent bond cleavage reaction;

(Type 2)

a compound capable of undergoing a one-electron oxidation to thereby form a one-electron oxidation product thereof, wherein the one-electron oxidation product is capable of releasing further one electron accompanying a subsequent bond cleavage reaction, and the compound has, in its molecule, two or more groups adsorptive to silver halide;

(Type 3)

a compound capable of undergoing a one-electron oxidation to thereby form a one-electron oxidation product thereof, wherein the one-electron oxidation product is capable of releasing further one or more electrons after going through a subsequent bond forming process;

(Type 4)

a compound capable of undergoing a one-electron oxidation to thereby form a one-electron oxidation product thereof, wherein the one-electron oxidation product is capable of releasing further one or more electrons after going through a subsequent intramolecular ring cleavage reaction; and (Type 5)

a compound having a formula: X—Y wherein X represents a reducing group, and Y represents a splitting-off group, wherein the reducing group represented by X is capable of undergoing a one-electron oxidation to thereby form a one-electron oxidation product thereof, from which Y is split accompanying a subsequent cleavage reaction of X—Y bond to thereby form an X radical, the X radical capable of further releasing one electron.

5. The silver halide photosensitive material according to claim 1, wherein the compounds of types 1 to 5 are represented by the following general formula (A), general formula (B), general formula (1), general formula (2), general formula (3), general formula (C), general formula (D), general formula (E), general formula (F) or general formula (G):

(A)

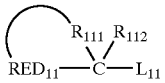

(B)

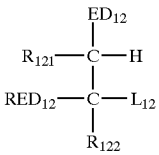

(1)

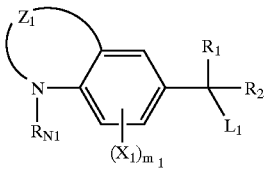

(2)

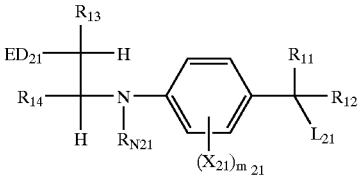

-continued (3)

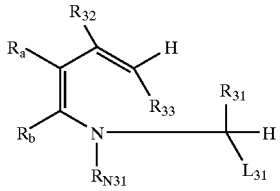

(C)

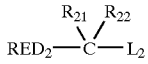

(D)

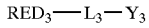

(E)

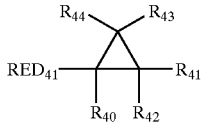

(F)

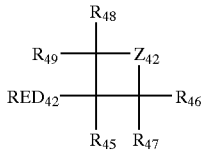

(G)

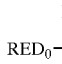

wherein in the general formula (A), $RED_{11}$ represents a one-electron oxidizable reducing group; $L_{11}$ represents a split-off group; $R_{112}$ represents a hydrogen atom or substituent; and $R_{111}$ represents a nonmetallic atomic group capable of forming, together with carbon atom (C) and $RED_{11}$, a specific 5- or 6-membered cyclic structure, wherein the 5- or 6-membered cyclic structure is selected from the group consisting of a tetrahydro form, hexahydro form and octahydro form of a 5- or 6-membered aromatic ring (including an aromatic heterocycle);

in the general formula (B), $RED_{12}$ represents a one-electron oxidizable reducing group; $L_{12}$ represents a split-off group; each of $R_{121}$ and $R_{122}$ represents a hydrogen atom or substituent; and $ED_{12}$ represents an electron-donating group, provided that $R_{121}$ and $RED_{12}$, or $R_{121}$ and $R_{122}$, or $ED_{12}$ and $RED_{12}$ may be bonded with each other to thereby form a cyclic structure;

in the general formula (1), $Z_1$ represents an atomic group capable of forming a 6-membered ring together with the nitrogen atom and the two carbon atoms of the benzene ring; each of $R_1$, $R_2$ and $R_{N1}$ represents a hydrogen atom or substituent; $X_1$ represents a group capable of substituting on the benzene ring; $m_1$ is an integer of 0 to 3; and $L_1$ represents a split-off group;

in the general formula (2), $ED_{21}$ represents an electron-donating group; each of $R_{11}$, $R_{12}$, $R_{N21}$, $R_{13}$ and $R_{14}$ represents a hydrogen atom or substituent; $X_{21}$ represents a substituent capable of substituting on the benzene ring; $m_{21}$ is an integer of 0 to 3; and $L_{21}$ represents a split-off group, provided that any two of $R_{N21}$, $R_{13}$, $R_{14}$, $X_{21}$ and $ED_{21}$ may be bonded with each other to thereby form a cyclic structure;

in the general formula (3), each of $R_{32}$, $R_{33}$, $R_{31}$, $R_{N31}$, $R_a$ and $R_b$ represents a hydrogen atom or substituent; and $L_{31}$ represents a split-off group, provided that when $R_{N31}$ represents a group other than an aryl group, $R_a$ and $R_b$ are bonded to each other to thereby form an aromatic ring;

in the general formula (C), $RED_2$ has the same meaning as $RED_{12}$ of the general formula (B); $L_2$ has the same meaning as $L_{11}$ of the general formula (A), provided that when $L_2$ represents a silyl group the compound represented by the general formula (C) has, in its molecular, a nitrogen-containing heterocycle that is substituted with two or more mercapto groups, as the group adsorptive to silver halide; each of $R_{21}$ and $R_{22}$ represents a hydrogen atom or substituent; and $RED_2$ and $R_{21}$ may be bonded with each other to thereby form a cyclic structure;

in the general formula (D), $RED_3$ represents a one-electron oxidizable reducing group; $Y_3$ represents a reactive moiety that reacts with one electron oxidized $RED_3$; $L_3$ represents a linking group that links between $RED_3$ and $Y_3$;

in the general formulae (E) and (F), each of $RED_{41}$ and $RED_{42}$ has the same meaning as $RED_{12}$ of the general formula (B); and each of $R_{40}$ to $R_{49}$ represents a hydrogen atom or substituent;

in the general formula (F), $Z_{42}$ represents —$CR_{420}R_{421}$—, —$NR_{423}$— or —O—, wherein each of $R_{420}$ and $R_{421}$ represents a hydrogen atom or substituent; and $R_{423}$ represents a hydrogen atom, alkyl group, aryl group or heterocyclic group; and in the general formula (G), $RED_0$ represents a reducing group; $L_0$ represents a splitting-off group; and $R_0$ and $R_{00}$ each represents a hydrogen atom or substituent, provided that $RED_0$ and $R_0$, or $R_0$ and $R_{00}$ may be bonded together to form a cyclic structure.

6. The silver halide photosensitive material according to claim 1, wherein the reducing compound is a compound selected from the group consisting of hydroxylamines, hydroxamic acids, hydroxyureas, hydroxyurethanes, hydroxysemicarbazides, reductons (including reducton derivatives), anilines, phenols (including chroman-6-ols, 2,3-dihydrobenzofuran-5-ols, aminophenols, sulfonamidophenols, and polyphenols such as hydroquinones, catechols, resorcinols, benzenetriols and bisphenols), hydrazines, hydrazides, and Phenidons.

7. The silver halide photosensitive material according to claim 6, wherein the reducing compound is a compound selected from the group consisting of hydroxylamines represented by the following general formula ($B_{14}$) and hydroxamic acids represented by the following general formula ($B_{15}$):

($B_{14}$)

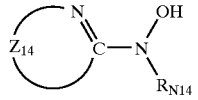

($B_{15}$)

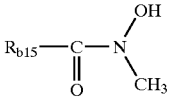

wherein in the general formula ($B_{14}$), $R_{N14}$ represents a hydrogen atom, alkyl group or aryl group; and $Z_{14}$ represents a nonmetallic atom group capable of forming, together with —N=C—, a 5- to 7-membered heterocycle; and in the general formula ($B_{15}$), $Rb_{15}$ represents a hydrogen atom, alkyl group, aryl group or heterocycle.

8. The silver halide photosensitive material according to claim 1, wherein the compounds of types 1 to 5 each has, in its molecule, a group adsorptive to silver halide or a partial structure of sensitizing dye.

9. The silver halide photosensitive material according to claim 2, wherein the one-electron oxidation product generated by one-electron oxidation, is capable of releasing further two or more electrons.

10. The silver halide photosensitive material according to claim 2, wherein the compound capable of undergoing a one-electron oxidation to thereby form a one-electron oxidation product thereof wherein the one-electron oxidation product is capable of releasing further one or more electrons, is selected from the following compounds of types 1 to 5:

(Type 1)

a compound capable of undergoing a one-electron oxidation to thereby form a one-electron oxidation product thereof, wherein the one-electron oxidation product is capable of releasing further two or more electrons accompanying a subsequent bond cleavage reaction;

(Type 2)

a compound capable of undergoing a one-electron oxidation to thereby form a one-electron oxidation product thereof, wherein the one-electron oxidation product is capable of releasing further one electron accompanying a subsequent bond cleavage reaction, and the compound has, in its molecule, two or more groups adsorptive to silver halide;

(Type 3)

a compound capable of undergoing a one-electron oxidation to thereby form a one-electron oxidation product thereof, wherein the one-electron oxidation product is capable of releasing further one or more electrons after going through a subsequent bond forming process;

(Type 4)

a compound capable of undergoing a one-electron oxidation to thereby form a one-electron oxidation product thereof, wherein the one-electron oxidation product is capable of releasing further one or more electrons after going through a subsequent intramolecular ring cleavage reaction; and (Type 5)

a compound having a formula: X—Y wherein X represents a reducing group, and Y represents a splitting-off group, wherein the reducing group represented by X is capable of undergoing a one-electron oxidation to thereby form a one-electron oxidation product thereof, from which Y is split accompanying a subsequent cleavage reaction of X—Y bond to thereby form an X radical, the X radical capable of further releasing one electron.

11. The silver halide photosensitive material according to claim 2, wherein the compounds of types 1 to 5 are represented by the following general formula (A), general formula (B), general formula (1), general formula (2), general formula (3), general formula (C), general formula (D), general formula (E), general formula (F) or general formula (G):

(A)

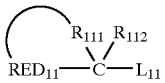

(B)

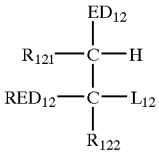

(1)

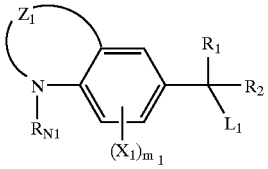

(2)

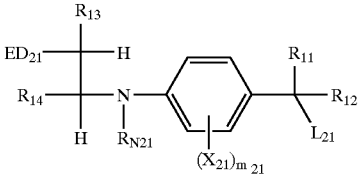

(3)

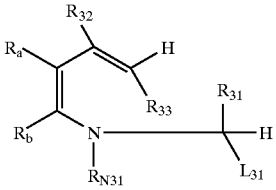

(C)

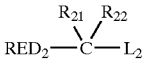

(D)

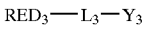

(E)

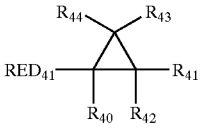

(F)

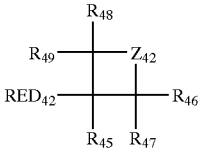

(G)

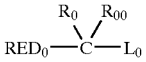

wherein in the general formula (A), $RED_{11}$ represents a one-electron oxidizable reducing group; $L_{11}$ represents a split-off group; $R_{112}$ represents a hydrogen atom or substituent; and $R_{111}$ represents a nonmetallic atomic group capable of forming, together with carbon atom (C) and $RED_{11}$, a specific 5- or 6-membered cyclic structure, wherein the 5- or 6-membered cyclic structure is selected from the group consisting of a tetrahydro form, hexahydro form and octahydro form of a 5- or 6-membered aromatic ring (including an aromatic heterocycle);

in the general formula (B), $RED_{12}$ represents a one-electron oxidizable reducing group; $L_{12}$ represents a split-off group; each of $R_{121}$ and $R_{122}$ represents a hydrogen atom or substituent; and $ED_{12}$ represents an electron-donating group, provided that $R_{121}$ and $RED_{12}$, or $R_{121}$ and $R_{122}$, or $ED_{12}$ and $RED_{12}$ may be bonded with each other to thereby form a cyclic structure;

in the general formula (1), $Z_1$ represents an atomic group capable of forming a 6-membered ring together with the nitrogen atom and the two carbon atoms of the benzene ring; each of $R_1$, $R_2$ and $R_{N1}$ represents a hydrogen atom or substituent; $X_1$ represents a group capable of substituting on the benzene ring; $m_1$ is an integer of 0 to 3; and $L_1$ represents a split-off group;

in the general formula (2), $ED_{21}$ represents an electron-donating group; each of $R_{11}$, $R_{12}$, $R_{N21}$, $R_{13}$ and $R_{14}$ represents a hydrogen atom or substituent; $X_{21}$ represents a substituent capable of substituting on the benzene ring; $m_{21}$ is an integer of 0 to 3; and $L_{21}$ represents a split-off group, provided that any two of $R_{N21}$, $R_{13}$, $R_{14}$, $X_{21}$ and $ED_{21}$ may be bonded with each other to thereby form a cyclic structure;

in the general formula (3), each of $R_{32}$, $R_{33}$, $R_{31}$, $R_{N31}$, $R_a$ and $R_b$ represents a hydrogen atom or substituent; and $L_{31}$ represents a split-off group, provided that when $R_{N31}$ represents a group other than an aryl group, $R_a$ and $R_b$ are bonded to each other to thereby form an aromatic ring;

in the general formula (C), $RED_2$ has the same meaning as $RED_{12}$ of the general formula (B); $L_2$ has the same meaning as $L_{11}$ of the general formula (A), provided that when $L_2$ represents a silyl group the compound represented by the general formula (C) has, in its molecular, a nitrogen-containing heterocycle that is substituted with two or more mercapto groups, as the group adsorptive to silver halide; each of $R_{21}$ and $R_{22}$ represents a hydrogen atom or substituent; and $RED_2$ and $R_{21}$ may be bonded with each other to thereby form a cyclic structure;

in the general formula (D), $RED_3$ represents a one-electron oxidizable reducing group; $Y_3$ represents a reactive moiety that reacts with one electron oxidized $RED_3$; $L_3$ represents a linking group that links between $RED_3$ and $Y_3$;

in the general formulae (E) and (F), each of $RED_{41}$ and $RED_{42}$ has the same meaning as $RED_{12}$ of the general formula (B); and each of $R_{40}$ to $R_{49}$ represents a hydrogen atom or substituent;

in the general formula (F), $Z_{42}$ represents —$CR_{420}R_{421}$—, —$NR_{423}$— or —O—, wherein each of $R_{420}$ and $R_{421}$ represents a hydrogen atom or substituent; and $R_{423}$ represents a hydrogen atom, alkyl group, aryl group or heterocyclic group; and in the general formula (G), $RED_0$ represents a reducing group; $L_0$ represents a splitting-off group; and $R_0$ and $R_{00}$ each represents a hydrogen atom or substituent, provided that $RED_0$ and $R_0$, or $R_0$ and $R_{00}$ may be bonded together to form a cyclic structure.

12. The silver halide photosensitive material according to claim 2, wherein the reducing compound is a compound selected from the group consisting of hydroxylamines, hydroxamic acids, hydroxyureas, hydroxyurethanes, hydroxysemicarbazides, reductons (including reducton derivatives), anilines, phenols (including chroman-6-ols, 2,3-dihydrobenzofuran-5-ols, aminophenols, sulfonamidophenols, and polyphenols such as hydroquinones, catechols, resorcinols, benzenetriols and bisphenols), hydrazines, hydrazides, and Phenidons.

13. The silver halide photosensitive material according to claim 12, wherein the reducing compound is a compound selected from the group consisting of hydroxylamines represented by the following general formula ($B_{14}$) and hydroxamic acids represented by the following general formula ($B_{15}$):

($B_{14}$)

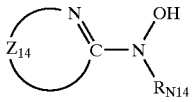

-continued ($B_{15}$)

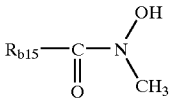

wherein in the general formula ($B_{14}$), $R_{N14}$ represents a hydrogen atom, alkyl group or aryl group; and $Z_{14}$ represents a nonmetallic atom group capable of forming, together with —N═C—, a 5- to 7-membered heterocycle; and in the general formula ($B_{15}$), $Rb_{15}$ represents a hydrogen atom, alkyl group, aryl group or heterocycle.

14. The silver halide photosensitive material according to claim 2, wherein the compounds of types 1 to 5 each has, in its molecule, a group adsorptive to silver halide or a partial structure of sensitizing dye.

* * * * *